US006569066B1

(12) United States Patent
Patterson et al.

(10) Patent No.: US 6,569,066 B1
(45) Date of Patent: May 27, 2003

(54) UPPER EXTREMITY REHABILITATION AND TRAINING DEVICE AND METHOD

(76) Inventors: Paul Patterson, 87 Ch. Pic Bois, Val Des Monts, Quebec (CA), J8N-6C4; Kieth E. Pyne, 3007 Cole Ave., Apt. 124, Dallas, TX (US) 75024; Charles Poliquin, 625 Paint Brush La., Monument, CO (US) 80132

( * ) Notice: Subject to any disclaimer, the term of this patent is extended or adjusted under 35 U.S.C. 154(b) by 0 days.

(21) Appl. No.: 09/585,462

(22) Filed: May 31, 2000

(51) Int. Cl.[7] ..... A63B 21/075
(52) U.S. Cl. ..... 482/99; 482/106; 482/108
(58) Field of Search ..... 482/99, 106, 108, 482/93, 49, 50, 148, 140, 904

(56) References Cited

U.S. PATENT DOCUMENTS

| | | | | |
|---|---|---|---|---|
| 3,185,476 A | | 5/1965 | Fechner | |
| 3,347,240 A | * | 10/1967 | Rigler | |
| 4,109,908 A | * | 8/1978 | Pugh et al. | |
| 4,695,051 A | * | 9/1987 | Jenison | |
| 4,858,916 A | * | 8/1989 | Beaumont | 482/44 |
| 5,342,268 A | | 8/1994 | Caruthers | |
| 5,709,637 A | | 1/1998 | Gow et al. | 482/129 |
| 5,951,813 A | * | 9/1999 | Warren | 482/44 |

* cited by examiner

*Primary Examiner*—Jerome W. Donnelly
(74) *Attorney, Agent, or Firm*—Conley Rose, P.C.

(57) ABSTRACT

An upper extremity training and rehabilitation device includes a base having a distal end and a proximal end, an opening at the proximal end adapted for insertion of an exerciser's hand, and at least one notch formed at at least one of the distal end or the proximal end, as well as a handle disposed within the opening of the base. The device can be used with or without a flexible member attached to the device, the flexible member being used to apply tensile force to the device during exercise. The device can include additional weights that can be attached to the device for various exercises. The handle of the device can also be adjusted to vary the moment arm applied during exercise. The point of attachment of the flexible member and the handle position relative the base can be varied in order to vary the moment arm applied during exercises. A method for upper extremity rehabilitation and training utilizes a base having an opening with a handle disposed therein for grasping by an exerciser. Also presented are methods of performing various exercises that optimally stimulate the upper extremity kinetic chain generally, and the hand/wrist complex in particular, in order to improve strength, flexibility, proprioception, and muscle tonus, as well as reduce pain. A method of resetting spasmed muscle fibers to normal muscle tonus is also presented.

38 Claims, 73 Drawing Sheets

UPPER EXTREMITY REHABILITATION AND TRAINING DEVICE AND METHOD

CLAIM OF PRIORITY

This application claims priority from a U.S. Provisional Patent Application to Patterson, et. al, filed May 5, 2000, entitled "Upper Extremity Rehabilitation and Training Device and Method".

TECHNICAL FIELD OF THE INVENTION

This invention relates generally to training and rehabilitation of the upper extremities using inertial resistance.

BACKGROUND

Most functional activities, such as competitive sports, require coordinated movement of and function at multiple muscles and joints. An example of such an activity is the act of throwing a baseball, which requires coordinated use of, inter alia, the muscles serving the hand/wrist, elbow, shoulder, and scapular muscle-joint complexes. Each of these muscle-joint complexes includes major and minor mover muscles, which flex-extend, adduct-abduct, supinate-pronate, stabilize and rotate. These four muscle-joint complexes are collectively referred to as the upper extremity kinetic chain.

To effectively throw a baseball optimally and avoid injury, a player must be able to coordinate both the major and minor movers as well as the stabilizer and rotator muscles of the entire upper extremity kinetic chain. If this coordination is less than optimal, injury and/or diminished performance often result. As a consequence, in order to optimally train and/or rehabilitate the upper extremities for real life and/or real sport expression of maximal upper body performance potential, coordinated, neuro-muscularly efficient, four-muscle-joint-complex training of the entire upper extremities' kinetic chains is necessary.

The use of various devices, such as barbells, dumbbells, and exercise machines, for rehabilitation, fitness, and performance enhancement of athletes and other individuals is well known. These devices use some type of inertial resistance against which one or more of an exerciser's muscle groups exert.

Dumbbells are often used for training the upper extremities and typically consist of a handle connecting a pair of weighted discs. A dumbbell is typically balanced so that its center of gravity is located at the middle of its handle, so that an exerciser can grasp the handle with one hand and perform inertial-resistance exercises.

Barbells are also primarily used for training the upper extremities. They typically consist of a relatively elongated cylindrical bar used as a handle that connects a pair of weighted discs, the bar most often being gripped by an exerciser with both hands while performing inertial-resistance exercises. The center of gravity of a barbell is normally positioned in the center of the bar between the weighted discs, which position allows an exerciser to balance the barbell in both hands while performing inertial-resistance exercises. Barbells are normally either made so that weighted discs can be slid on and off the bar or with fixed weighted discs permanently attached. Dumbbells and barbells are collectively termed free weights.

Numerous exercise machines have been devised to train and/or rehabilitate the upper extremities. Exercise machines most often consist of an inertial resistance such as a weight, elastic member or flexible member, hydraulic piston, or the like, which is connected to a part of an exerciser's body by a handle, pad, stirrup, strap, or other means for transferring force applied by muscular effort by the exerciser via a cable, lever, or other connective means to the inertial resistance.

One drawback to prior art free weights and exercise machines is their inability to exercise the stabilizer and rotator muscles of the upper extremity kinetic chain. This is due to the fact that free weights and machines involve two-dimensional exercise movement paths while stability and rotational strength stimuli require three dimensional exercise movement paths. During prior art upper extremity free weight and exercise machine exercises, one or both hands are typically used to grasp an exercise machine handle, barbell or dumbbell. An exerciser's hand/wrist is normally fixed in either a fully supinated or in a partially pronated position. A prior art barbell biceps curl, for example, is typically performed with the hand/wrist in a fully supinated position and in a static isometric contraction. Other than a limited static hand/wrist muscle-joint resistance to extension/flexion that occurs as the wrist is statically held in a neutral position between full wrist flexion and full wrist extension, there is no further hand/wrist muscle-joint complex flexion/extension, supination-pronation, or ulnar-radial deviation training stimulus. Moreover, there is no hand/wrist muscle-joint complex range of motion stimulus and little or no stability strength stimulus since the center of gravity of the bar or handle is located in the center of the exerciser's fist.

In a prior art barbell biceps curl, the exerciser's hand/wrist muscle-joint complex does not have to stabilize with respect to radial/ulnar deviation, nor does the elbow muscle-joint complex have to resist supination/pronation. Thus, an upper extremity exercise such as the barbell biceps curl is designated a dead hand exercise, because it stresses the elbow flexor muscles (i.e., the major movers for a barbell biceps curl) almost exclusively, and, at best, only minimally stimulates the stabilizer muscles of the upper extremity kinetic chain, including the hand/wrist, the limited isometric flexion/extension of the hand/wrist muscle-joint complex discussed above being the minimal stabilizer stimulus. The term dead hand refers to an essentially fixed isometrically contracted hand-wrist position which predominates during the use of a traditional barbell in particular, dumbbell use to a lesser degree, and most exercise machines. The isometric dead hand position is neutral between wrist flexion and extension, and wrist ulnar and radial deviation. Once the start position of a dead hand exercise is assumed, the hand-wrist remains isometrically fixed for the duration of the exercise.

Another of the drawbacks of prior art free weights and exercise machines is their inability to provide moment arm variations in the exercises they are designed to allow a exerciser to perform. The term moment arm variations refers to the ability to change not only the amount of inertial resistance applied during the exercise, but also its point of application, so that the torque, linear resistance, and/or stabilizing resistance applied to the upper extremity kinetic chain can be varied and customized to train strength and flexibility across all movement potentials of all four muscle-joint complexes of the upper extremity kinetic chain.

By variation of the moment arms applied to the upper extremity kinetic chain during an exercise, changes in the resistance curve of the exercise and the stress placed on the major and minor movers as well as the rotator and stabilizer muscles of the upper extremity kinetic chain during the exercise could be varied so that the rehabilitation and training goals of the exercise could be more readily and optimally achieved. Optimal training and rehabilitation requires full anatomic range of motion movement capability across the hand/wrist, elbow, shoulder, and scapular muscle-joint complexes with four-dimensional strength-stimulus (i.e., forward/backward, side-to-side, up-down, and rotational) to provide optimal training of the upper extremity kinetic chain. Such optimal training enables maximal speed and power expression in all movement potentials. In addition, the ability to vary the moment arm permits an exerciser to more precisely tailor the exercise to a real-world and/or real sport activity for which he wants to train and/or rehabilitate. Unfortunately, prior art exercises and devices do not permit such optimal training or rehabilitation.

It is well known that a prior art dumbbell can be used with a single slightly varying moment arm along the axis of the handle, which extends between the two weighted discs. In particular, an exerciser sometimes will grip the handle of the dumbbell with one side of their fist abutting against one of the weighted discs so that the center of gravity of the dumbbell is no longer in the center of the fist. By so doing, the exerciser can slightly vary the moment arm in such a way as to increase the torque applied, for example, during either pronation or supination of the elbow muscle-joint complex. However, the ability of a prior art dumbbell to accommodate moment arm variations is limited and does not adequately stimulate the rotator and stabilizer muscles of the upper extremity kinetic chain because the supination/pronation function of the elbow muscle-joint complex is minimally stressed, while the other muscles of the upper extremity kinetic chain remain basically unaffected.

The application of the dumbbell fly exercise to the four-joint kinetic chain illustrates the delimited training effect of prior art training. Throughout the exercise, the hand/wrist remains in a isometrically contracted position mid-way between flexion and extension and between radial and ulnar deviation once the dumbbell has been grasped. Similarly, throughout the exercise, the forearm is pronated in an isometric contraction. During the exercise, the elbow is partially flexed while the shoulder performs lateral abduction. Thus, the exercise is essentially two-dimensional and there is little or no rotational or stability-strength stimulus and the exerciser is only performing the exercise in opposition to the pull of gravity.

Prior art barbells and exercise machines are even more limited than dumbbells with respect to moment arm variations, both in the number and degree of moment arm variations that are possible and in their ability to train the rotator and stabilizer muscles of the upper extremity kinetic chain as a result of the variations. Exercise machines typically provide no moment arm variations during the course of an exercise. Moreover, the number and degree of moment arm variations, if any, provided by an exercise machine, would by necessity be fixed by the machine's structure, which would also eliminate stimulus of the stabilizer muscles, given that exercise machines do the stabilizing for the exerciser and thus allow the exerciser to work only the major movers at a single joint, as a result of the machines' fixed exercise movement paths.

Prior art barbells are even more unsuited for application of moment arm variations because of their typical use while in an exerciser's hands; it is therefore apparent that if an exerciser were to attempt to vary the moment arm, for example, by gripping the barbell off center, either removable weights could slide off the bar or the exerciser could be placed in danger as a result of losing control of the barbell. This would especially be true with respect to pressing movements in which the exerciser is underneath the bar.

Another drawback associated with free weights and exercise machines is their inability to adequately correct an exerciser's limited range of motion in one or more of the four muscle-joint complexes of the upper extremity kinetic chain so that the exerciser can perform a given exercise to his or her full anatomic potential range of motion. Moreover, the larger the stature of the exerciser, the more the fixed design of an exercise machine delimits the effective range of motion available to the exerciser.

An exerciser's limited range of motion is often also due to the presence of chronically contracted groups of muscle fibers commonly referred to as muscle spasm. Muscle spasm inherently inhibits movement, by neuro-muscular reflex action, particularly movement toward the extremes of a given joint's range of motion. In most cases, the spasmed muscle fibers are not under conscious control and, when called on to move a joint structure into an unfamiliar part of a given range of motion, trigger further contraction, by protective reflex, of adjacent muscle(s) in an effort to protect the muscle-joint complex from injury or further injury. The spasmed muscle tissue can be disrupted or torn more easily due to its lowered elasticity. In addition, muscle spasm causes decreased blood and lymphatic fluid flow to the spasmed tissue, and resultant slowed healing, as well as impaired performance due to pain and decreased range of motion.

Unfortunately, optimal release of muscle spasm and reset of muscle tonus is unachievable using prior art free weights and exercise machines. Prior art exercise machines limit range of motion due to their two-dimensional fixed movement paths, and are largely dimensionally fixed; as such, they do not optimally accommodate different-sized exercisers. They also provide little or no stability strength stimulus because the machine stabilizes the weight for the exerciser. Free weights are only marginally effective at resetting muscle tonus because they operate only against gravity and provide little or no rotational stimulus. As such, free weights provide only two-dimensional strength stimulus; therefore, primary rotators, such as the teres major and popliteus, can go into spasm, remain in such a state, and inhibit movement via protective inhibition.

Spasming of muscle fibers in stabilizer and rotator muscles commonly occurs as these muscle groups become progressively weaker in relation to major movers. Prior art free weight and exercise machine exercises are simply not able to provide the training stimuli necessary to fully develop the functional capacity of these specialized muscles. As such free weight and/or machine exercises are repeatedly performed, strength and flexibility (i.e., range of motion) imbalances are either created or are magnified as the major movers targeted by prior art exercise machine and free weight exercises become stronger, while the stabilizer and rotator muscles become comparatively unconditioned (i.e., relatively weak, often with relatively more muscle spasm). Once such muscle imbalances are present, the stabilizer/rotator muscles tend to spasm (i.e., chronically contract) to protect the related joint structure(s) and themselves from damage caused by the action of the ever-stronger major movers.

Perhaps even more significant is the pain that results from chronically spasmed muscle tissue, given that not only the involved muscle tissue but also related nerve structures are chronically in circulatory deficit with respect to both blood and lymphatic fluid. To reset muscle tonus to normal levels requires exercises that offer a comprehensive full range of motion across rotary, flexor/extensor, supinator/pronator, and exercise movement and a complete array of slow speed to high speed training stimuli. Prior art free weights and machines are heavily momentum-limited in that once an exerciser moves the weight quickly, the weight develops momentum and then must be slowed down. This causes safety risks and injury potential, thus requiring that free weights and most machines be used at slow to moderate exercise speeds. The negative phase of these exercises usually involves lowering the weight in response to gravity, during which lowering slow exercise speeds are required. High exercise speeds are not usually advisable under these conditions and full range of motion movements are usually avoided.

Prior art free weights and exercise machines fail to provide this range of training stimuli, largely because of their inability to completely train the stabilizer/rotator muscles, let alone provide comprehensive training of the entire upper extremity kinetic chain. Full anatomic ranges of motion are simply not possible, and thus the alleviation of muscle spasm and the resetting of muscle tonus is also not possible.

Another drawback of prior art free weights and exercise machines is that they are based on a single-joint-dominant training mode model, in which only major movers are stressed and development of stabilizer/rotator muscles is neglected. An example of a single-joint-dominant training mode exercise is the prior art barbell biceps curl. In the prior art barbell biceps curl, only the elbow muscle-joint complex flexor muscles (i.e., biceps) are stressed, to the exclusion of the biceps' role as a supinator of the hand/wrist muscle-joint complex, while the rotator/stabilizer muscles of the upper extremity kinetic chain, including the hand/wrist, shoulder, and scapular complexes are relatively neglected. As a result of the single-joint dominant training mode model, prior art free weights and exercise machines have been used to train the major movers solely as flexors and extensors, emphasizing flexion/extension of hand/wrist and elbow joint and adduction/abduction of the shoulder joint. They have all but ignored the rotary and stabilization functions of both major and minor movers across all four joints of the upper extremity kinetic chain.

In contrast, real-world activities, such as a baseball throw, require coordinated action of the minor and major movers, particularly their rotational and stabilization functions, of the entire upper extremity kinetic chain. Thus, the use of prior art free weights and exercise machines can create muscle strength imbalances as major movers are strengthened as flexors and extensors, while the exerciser's rotary and stabilization functionality becomes relatively less. Once the exerciser then attempts to engage in a real-world or real-sport activity that calls on the major and minor movers to act in a coordinated three-dimensional fashion, decreased performance and/or injury become more and more likely.

Virtually all real-world upper extremity movements involve the upper extremity kinetic chain performing one or more of ten movements: hand/wrist radial deviation; hand/wrist ulnar deviation; hand/wrist flexion; hand/wrist extension; forearm supination; forearm pronation; elbow flexion; elbow extension; scapular protraction; scapular retraction; or various combinations of these movements. These ten movements cannot be fully trained along the entire upper extremity kinetic chain using prior art free weights or machines because movements using such devices are dead-hand movements. In effect the hand/wrist complex is used only for fist/finger flexion in an isometric contraction mode during the entire exercise, and in effect merely acts as a static link between the upper extremity and the free weight or exercise machine so that the load can be applied to the specific major mover(s) of the upper extremity targeted by the exercise.

The statically and isometrically contracted (i.e., dead hand) hand/wrist position of most free weight and exercise machines means that the rotary capability of an exerciser will be undertrained by prior art free weight and machine exercises. The effect of incomplete hand/wrist training has a domino-like effect along the upper extremity kinetic chain. The hand/wrist is not rotary trained; therefore, the elbow is not rotary trained. Once it is recognized, for example, that the biceps is a major mover for supination and that the biceps' origins are at two different sites in the shoulder joint, all three joint complexes (i.e., hand/wrist, elbow, and shoulder) remain undertrained by prior art free weight and exercise machine exercises.

The development of efficient four-joint coordination and motor patterning resulting in maximal performance expression of the entire upper extremity kinetic chain cannot be achieved unless all four joints of the upper extremity kinetic chain are trained in a coordinated manner that simulates real-world activity. This has been unachievable using prior art free weights and exercise machines.

Another drawback to prior art free weights and exercise machines is their failure to enable the exerciser to fine tune and upgrade their proprioceptive sense to accommodate real-world/sport demands. Proprioception has been generally defined as an organism's precise sense of where it is in space and where its body parts are in relation to one another. In the context of inertial resistance exercise, proprioception is the ability of an exerciser to know where his body is positioned throughout the exercise range of motion, which allows the muscle fibers specifically, and various muscles generally, to be coordinated and fire in the proper sequence in order to properly execute the desired movement throughout the entire exercise.

If, for example, a baseball pitcher has not been properly proprioceptively conditioned and, as a result, his shoulder muscle-joint complex's external rotator muscles are strong but other parts of his upper extremity kinetic chain, such as the stabilizer muscles, are weak and/or spasmed, he will be unable to optimally implement the precise motor pattern required to skillfully throw the baseball. This inability will result in a significant chance of injury due to abbreviated ranges of motion caused by spasmed muscle fiber that not only cannot contribute to developing force to throw the ball, but which also inhibits the remaining muscle fiber from developing force maximally and/or explosively.

Imbalance in the stabilizer muscles invariably leads to diminished performance and an enhanced risk of injury. Premature firing of stabilizer/antagonist muscles to decelerate the upper extremity during an attempt to execute a high-speed full range of motion upper extremity kinetic chain movement will often occur. For example, if a javelin thrower has weak and/or spasmed stabilizer muscles anywhere in the upper extremity kinetic chain, the stabilizer/antagonist muscles will tend to contract to inhibit the throwing movement before he has released the javelin. This premature antagonist/stabilizer muscle firing occurs as a protective mechanism (i.e., protective inhibition), in an effort to slow the thrower's arm so that the major movers do not overpower the weak/spasmed stabilizer muscles and damage them or the joints themselves.

Thus, the javelin thrower could increase his throwing speed not just by training the internal shoulder rotator/stabilizer muscles that contract during a throw, but also by training the antagonist muscles that decelerate the arm, so that the deceleration does not occur prematurely in the motion in order to protect the upper extremity from injury.

Unfortunately, prior art free weights and machines do not permit such complex training. Such complex training is not possible using prior art devices and methods because of the limitations of prior art free weights and exercise machines, in that they: 1) require slow lifting speed to control momentum; 2) employ a single-joint-dominant focus; 3) elicit a two-dimensional muscle stimulus; and 4) permit only abbreviated ranges of motion due to either machine design and/or the need to control momentum as the exercise is performed.

Full anatomic range of motion training of the stabilizer/rotator muscles, and release of muscle spasm are interrelated. Being free of muscle spasm (i.e., normal muscle tonus) allows an exerciser to train through a full anatomic range of motion by serving to minimize protective reflex inhibition, which is a natural result of the muscle spasm as the exerciser tries to protect himself from injury. Strength imbalances such as overwhelming the comparatively weak stabilizer/rotator muscles is another source of protective reflex inhibition. Once normal muscle tonus is re-established, pain/premature protective reflex inhibition ceases and full anatomic range of motion exercise is possible. The exerciser can now proceed to use his proprioceptive awareness during full anatomic range of motion exercise to develop highly-efficient movement patterns and new performance potential while maintaining his musculature relatively spasm free.

Strength imbalances between the stabilizer and major mover muscles causes what is known as the cumulative trauma cycle to begin. The cumulative trauma cycle is started when muscle strength imbalance leads to an initial injury to the muscle, which injury leads to muscle weakness and more muscle spasm. Once the muscle starts to become weaker because of the spasm, blood and lymphatic flow through the muscle are decreased. The cycle can become chronic, with further decreased blood and lymph flow to the muscles, increased spasm, and eventually scar tissue formation. Further impaired range of motion and consequent vulnerability of the muscle to more serious injury, including muscle tears, often result.

Another drawback of prior art free weights and machine exercises is their inability to train the muscles of the upper extremity kinetic chain over a full range of motion to full anatomic potential. The ability to train the upper extremities over the full anatomic range of motion is therefore of critical significance as a training and rehabilitation goal, because such training allows an exerciser to attain conscious neuromuscular control over the full anatomic range of motion for a given exercise, which enhanced range of motion results in both injury resistance and maximal performance expression. Injuries often occur due to insufficient range of motion when an upper extremity joint is taken into an unfamiliar part of range of motion by an external force such as a fall or blow; injury to soft tissue and/or joint structures often results.

Another drawback of many prior art free weights and exercise machines is their size and/or weight. Because most are relatively heavy and cumbersome, often weighing between 100 and 1000 pounds, and requiring as much as 80 cubic feet of floor space, they are not readily transportable.

SUMMARY OF THE INVENTION

These and other limitations associated with prior art exercise devices and methods are overcome by the present invention, which is used for rehabilitation and training of the upper extremities. In one aspect of the invention, there is provided a device that is adapted to permit multiple moment arm variations during live-hand exercises of the upper extremity kinetic chain. In another aspect of the invention, a device is provided that can be used to provide a training and rehabilitation stimulus to increase range of motion (i.e., flexibility) of an exercise movement to the level of full anatomic potential that can be used to provide a training and rehabilitation stimulus to increase functional strength capabilities across full anatomic potential ranges of motion.

In yet another aspect of the invention, a device is provided that includes a base having a distal end and a proximal end, an opening at the proximal end adapted for insertion of an exerciser's hand, and at least one notch formed at at least one of the distal end or the proximal end. The device also includes a handle disposed within the opening of the base. The device can be used to eliminate muscle spasm and reset muscle tonus to normal levels.

In still another aspect of the invention, a device is provided that can be used to improve proprioception and strengthen stabilizer/rotator muscles of the upper extremities. In still another aspect of the invention, a device is provided that increases blood and lymphatic fluid flow to the upper extremity muscles by releasing muscle spasm. In other aspects of the invention, various upper extremity exercises utilizing one or more live-hand devices are provided which serve to solve one or more of the above-described drawbacks associated with the prior art.

BRIEF DESCRIPTION OF THE DRAWINGS

For a more complete understanding of the present invention and the advantages thereof, reference is now made to the following description taken in conjunction with the accompanying drawings, in which like reference numbers indicate like features and wherein.

DESCRIPTION OF THE PREFERRED EMBODIMENTS

Figure 1:
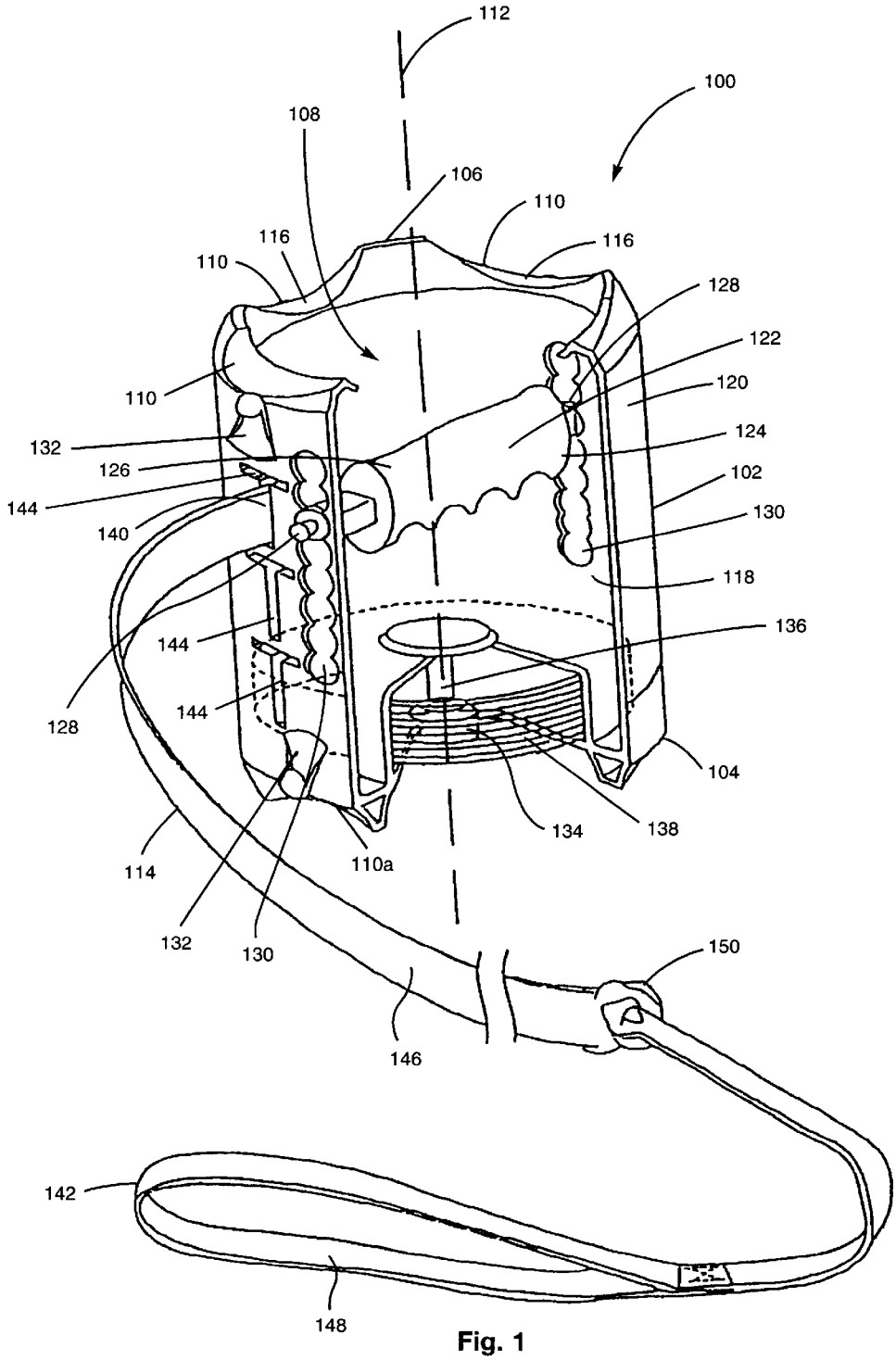
FIG. 1 is a diagram illustrating a live-hand upper extremity training and rehabilitation device 100 embodying concepts of the present invention.

Referring now to FIG. 1, shown is live-hand upper extremity training and rehabilitation device 100 embodying concepts of the present invention. The term live-hand refers to a dynamic, four-dimensional (i.e., up-down/side-side/rotational) resistance application that varies continuously throughout the duration of an exercise. A live-hand device optimally stimulates all three pairs of possible anatomic movements of the hand-wrist-forearm complex (i.e., ulnar-radial deviation; flexion-extension; supination-pronation) by forcing the exerciser to engage his entire upper extremity kinetic chain during exercises performed with the device. The device includes a cross-sectionally substantially cylindrical annular' base 102 having a distal end 104 and a proximal end 106, an opening 108 at the proximal end 106, a plurality of proximal notches 110 proximate the proximal end 106 and distal notches 110*a* proximate the distal end 104, and a longitudinal axis 112 running substantially perpendicularly to the ends 104 and 106 of the base 102. The proximal end 106 is the end of the base 102 into which an exerciser inserts his hand to use the device 100. Conversely, the distal end 104 is the end opposite the proximal end 106. The distal end 104 and the proximal end 106 preferably form substantially right angles to the exterior surface 120 of the base 102. Although the base 102 as shown is substantially cylindrical in cross-section, the base 102 can be made virtually any desired shape in cross-section, such as triangular, square, pentagonal, hexagonal, octagonal, elliptical, etc. The base also can include VELCRO surfaces (not shown) for use in securing various weights to the base 102. Of course, the base 102 can also have an opening at the distal end 104 if so desired.

The device 100 is preferably adapted to permit a flexible member 114 to engage at least one distal notch 110*a* and/or at least one proximal notch 110, such as when the device 100 is moved by an exerciser so that the flexible member 114 passes across one or more of the notches 110 or 110*a* to an inertial resistance (not shown) to which the flexible member 114 is attached. A deepest point 116 of each notch 110 or 110*a* is defined as the point on the notch 110 or 110*a* closest to the opposite end 104 or 106 of the base 102. For example, the deepest point 116 of a proximal notch 110 is the closest point on the proximal notch 110 to the distal end 104 of the base 102.

As shown in FIG. 1, the base 102 has an interior surface 118 and an opposing exterior surface 120. In a preferred embodiment, the exterior surface 120 of the base 102 is covered at least in part by a non-slip material (not shown). The base 102 also preferably includes at least one indicator (not shown) to demarcate rotation of the device 100 in an exerciser's hand. For example, the base 102 can be divided circumferentially into two or more sections (not shown) around the longitudinal axis 112 and each of the sections (not shown) painted a different color or a system of LED lights (not shown) can be employed on the proximal end 106 which turns on as the device 100 is rotated so that an exerciser can easily assess how much he has been able to rotate the device 100 in his hand during an exercise.

The device 100 also includes a handle 122 having a thumb end 124 and a little-finger end 126 disposed within the opening 108 of the base. Which of the ends 124 and 126 of the handle is the thumb end 124 and which is the little-finger end 126 depends on which hand an exerciser grasps the handle 122 with. In a preferred embodiment, the handle 122 is adapted to be grasped by either hand. Of course, the handle 122 can also be tailored to only be used by an exerciser's right hand or left hand.

The handle 122 preferably is positioned substantially perpendicularly to the longitudinal axis 112 of the base 102 and extends across the opening 108 of the base 102. The handle 122 as shown is adapted to be grasped by a hand of an exerciser so that the exerciser forms a fist around the handle 122. The handle 122 as shown is shaped to ergonomically fit the hand of the exerciser and the handle 122 is typically positioned approximately midway between the distal end 104 and the proximal end 106 of the base 102. In a preferred embodiment, the position of the handle 122 along the longitudinal axis 112 is adjustable. Of course, the device 100 can be built so that the handle 122 is adjustable to any position within the opening 108 of the base 102, such as non-perpendicular to the longitudinal axis 112 and/or closer to or further from the distal end 104.

FIG. 1 shows one embodiment of an adjustable handle feature in which the handle 122 includes a spring-loaded knob 128 at each of the handle's ends 124 and 126. This adjustable handle feature of the device 100 includes a pair of contiguous-multiple-semicircular-shaped apertures 130 formed into opposite sides of the base 102 and are preferably parallel to one another and to the longitudinal axis 112 of the base 102. Each of the knobs 128 is adapted to fit within one of the apertures 130 so that the handle 122 can be positioned along the longitudinal axis 112 of the base 102 and then locked into place using the knobs 128. Of course, any suitable means for adjusting the position of the handle 122 relative the base 102 in which the handle 122 can be securely held in place once it has been positionally adjusted can be employed, such as a screw-down type knob (not shown), a removable cotter-pin (not shown) in each end 124 and 126 of the handle 122, or spacers (not shown) inserted above and below the knobs 124 and 126.

In a preferred embodiment, at least one side hook 132 is attached to the base 102 proximate to the distal end 104 and/or the proximal end 106 of the base 102. The side hooks 132 can be used for a number of purposes, including retaining the flexible member 114 and creating a moment arm for application of force against the flexible member 114 when the flexible member 114 is in tension and also for helping to retain one or more detachable side weights (not shown) on the exterior surface 120 of the base 102. The side hooks 132 preferably have a minimal overhang distance ("D") from the base 102 in a plane perpendicular to the longitudinal axis 112. Of course, any desired number of side hooks 132 can be attached to the distal end 104 and/or the proximal end 106 of the base 102. The side hooks 132 can be integral to the base 102 or can be separate pieces attached to the base 102. In a preferred embodiment, the side hooks 132 are centered on the deepest point 116 of the notches 110 or 110*a*.

As shown in FIG. 1, the device 100 also includes a nut 134 and a bolt 136 proximate the distal end 104 of the base 102, with the bolt 136 running substantially parallel to the longitudinal axis 112, the nut 134 and the bolt 136 being adapted to attach one or more end weights 138 to the distal end 104 of the base 102. In a preferred embodiment, a standard circular weight with a hole in its center is used as shown as the end weight 138 and is slid onto the bolt 136 and is then secured using the nut 134. More than one of the end weights 138 can be attached to the base 102 as needed. Of course, the nut 134 and the bolt 136 need not be used to secure one or more of the end weights 138 to the distal end 104 of the base 102, but rather, any suitable means for attaching at least one end weight 138 to the distal end 104 of the base 102 can be employed, such as clips (not shown), brackets (not shown), springs (not shown), magnets (not shown), specially-shaped weights that lock into the base (not shown), VELCRO (not shown), or the like.

In addition, the distal end 104 of the base 102 can also be adapted to permanently retain one or more non-removable end weights (not shown) with or without the capability of adding additional end weights 138 to the distal end 104 of the base 102. The device 100 as shown includes an end weight 138 attached to the distal end 104 of the base 102 via the nut 134 and the bolt 136.

As shown, the flexible member 114 is attached to the base 102 adjacent a first end 140 of the flexible member 114. A second end 142 of the flexible member 114 can be attached to an inertial resistance (not shown), such as, for example, a fixed point (not shown) such as a post or bar, or to a movable resistance (not shown) such as a weight stack, springs, or hydraulic member.

The device 100 also includes a plurality of locations, shown as slots 144, for attaching the flexible member 114 to the base 102. As shown, the slots 144 are T-shaped to permit a T-shaped rigid member (not shown) at which the first end 140 of the flexible member 114 terminates to be inserted into the slot 144 and then rotated so that the flexible member 114 will not separate from the base 102 during performance of an exercise. A plurality of slots 144 is preferable, since attaching the flexible member 114 in different positions on the base 102 permits variations of the moment arms (versus the handle 122 position and versus a center of gravity of the device) applied during exercise. Or course, the center of gravity of the device 100 varies depending on the configuration of weights attached to the base 102.

The slots 144 need not be T-shaped, but rather, for example, could be keyhole-shaped or otherwise configured to retain the flexible member 114 or hardware attached to the flexible member (not shown). Further, the slots 144 need not be employed to attach the flexible member 114 to the base 102. Any suitable means for attaching the flexible member 114 so that it is secured to the base 102 and will not come loose from the base 102 under load is permissible. For example, any number of means of attaching, such as clips (not shown), brackets (not shown), hooks (not shown), knobs (not shown), or the like could be used, the means for attaching preferably comprising a plurality of points on the base 102 for attaching the flexible member 114. In addition, the flexible member 114 can be attached via a swivel attachment (not shown) so that the flexible member 114 will tend to lay flat against the base 102 regardless of the direction of tensile force on the flexible member 114.

The flexible member 114 as shown is preferably at least in part a substantially flat strap 146 or length of material that is adapted to lay flat against the base 102 when tension is applied to the flexible member 114 between the flexible member's 114 first 140 and second ends 142. The flexible member 114 can be elastic (e.g., surgical tubing) or inelastic (e.g., a steel cable) in whole or part, as dictated by the exercise application. The flexible member 114 can be inelastic for use in certain applications such as, for example, when the flexible member 114 is attached to a cable (not shown) attached to a weight stack (not shown) or other moveable inertial resistance. The flexible member 114 is preferably at least in part elastic when its second end 142 is attached to a fixed point (not shown). The flexible member 114 is preferably adapted to wrap around the exterior surface 120 of the base 102.

The flexible member 114 as shown also preferably includes a loop 148 that can be used to attach the flexible member 114 to either a fixed inertial resistance (not shown) or a moveable inertial resistance (not shown). The loop 148 is preferably large enough to permit an exerciser to thread the base 102 through the loop 148 in order to form a knot to secure the device to an inertial resistance (not shown). Of course, other means for attaching the second end 142 of the flexible member 114 to an inertial resistance can be used, such as clips (not shown), hooks (not shown), VELCRO (not shown), or the like.

In addition, the flexible member 114 also includes a detachment clip 150 that permits the loop 148 to be separated from the rest of the flexible member 114. The detachment clip 150 could be used, for example, to attach the flexible member 114 to a cable connected to a weight stack (not shown).

Figure 2A:
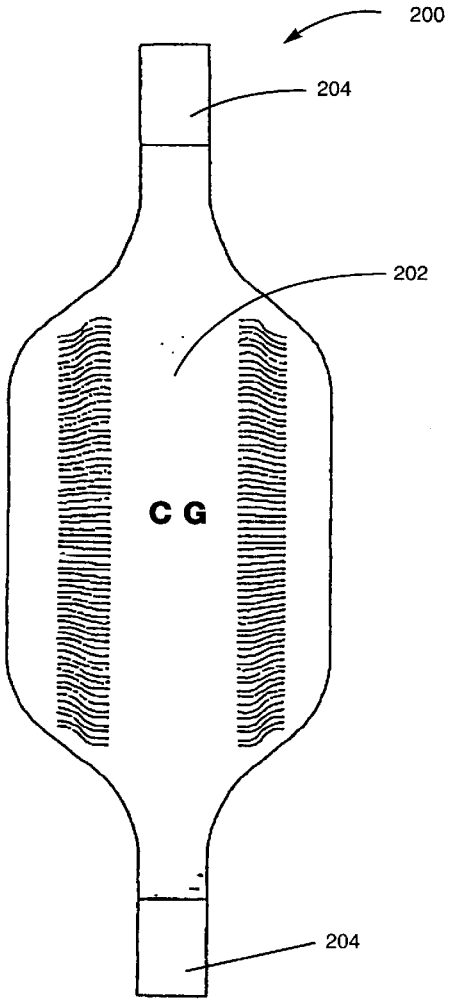
FIGS. 2A and 2B are diagrams illustrating a detachable side weight in accordance with the teachings of the present invention.

Referring now to FIG. 2A, shown is a bottom view of a detachable side weight 200 (i.e., a side weight adapted to fit against the exterior surface of the base)in accordance with the teachings of the present invention. The detachable side weight 200 is preferably adapted to be wrapped around the exterior surface 120 of the base 102 of FIG. 1 so that an exerciser can add additional weight at various positions on the base 102 as desired for performing different exercises.

Figure 2B:
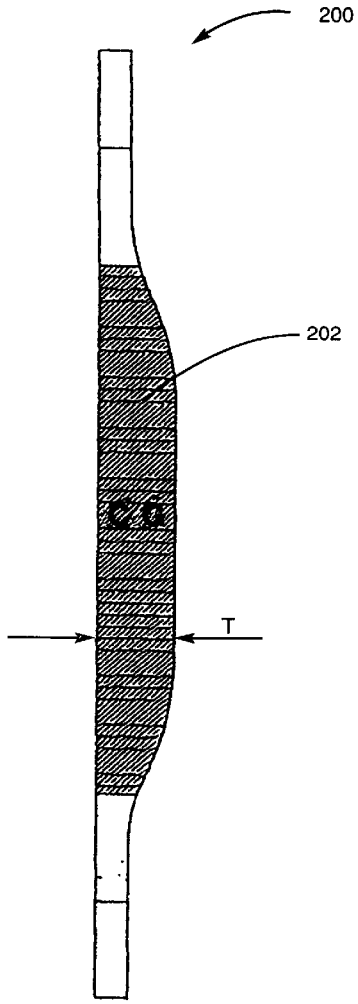

The detachable side weight 200 as shown preferably comprises weighted particulate matter such as sand or ball bearings (not shown) within a flexible central portion 202 so that a center of gravity of the detachable side weight 200 is approximately where the letters "CG" are shown on FIGS. 2A and 2B. Of course, the center of gravity of the weight 200 need not be placed at this location and can be varied as deemed appropriate for a given exercise application. Alternatively, the weight 200 can be filled with non-particulate matter and shaped to fit against the exterior surface of the base 102.

Also shown on FIG. 2A are two wings 204 that will typically not include particulate weighted matter (not shown) and which are adapted to assist in retaining the detachable side weight 200 on the base 102. In a preferred embodiment, the wings 204 respectively comprise mating portions of hook-and-loop fasteners, commonly known as VELCRO (not shown), so that the detachable side weight 200 can be wrapped around the base 102 and secured to the base 102. Other suitable means of securing the detachable side weight 200 to the base 102, such as buckles (not shown), clips (not shown), or brackets (not shown) of various types can also be employed.

The detachable side weight 200 also preferably includes hook and/or loop fasteners (not shown) on the central portion 202 of the detachable side weight 200 so that a corresponding mating portion of a hook-and-loop fastener on the base's 102 exterior surface 120 can be engaged to further assist in securing the detachable side weight 200 in a specific pre-selected position to the base 102. Any suitable pattern of fasteners can be used.

Referring now to FIG. 2B, shown is a side elevation view of the detachable side weight 200 of FIG. 2A. As shown, the detachable side weight 200 preferably has a thickness T across its central portion 202 that is less than the minimal distance D of FIG. 1, so that the side hooks 132 of the base 102 can assist in retaining the detachable side weight 200, especially in the event that an exerciser drops the device.

Figure 3A:
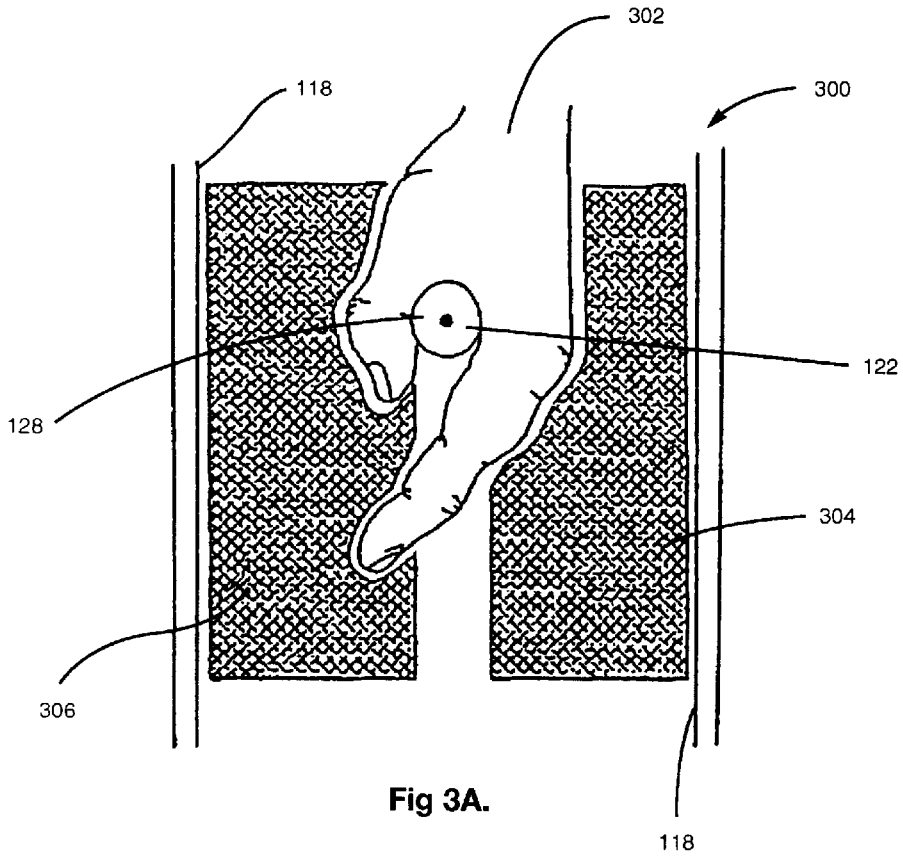
FIGS. 3A and 3B are diagrams illustrating an open-hand insert in accordance with the teachings of the present invention.

Referring now to FIG. 3A, shown is an open-hand insert 300 that is preferably used to allow the handle 122 to be adapted to fit an open hand 302 of an exerciser. The insert 300 can be used most effectively by exercisers who engage in activities that involve use of an open hand as opposed to a fist or closed grip, such as swimmers, climbers, handball players, and martial artists. The insert 300 is preferably shaped to ergonomically fit the open hand 302 of the exerciser.

The open-hand insert 300 is preferably comprised of two portions, a knuckle portion 304 and a thumb portion 306. The knuckle portion 304 is adapted to fit between the back of an exerciser's hand 302 and the interior surface 118 of the base 102 when the exerciser has inserted his hand 302 into the opening 108 of the base 102 from the proximal end 106. The thumb portion 306 is preferably adapted to fit between the thumb and fingertips of an exerciser's hand 302 and the interior surface 118 of the base 102 when the exerciser has inserted his 302 hand into the opening 108 of the base 102 from the proximal end 106.

Also shown in FIG. 3A is an end view of the thumb end 128 of the handle 122. FIG. 3A also shows the open-hand insert 300 being used by an exerciser's left hand. Of course, either a left-handed or a right-handed insert 300 may be used. In a preferred embodiment, the open-hand insert 300 is adapted to be used exclusively with either an exerciser's right hand or left hand so that the insert 300 can be better fitted to the hand 302 it is intended to be used by.

FIG. 3A illustrates the left hand extended into the proximal opening 108 of the base 102, with the open-hand insert 300 positioned as shown against the interior surface 118 of the base 102 so that the exerciser is prevented from wrapping his left hand around the handle 122 while he uses the device 100. The thumb portion 306 engages the exerciser's fingertips and thumb. The knuckle portion 304 engages the back of the exerciser's hand adjacent his knuckles. The thumb portion 306 and the knuckle portion 304 preferably do not extend toward the proximal end 106 of the base 102 beyond the most proximal portion of the handle 122, so that the device remains a live-hand device that the exerciser is forced to use with minimal or no wrist support. For example, if the thumb portion 306 and/or the knuckle portion 304 extends proximally beyond the most proximal portion of the handle 122, the exerciser might be able to brace his wrist and/or palm against the insert 300 while performing various exercises, which would result in undesirable less challenging strength and flexibility stimuli to the upper body joint muscle complexes generally, and to the hand/wrist joint-muscle complexes specifically.

Figure 3B:
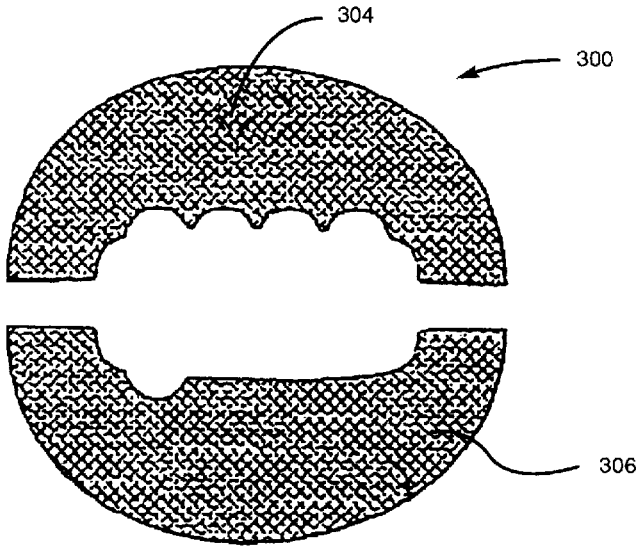

FIG. 3B is an end view of the insert of FIG. 3A as viewed from the distal end 104 of the base 102 of the device 100 when the insert 300 has been inserted into the proximal opening 108 of the base. Unlike FIG. 3A, the handle 122 is not shown. As shown, the thumb portion 306 and the knuckle portion 304 of the insert 300 are preferably separate pieces, which allows them to be slid into and out of the proximal opening 108 of the base 102 by an exerciser as desired. Of course, the insert 300 can be adapted to be permanently a part of the device 100, in which case the inclusion of the handle 122 is optional. Alternatively, the handle 122 can be made to be removable from the base 102 prior to insertion of the insert 300. The insert 300 may also be fitted with air bags and/or a pumping system (not shown) to custom fit the insert 300 to a variety of exercisers' hand sizes.

The insert 300, if intended to be inserted around the handle 122, is preferably comprised of a durable, semirigid, resilient material that is strong enough to withstand loads transmitted through the exerciser's hand during exercise and flexible enough to deform as needed as the thumb portion 306 and knuckle portion 304 are being inserted into the proximal opening 108. Of course, the insert 300 need not be flexible if the handle 122 is removable, the insert 300 is not removable from the base 102 by an exerciser, or the insert 300 is adapted to be inserted into the proximal opening 108 without engaging the handle 122.

Figure 4:
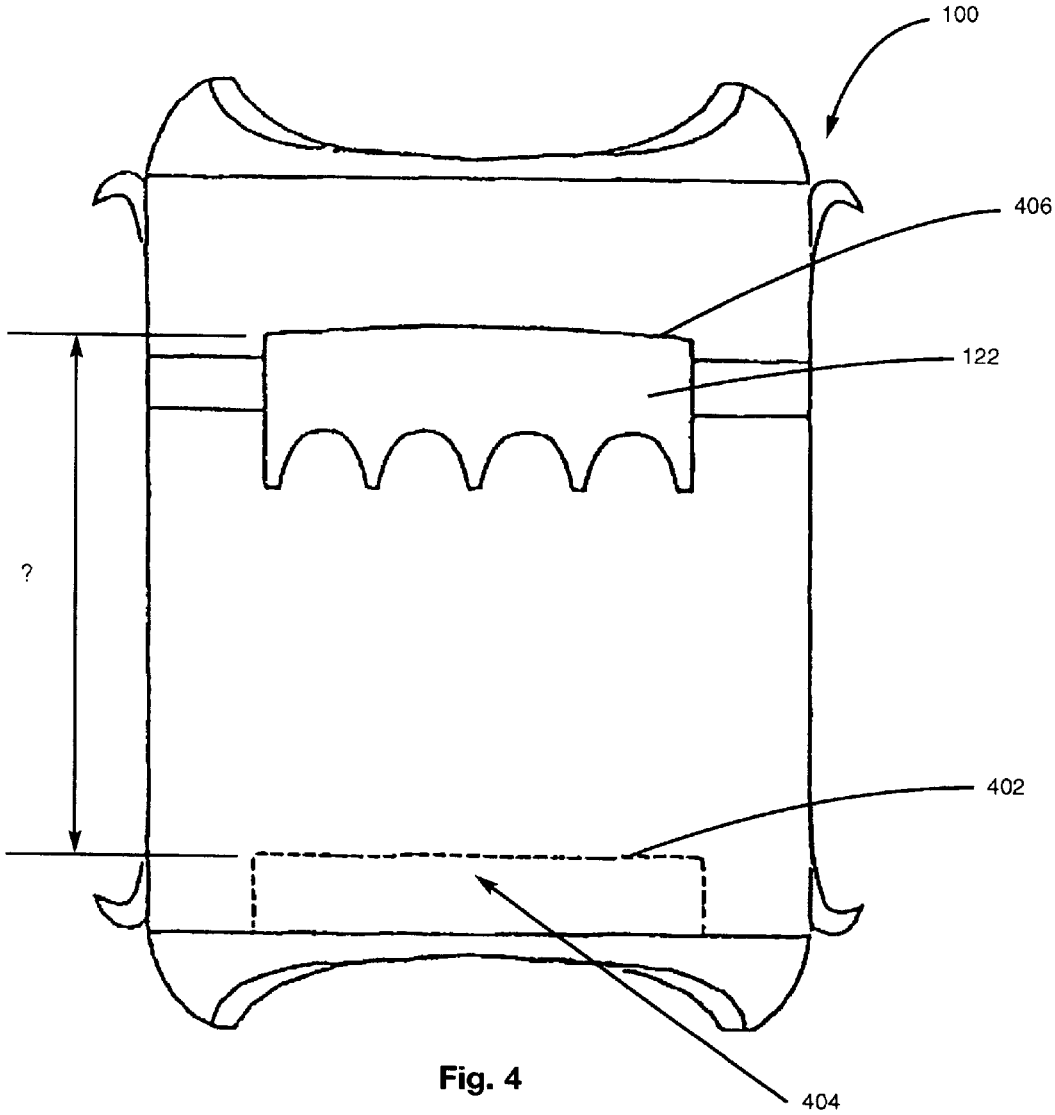
FIG. 4 is a diagram illustrating an embodiment of the device of the present invention.

FIG. 4 is a side view of an embodiment of the device 100 of the present invention. As shown, a height "h" illustrates a preferred height of the insert 300 in relation to the handle 122. The height "h" represents the distance between a proximal edge 402 of an end weight cavity 404 into which end weights 138 can be inserted and a proximal edge 406 of the handle 122. Alternatively, if the base has a distal opening, "h" could be measured between the proximal edge of the handle and the bottom surface of the distal end of the base, the important feature being that the insert 300 not extend proximally beyond the handle 122.

Figure 5:
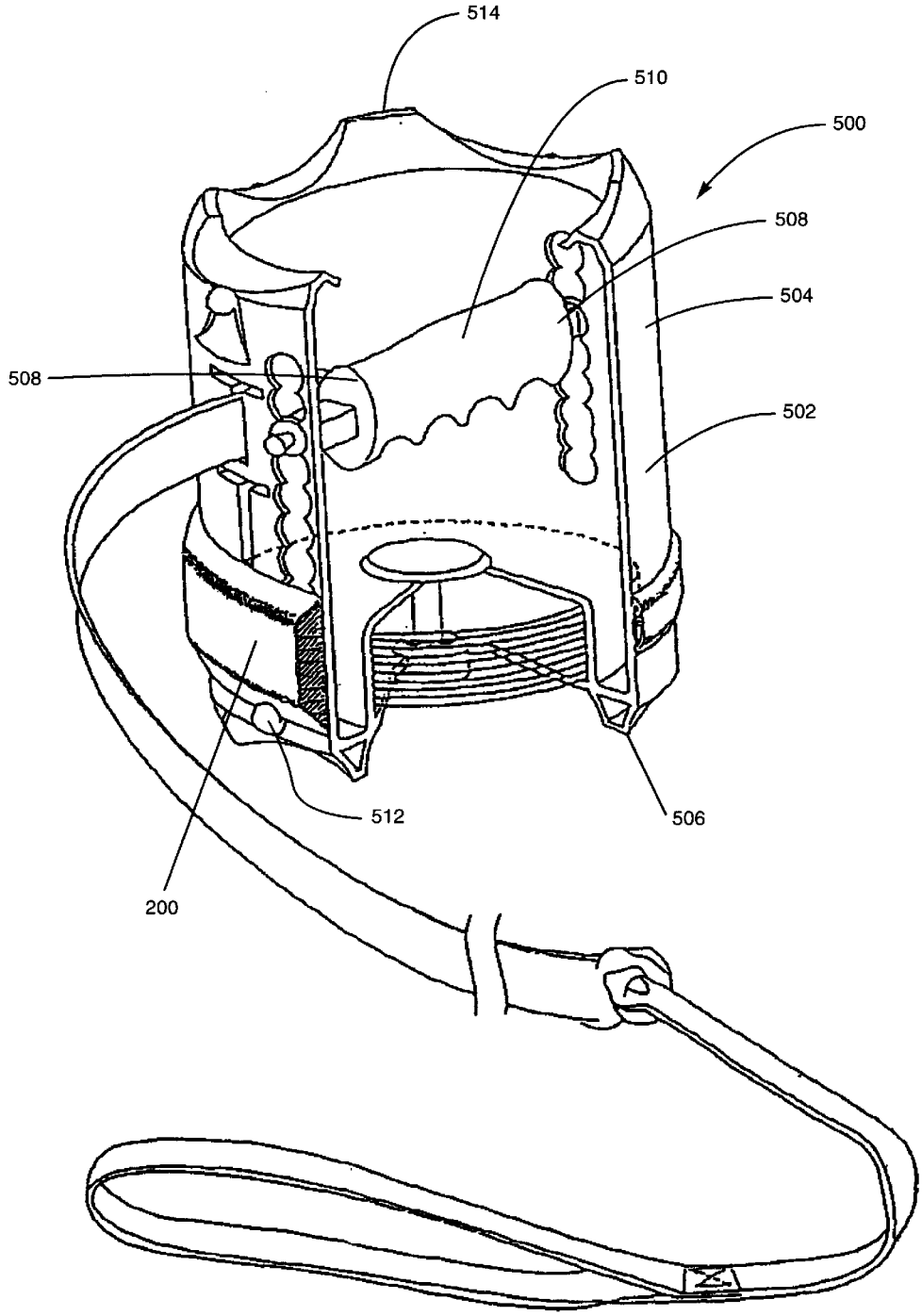
FIG. 5 is a diagram illustrating an embodiment of the present invention with a detachable side weight attached thereto.

Referring now to FIG. 5, illustrated is a device 500 embodying concepts of the present invention. The device 500 is in all relevant respects identical to the device 100 of FIG. 1 except that it has a detachable side weight 200 of FIGS. 2A and 2B wrapped around the exterior surface 502 of the base 504 adjacent to the distal end 506 of the base 504. As shown, the detachable side weight 200 has a center of gravity circumferentially adjacent one of the ends 508 of the handle 510. While it is preferable in many exercises that the center of gravity of the detachable side weight 200 is circumferentially adjacent to one of the ends 508 of the handle 510 as shown in FIG. 5, the center of gravity of the detachable side weight 200 can be positioned in any other circumferential position as deemed appropriate for a particular exercise.

The detachable side weight 200 shown longitudinally adjacent to the distal end 506 of the base 504 engages at least one side hook 512, which assists in retaining the detachable side weight 200 on the base 504. Of course, more than one detachable side weight 200 can also be attached to the base 504 adjacent a proximal end 514 of the base 504. In addition, one or more detachable side weights 200 can be attached to the base 504 at varying longitudinal and circumferential positions on the base 504 as needed.

The present invention permits moment arm variations unachievable by the prior art by virtue of the combined effect of: 1) resistance (e.g., flexible member, detachable side weights, end weights, or any combination of the above); 2) mode (e.g., rotational/torque stimulus, deviation of longitudinal axis of device from either line of pull of flexible member, line of pull of gravity, or both depending on selection from no. 1); and/or 3) exercise selection.

One of the drawbacks of the prior art methods and devices with respect to stability-strength stimulus is overcome by the present invention. Stability-strength stimulus is defined as a stimulus that increases musculo-skeletal strength in general and balance in particular. Such stimuli includes unstable bases such as wobble boards, balance beams, and mini-trampolines for whole body stability strength and any device that puts the center of gravity outside the center of the fist and, in the most complex of stimuli, varies the location of the center of gravity during a given movement, such as a live-hand device according to the present invention. The present invention yields these variations by the following: 1) variations in flexible member tracking on the exterior surface of the device; 2) variable flexible member attachment sites; 3) variable handle locations; 4) distal and/or proximal notch engagement of a flexible member; 5) detachable side weight belt placement; 6)end weights; 7)position of the device vis-à-vis center of gravity of exerciser's body; and 8) position of anchor of second end of flexible member vis-à-vis center of gravity of exerciser's body.

Having now described a device embodying concepts of the present invention, FIGS. 6–18 illustrate a number of different upper extremity exercises that can be performed using a device embodying concepts of the present invention. Although the exercises described in connection with FIGS. 6–17 depict an exerciser using a device as described herein, the exercises described in FIGS. 6–18 can be performed using any type of live-hand device, including but not limited to the device described herein, so long as the live-hand device is capable of providing comprehensive strength and flexibility stimulus of the four-joint upper extremity kinetic chain. Thus, the exercises described herein can be practiced apart from use of the device described herein without departing the spirit and scope of Applicants' invention. Although the device shown in FIGS. 6–18 does not explicitly depict many of the features of the device as described herein with respect to FIGS. 1–5, it should be understood that any of the exercises described herein can be performed with multiple variations of features of the device as described with respect to FIGS. 1–5, including but not limited to detachable side weights, end weights, varying handle positions, etc. A reference to the location of an inertial resistance herein is meant to refer to the direction of force applied to the device being used by the exerciser. Thus, an inertial resistance in the form of a weight stack might be physically located behind an exerciser, but its direction of force could be in front of the exerciser due to the use of cables, pulleys, and the like. Moreover, many variations of the exercises described can be devised, as well as other exercises, without departing from the scope and spirit of the present invention.

Each of the exercises described below with reference to FIGS. 6–18 can be used to reset spasmed muscle fiber or fibers to normal muscle tonus. The process of resetting spasmed fiber includes selecting an upper extremity exercise that has its beginning point at the first end of the exerciser's substantially maximal range of motion and its end point at the second end of the exerciser's substantially maximal range of motion. For example, if a shoulder rotation exercise were to be performed, the exerciser would perform the exercise from his substantially maximal internal rotation range of motion to his substantially maximal external rotation range of motion, or vice versa.

To reset spasmed muscle fiber or fibers to normal muscle tonus levels, the exerciser performs the upper extremity exercise using a live-hand exercise device adapted to stimulate at least one muscle fiber of one or more muscles of the exerciser's upper extremities. To perform the exercise and reset muscle spasm, the exerciser substantially maximally voluntarily stretches the muscle fiber or fibers at the beginning point of the exercise (e.g., he internally rotates his shoulder as far as he can), and then performs the exercise until he has substantially maximally voluntarily contracted the muscle fiber or fibers at the second point of the exercise (e.g., he externally rotates his shoulder as far as he can). Those skilled in the art will recognize that when an agonist muscle group is substantially maximally stretched, its antagonist muscle group is substantially maximally contracted. Thus, more than one muscle's spasmed fibers can be reset by a single exercise.

The inventors have found that, in contrast to prior art exercise and rehabilitation methods that only exercise parts of the upper extremity kinetic chain, increased involvement of the entire upper extremity kinetic chain, and particularly the hand/wrist complex, as described herein is especially advantageous in resetting muscle spasm. Once the spasmed fiber or fibers have been reset to normal tonus levels, the advantages of reset naturally follow, including increased blood and lymphatic flow, as well as improved proprioception, range of motion (i.e., flexibility), power, and speed expression and injury resistance. As used herein, the term "maximal range of motion" refers to an exerciser's abbreviated maximal flexibility in performing a particular exercise at the time he is performing the exercise due to muscle memory programming by daily usage. The term "full anatomic range of motion" refers to the exerciser's maximal flexibility possible given the structural limitations of the exerciser's skeletal/joint structure. Repeated use of the present invention will allow his maximal range of motion to approach full anatomic range of motion.

Referring now to FIGS. 6A–6D, shown is an exerciser 600 in sequential phases of performing an internal shoulder rotation exercise. The exerciser 600 has in his right hand a live-hand device 100 having a handle (not shown) disposed within an opening of the device 100. A first end of a flexible member 114 has been attached to the device 100 adjacent to the little finger of the right hand of the exerciser 600. A second end of the flexible member 114 is attached to an inertial resistance, which is shown in FIGS. 6A–6D as a fixed point 602. The device 100 preferably has been positioned at a first position at which the flexible member 114 is substantially taut and so that the flexible member 114 is wrapped around at least one-eighth of the exterior surface of the device 100 so that the line of pull of the flexible member 114 as the device is rotated in the exerciser's hand falls along the exterior surface of the device 100. The exerciser has grasped the handle of the device 100 with his palm facing substantially away from his torso and with his arm substantially extended at his side. It is preferable that the exerciser 600 marks the distance between the first position and the fixed point 602 following having positioned the device at the first position, so that when the flexible member 114 is elastic, the amount of resistance used during the exercise can be recorded.

Figure 6A:
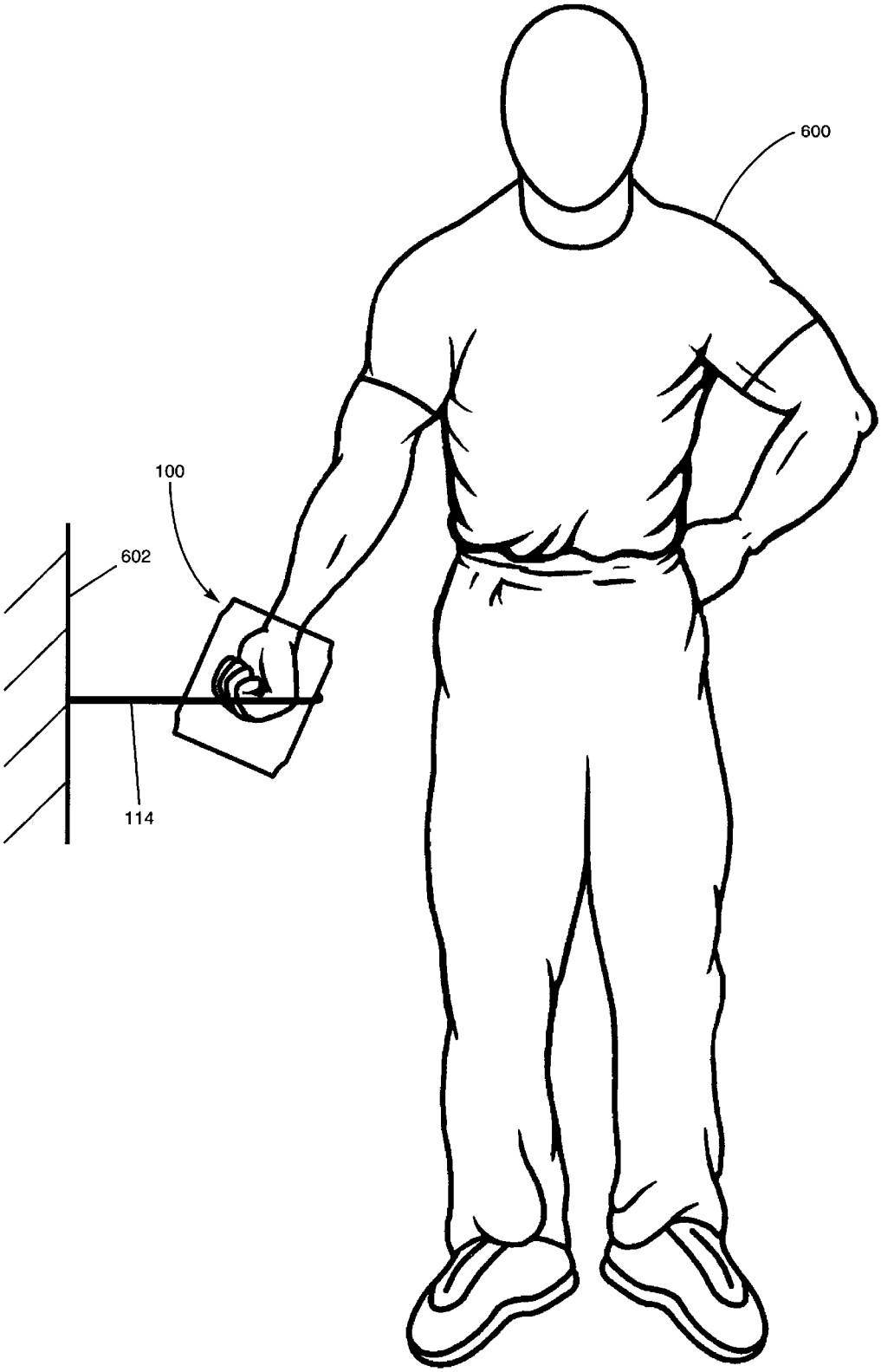
FIGS. 6A–6H are illustrations of an exerciser at various phases of performing a straight-arm arm-at-side internal shoulder rotation exercise in accordance with the teachings of the present invention.

To perform the exercise, the exerciser 600 assumes an initial position as shown in FIG. 6A in which he has supinated his right forearm and externally rotated his right shoulder joint as far as he can. Following assumption of this position, in which supination of the right forearm and external rotation of the right shoulder joint are at the exerciser's 600 substantially maximal range of motion, the exerciser preferably pauses and holds his arm in this substantially maximal range of motion position, which may or may not be his full anatomic range of motion. This step of supinating preferably also includes extending and radially deviating the wrist of the right arm, as shown in FIG. 6A. This hand/wrist involvement is indicative of the live-hand nature of the exercise, which maximally engages the entire upper extremity kinetic chain.

In a preferred embodiment of the exercise, the exerciser 600 is initially positioned so that his right hand is closer to the inertial resistance, shown as fixed point 602, than his left hand and the fixed point 602 is lateral to the exerciser 600, as is shown in FIGS. 6A–6D. However, so long as the flexible member 114 is positioned so that it resists internal shoulder rotation, virtually any comfortable position of the exerciser 600 is acceptable. If a fixed point 602 is used as the inertial resistance as shown in FIGS. 6A–6D, the fixed point 602 is preferably at approximately the exerciser's 600 waist level.

Figure 6B:
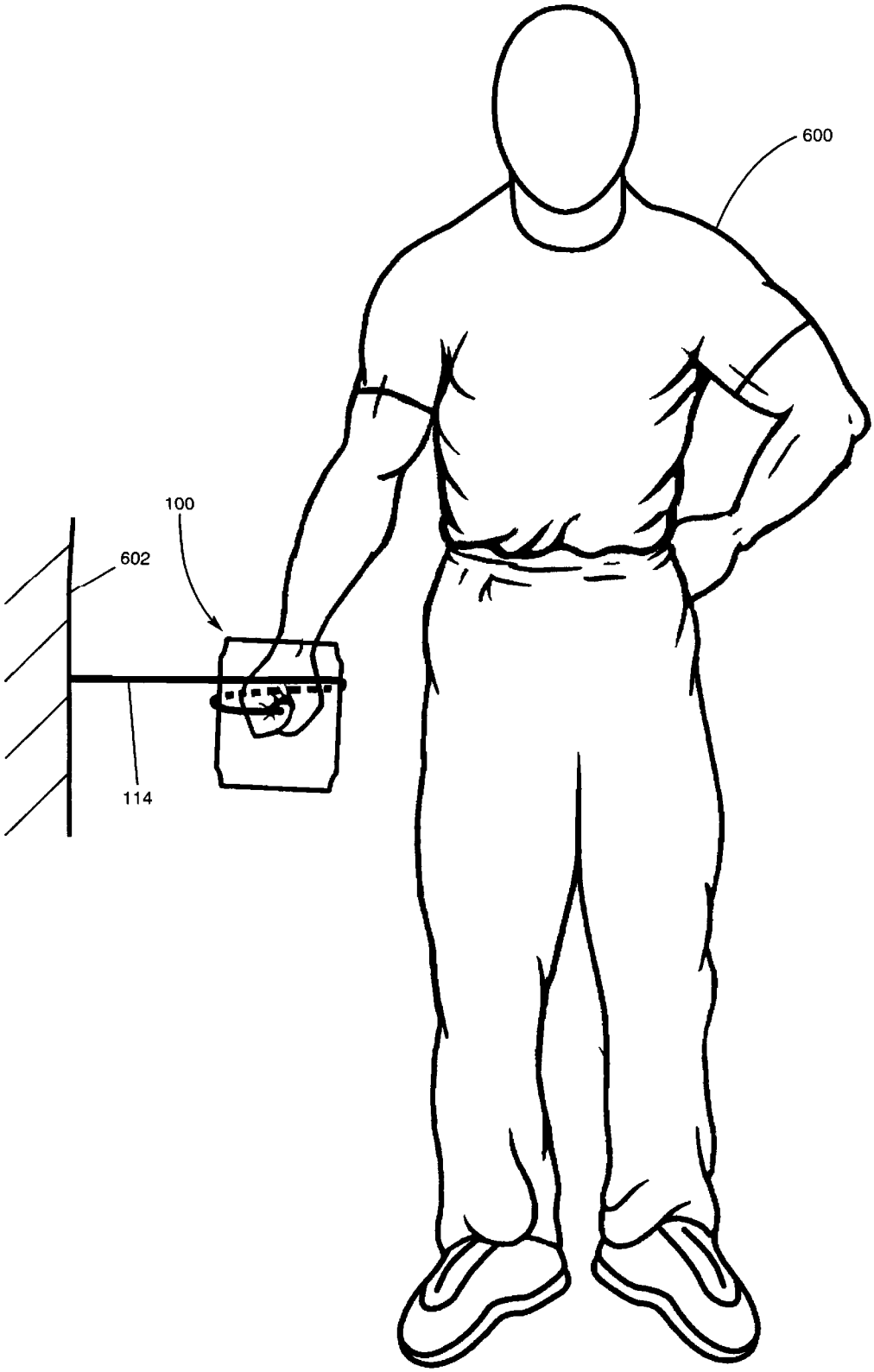
Figure 6C:
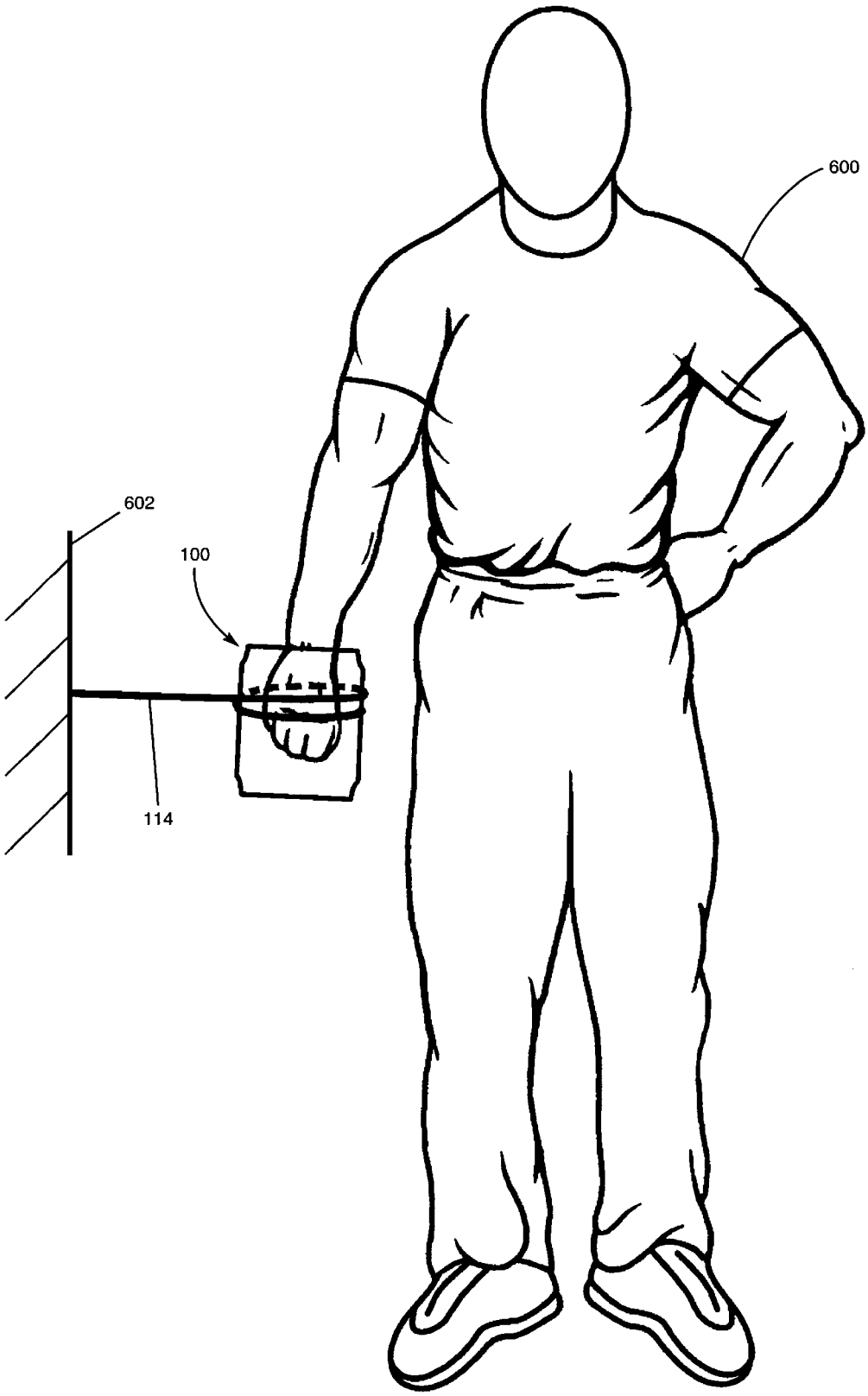
Figure 6D:
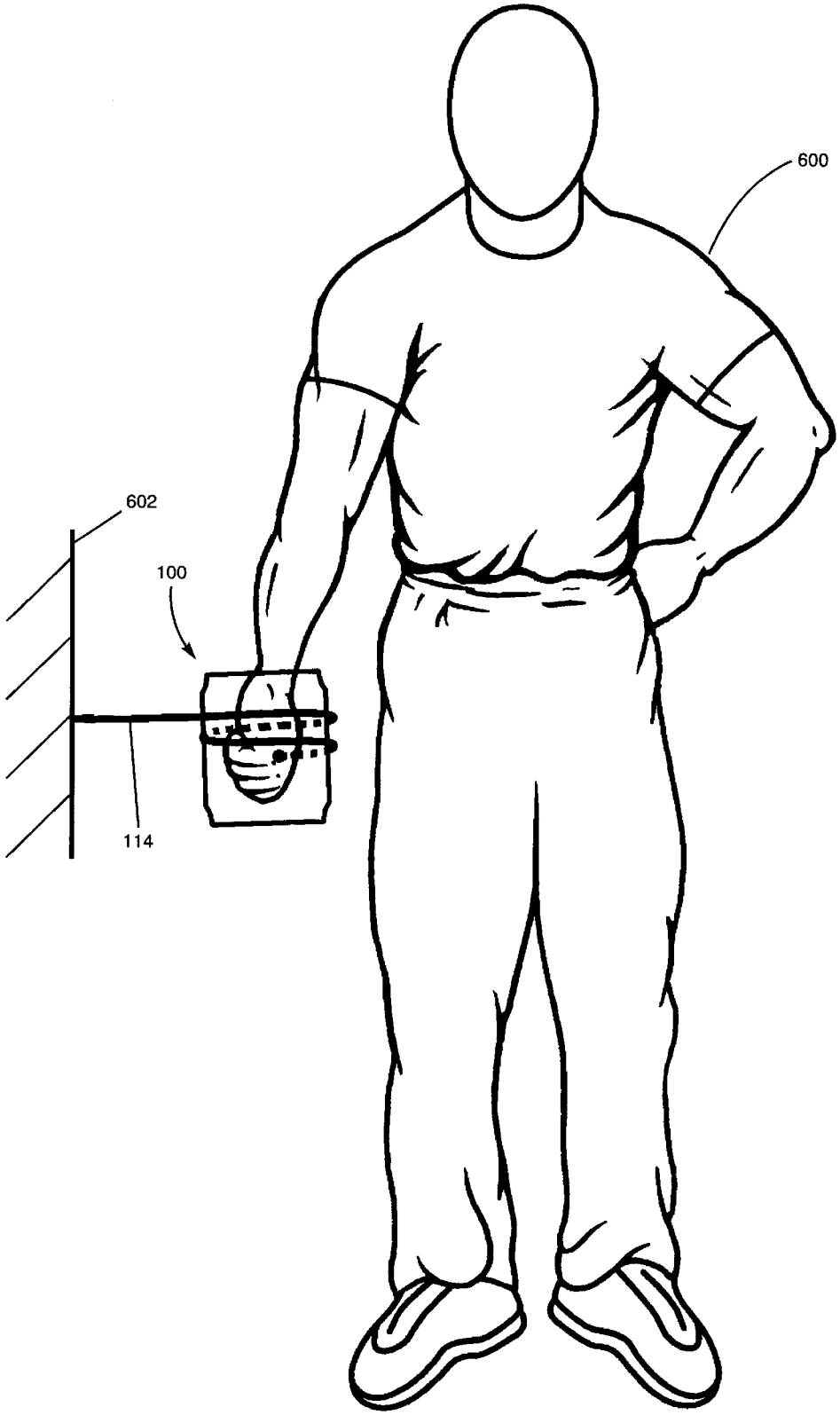
Figure 6E:
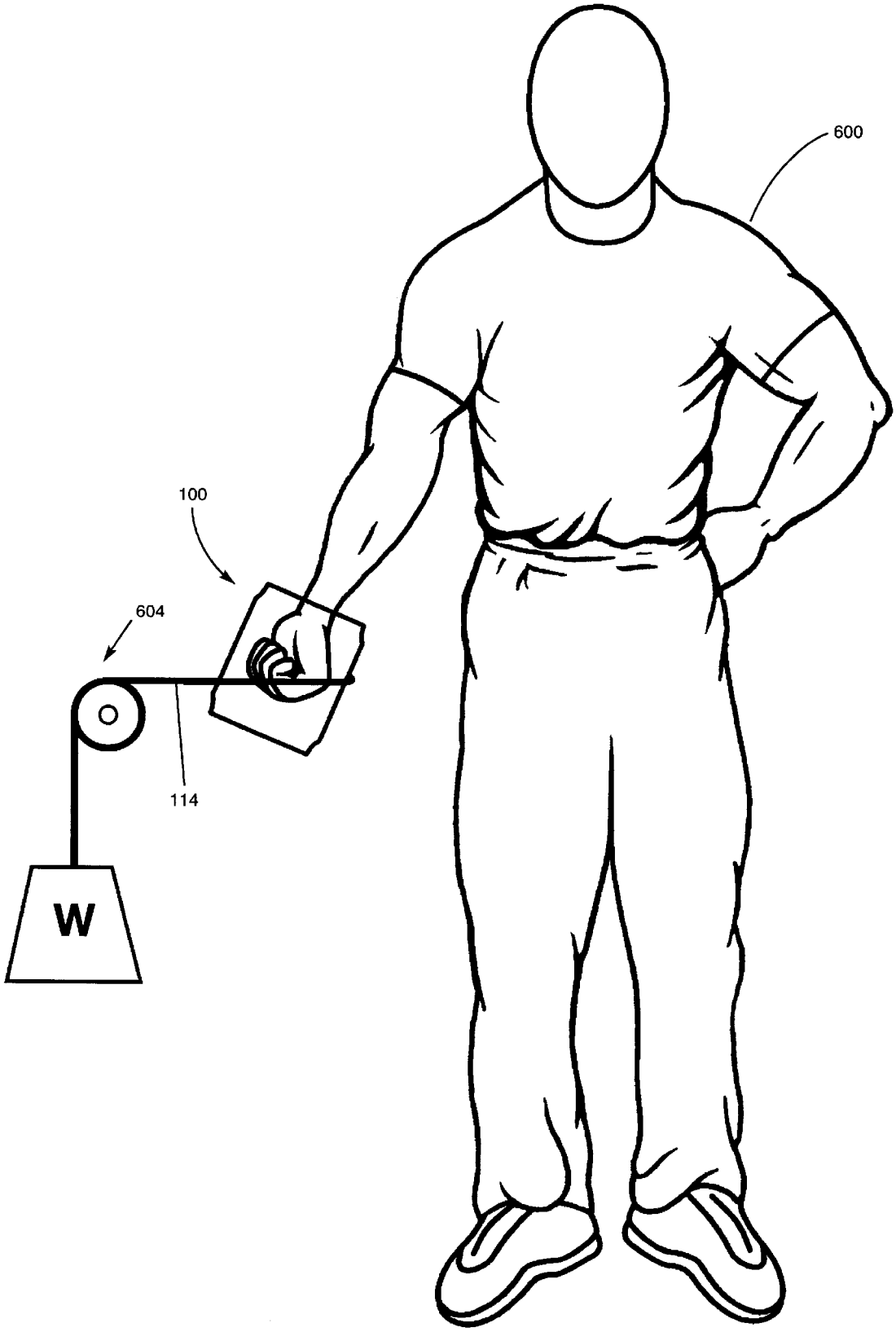
Figure 6F:
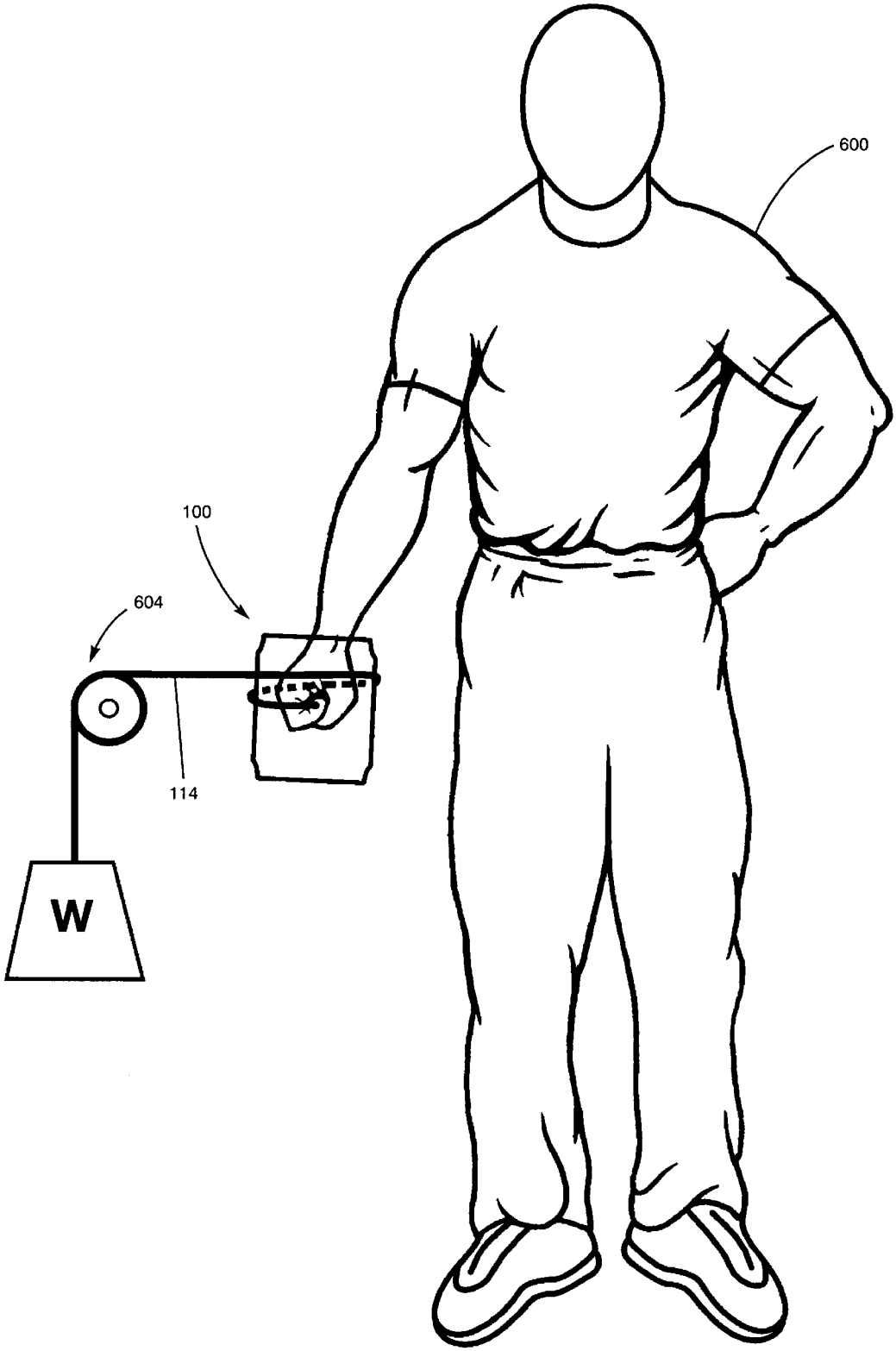
Figure 6G:
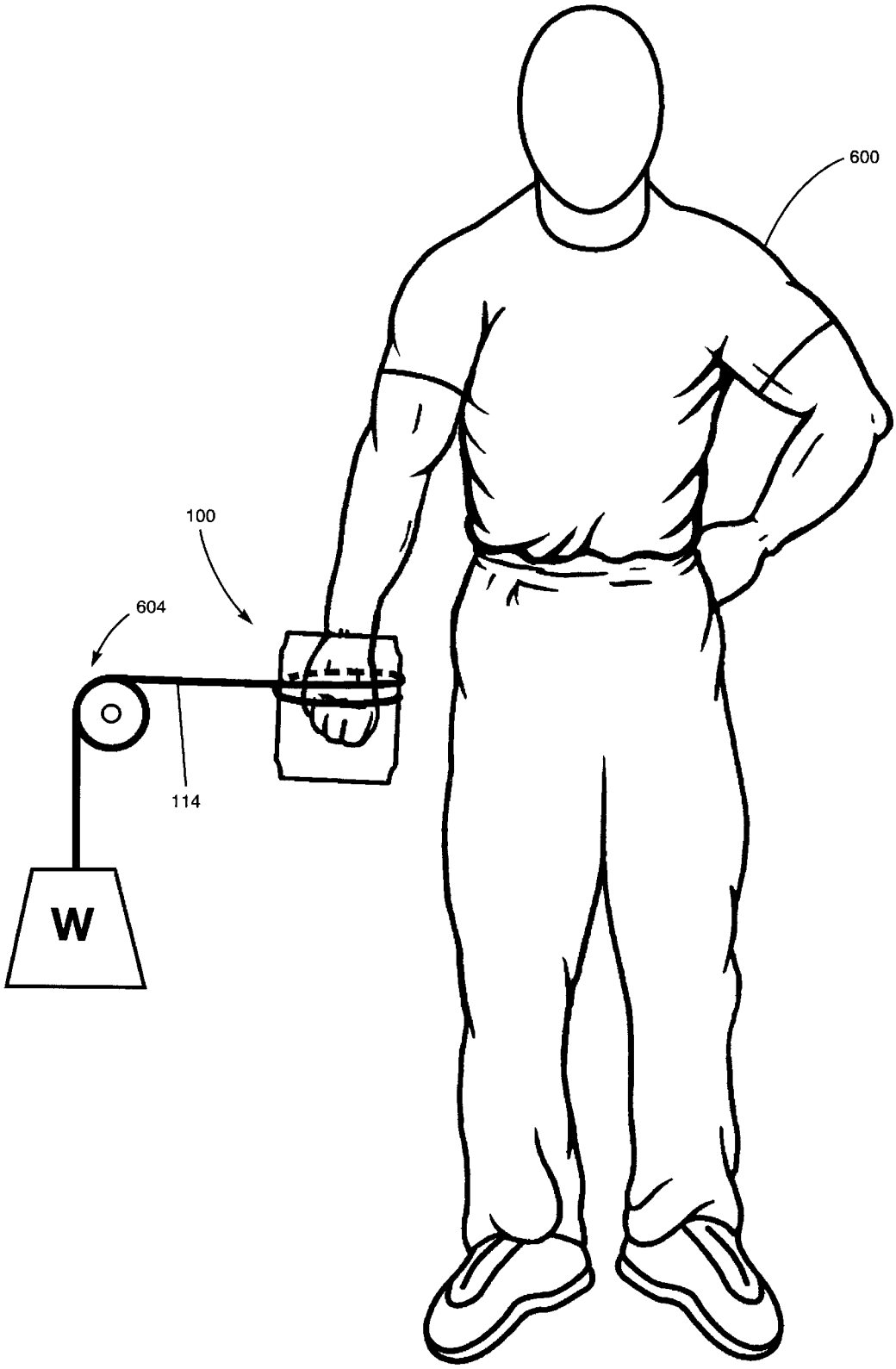
Figure 6H:
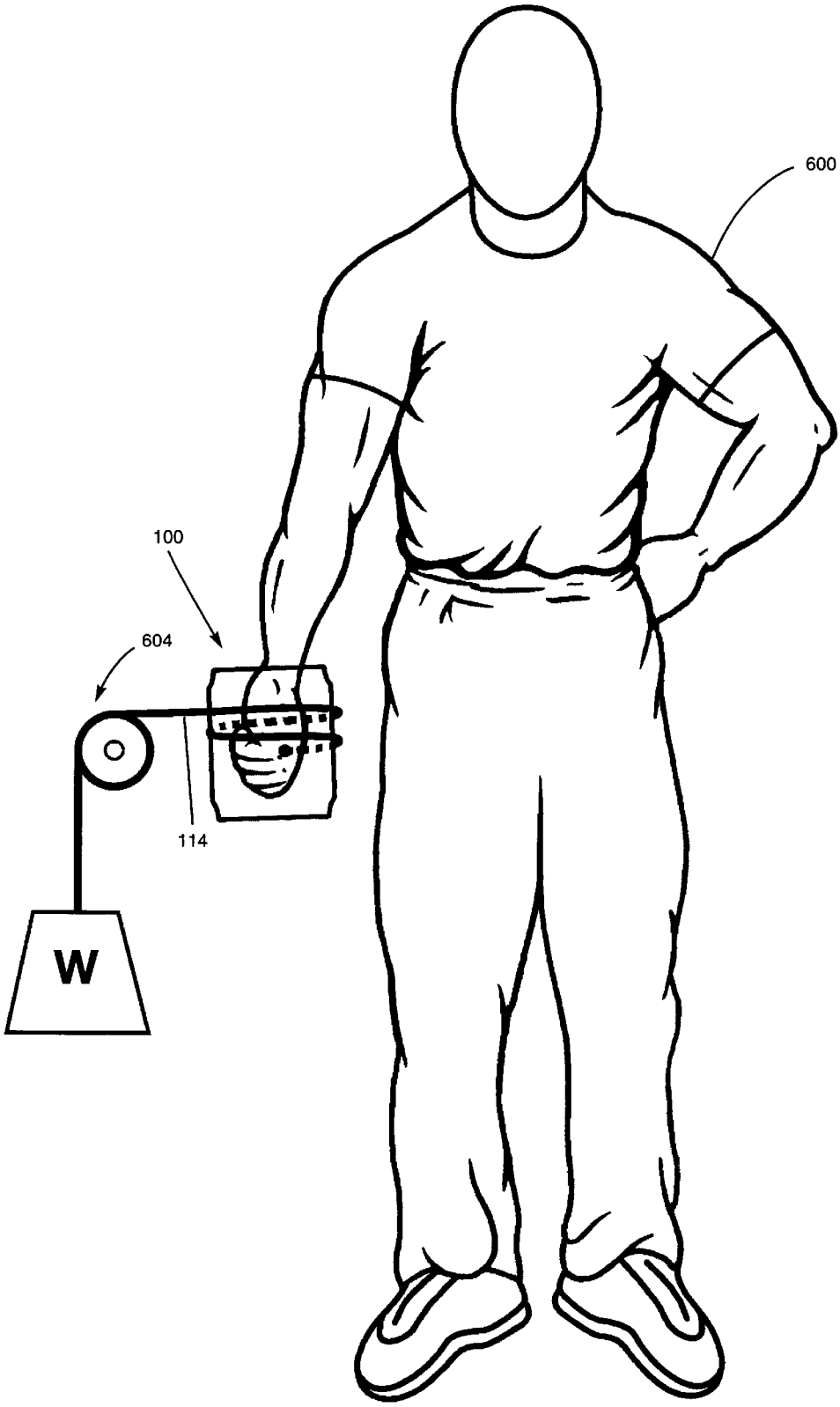

Next, the exerciser 600 pronates his right forearm and internally rotates his right shoulder joint against the pull of the flexible member 114 until he has reached his substantially maximal pronation-internal-rotation range of motion. FIGS. 6B and 6C illustrate intermediate phases of the exercise between FIGS. 6A and 6D. This step of pronating preferably includes flexing and ulnarly deviating the wrist of the right arm of the exerciser 600, as shown in FIG. 6D. The exerciser 600 can repeat the supinating and pronating steps as many times as desired.

While FIGS. 6A–6D show the first end of the flexible member 114 attached adjacent to the handle (not shown) of the device 100 near the exerciser's 600 little finger, this attachment point is not essential and the flexible member 114 can be attached at any point desired by the exerciser to achieve his exercise goals. The hand/wrist complex in particular is stimulated to a greater degree when the sum of the forces acting on the device 100 are such that the force is not applied through the center of the exerciser's 600 hand, but rather is applied at some other point of the device 100 so that a torque factor is induced. The torque factor requires the exerciser to engage his upper extremity musculature to a greater degree in order to perform the exercise than if he were using a dead hand device such as those of the prior art. A further torque stimulus can be provided by detachable side weights (not shown) and a wrist extension-flexion and radial ulnar deviation stimulus can be provided by end weights (not shown).

The flexible member 114 can be elastic, in which case it will typically be attached to the fixed point 602 as the inertial resistance. FIGS. 6A–6D each depict the flexible member 114 as elastic and the inertial resistance as the fixed point 602. In addition, the flexible member 114 can be inelastic, in which case it will typically be attached to a movable inertial resistance, such as a weight stack, hydraulic resistance, or the like.

FIGS. 6E–6H are identical to FIGS. 6A–6D, except that the flexile member 114 is inelastic and is attached to a moveable inertial resistance, represented by a weight 604.

Following performance of the exercise with the right arm, the exercise can be performed with the left arm in a manner that will be apparent to those skilled in the art. It is preferable that the exerciser 600 determine that the device 100 is positioned at the same position during the performance of the exercise with the left arm as it was positioned during performance of the exercise with the right arm, so that the same amount of resistance is applied to each arm during performance of the exercise. Of course, the position of the device 100 is most critical when an elastic flexible member 114 is used, since the resistance of an elastic flexible member 114 is dependent upon the amount it is stretched. Conversely, positioning of the device 100 when an inelastic flexible member 114 is used is not nearly as critical, since resistance applied through the inelastic flexible member 114 does not vary with distance.

Figure 7A:
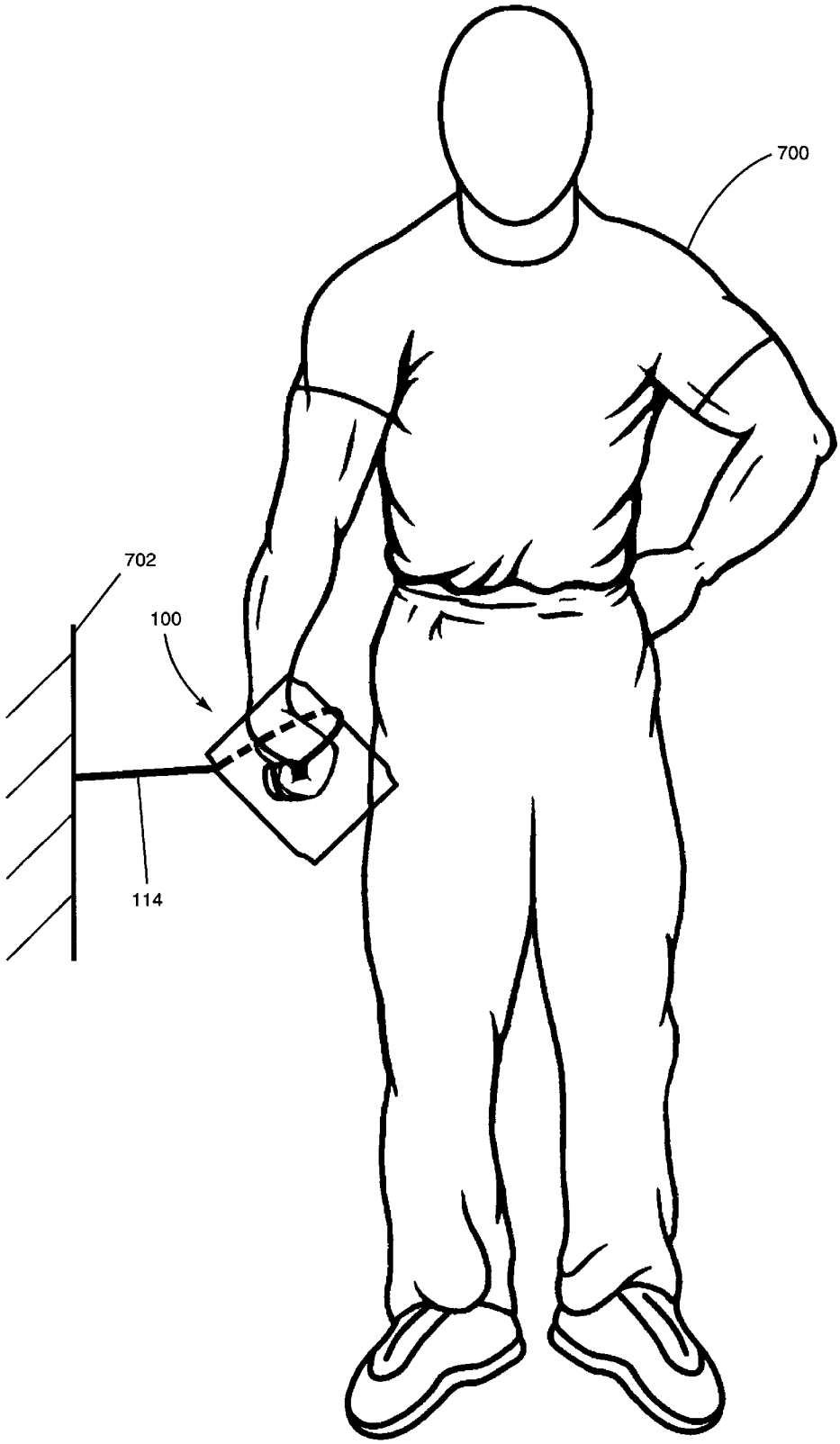
FIGS. 7A–7H are illustrations of an exerciser at various phases of performing a straight-arm arm-at-side external shoulder rotation exercise in accordance with the teachings of the present invention.

Referring now to FIGS. 7A–7D, shown is an exerciser 700 performing a similar exercise to that shown in FIGS. 6A–6D, except that the device 100 is held in the exerciser's 700 right hand and in which external rather than internal shoulder rotation is resisted by a flexible member 114. As shown in FIG. 7A, the exerciser 700 is grasping the handle (not shown)of the device 100 with his right hand, with his palm facing substantially away from his torso and with his right arm substantially at his side. The flexible member 114 is now preferably attached to the device 100 adjacent his right thumb rather than his little finger as in FIGS. 6A–6D. The first end of the flexible member 114 need not be attached adjacent to the handle of the device 100, but rather can be attached at any point of the device 100 as desired by the exerciser 700, so long as the flexible member 114 resists external rotation of the right shoulder joint.

It is preferable that, if the flexible member 114 is elastic, the exerciser 700 determines that the device 100 is positioned at the first position of FIGS. 6A–6D before he begins the external rotation exercise. This allows the exerciser 700 to ensure that a consistent level of resistance is being applied during each of the exercises. The exerciser 700 is preferably positioned so that his right hand is closer to the inertial resistance, shown as a fixed point 702 in FIGS. 6A–6D, than his left hand and the fixed point 702 is lateral to the exerciser 700. However, any comfortable position in which the flexible member 114 is positioned to resist external rotation is acceptable. If the inertial resistance is a fixed point 702, it is preferable that it is at approximately the exerciser's 700 waist level and in front of the exerciser 700.

Figure 7B:
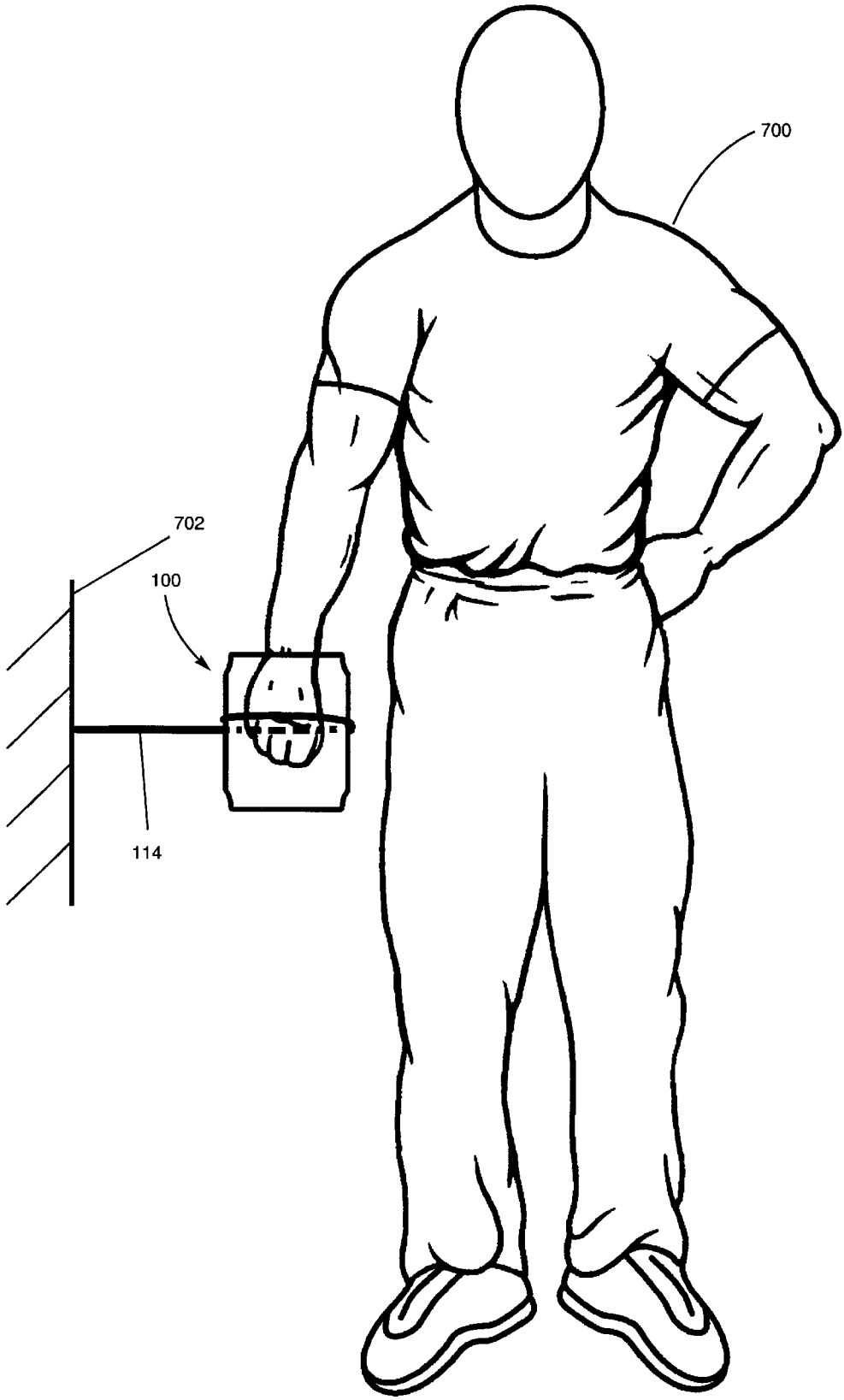
Figure 7C:
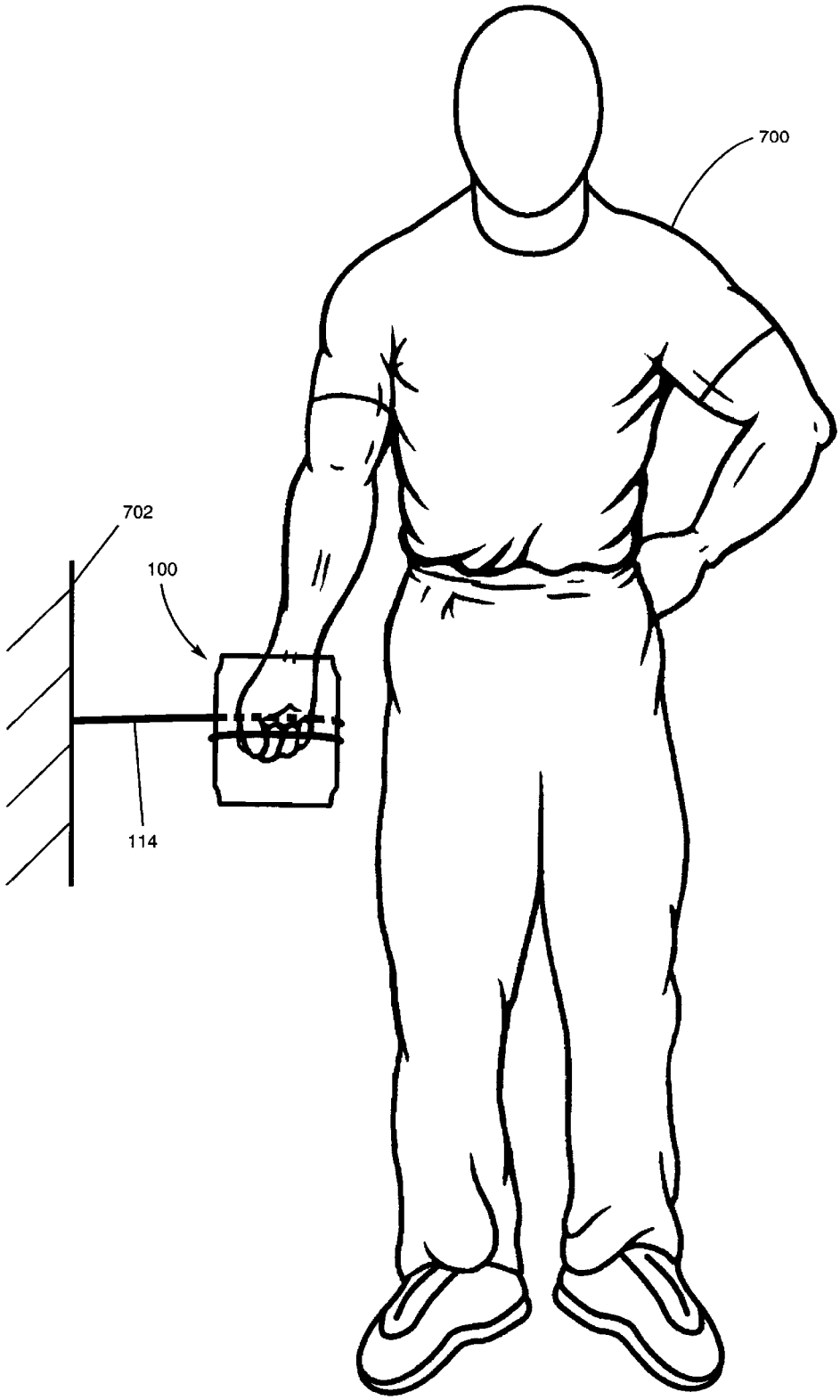
Figure 7D:
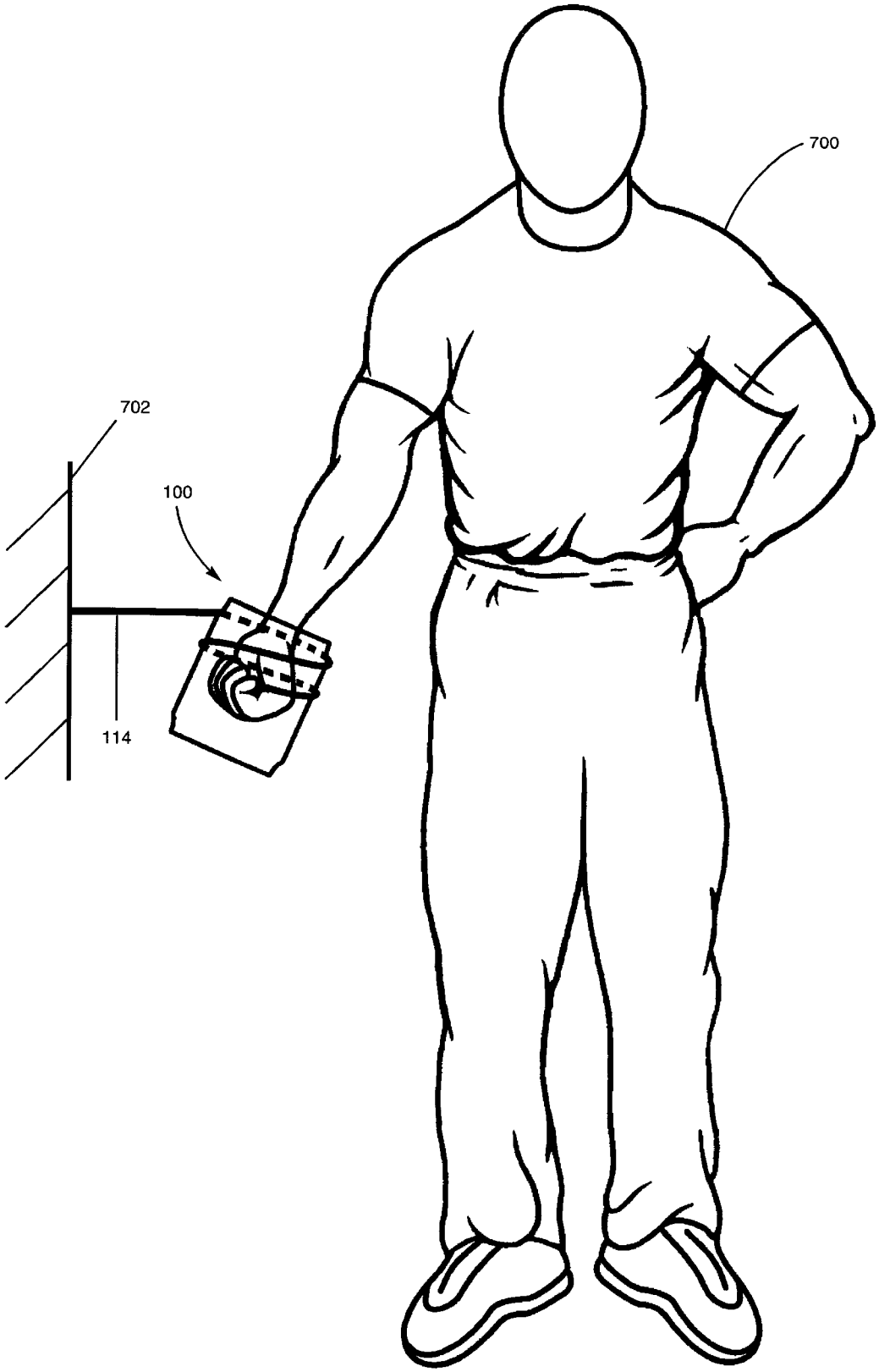
Figure 7E:
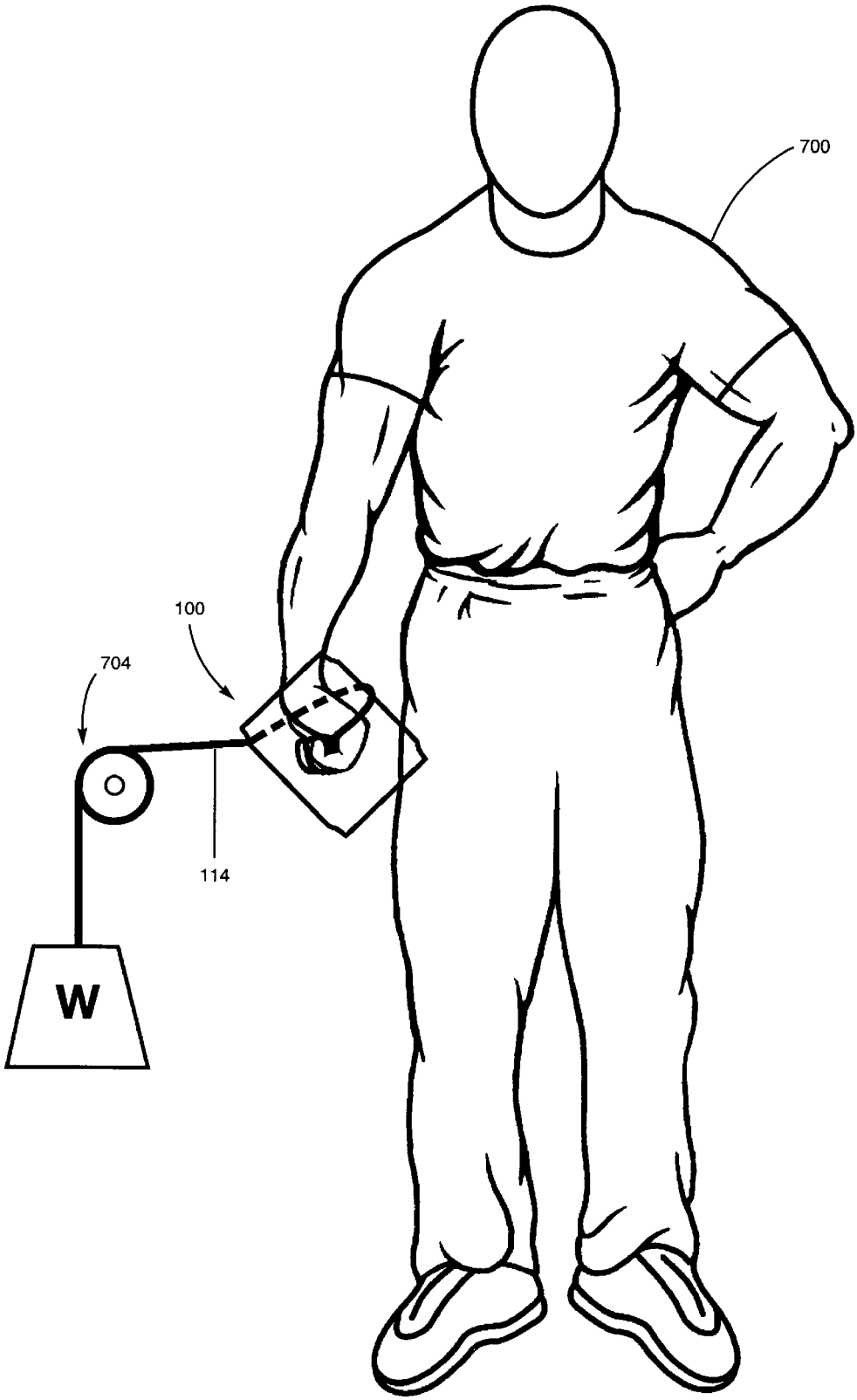
Figure 7F:
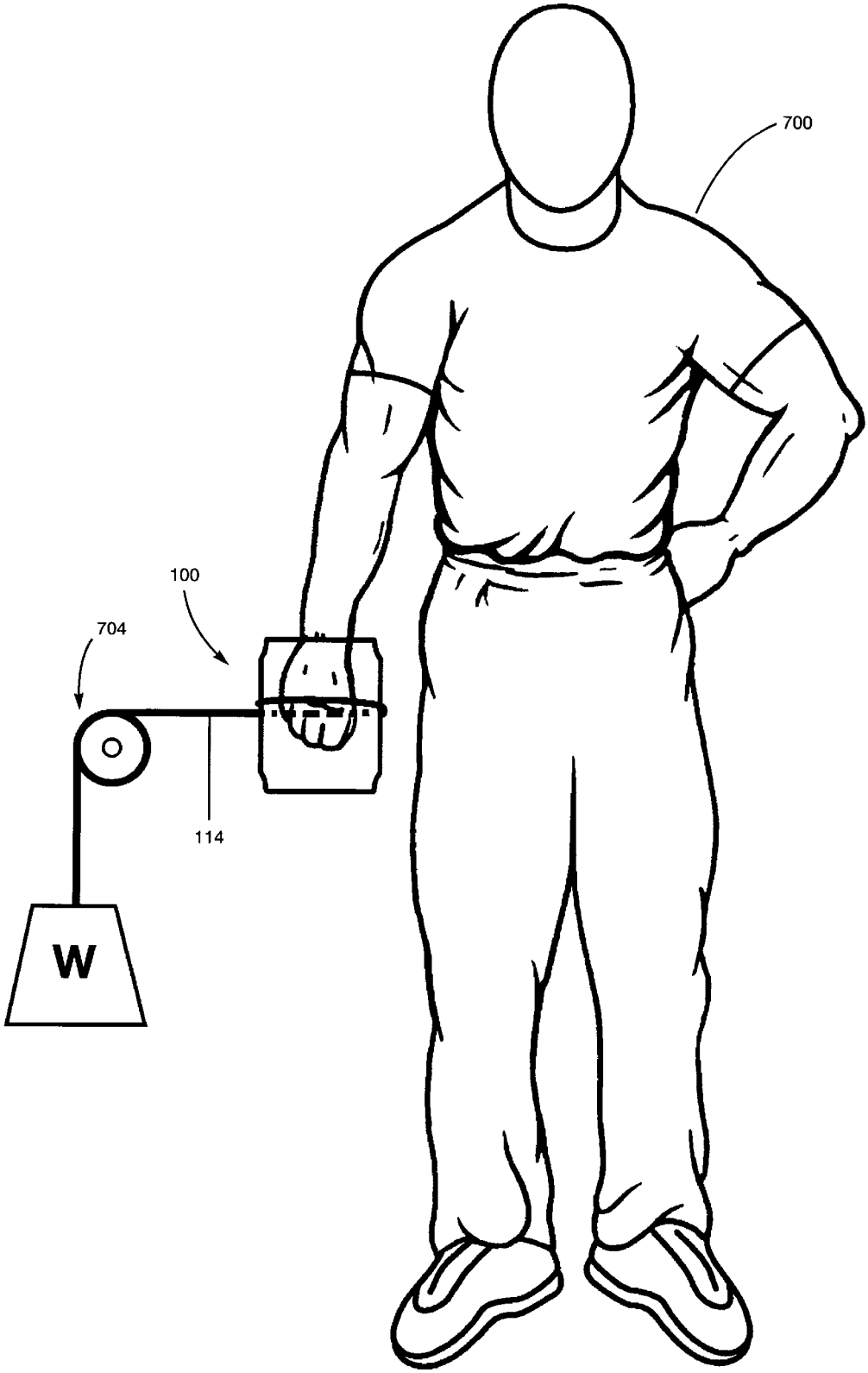
Figure 7G:
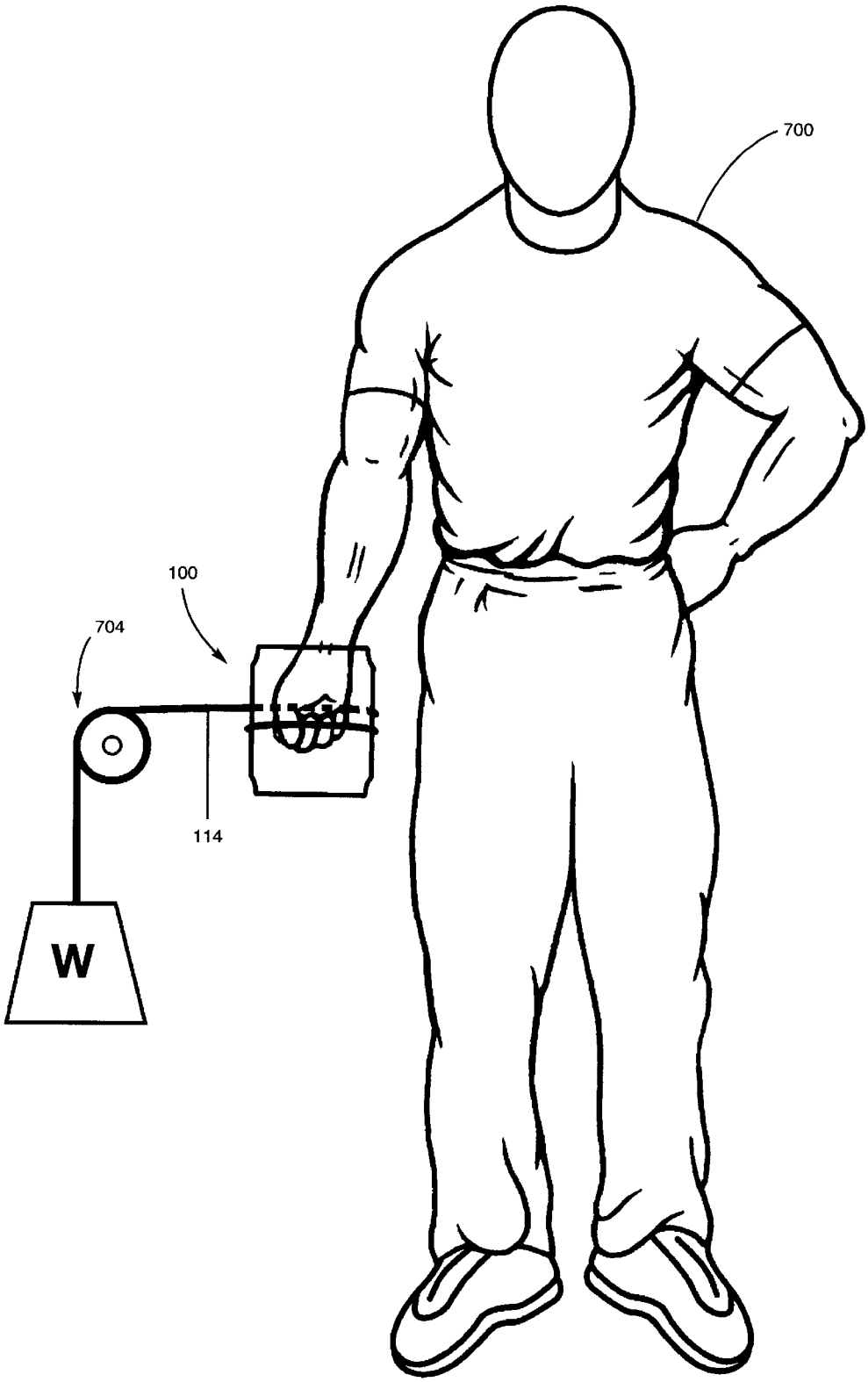
Figure 7H:
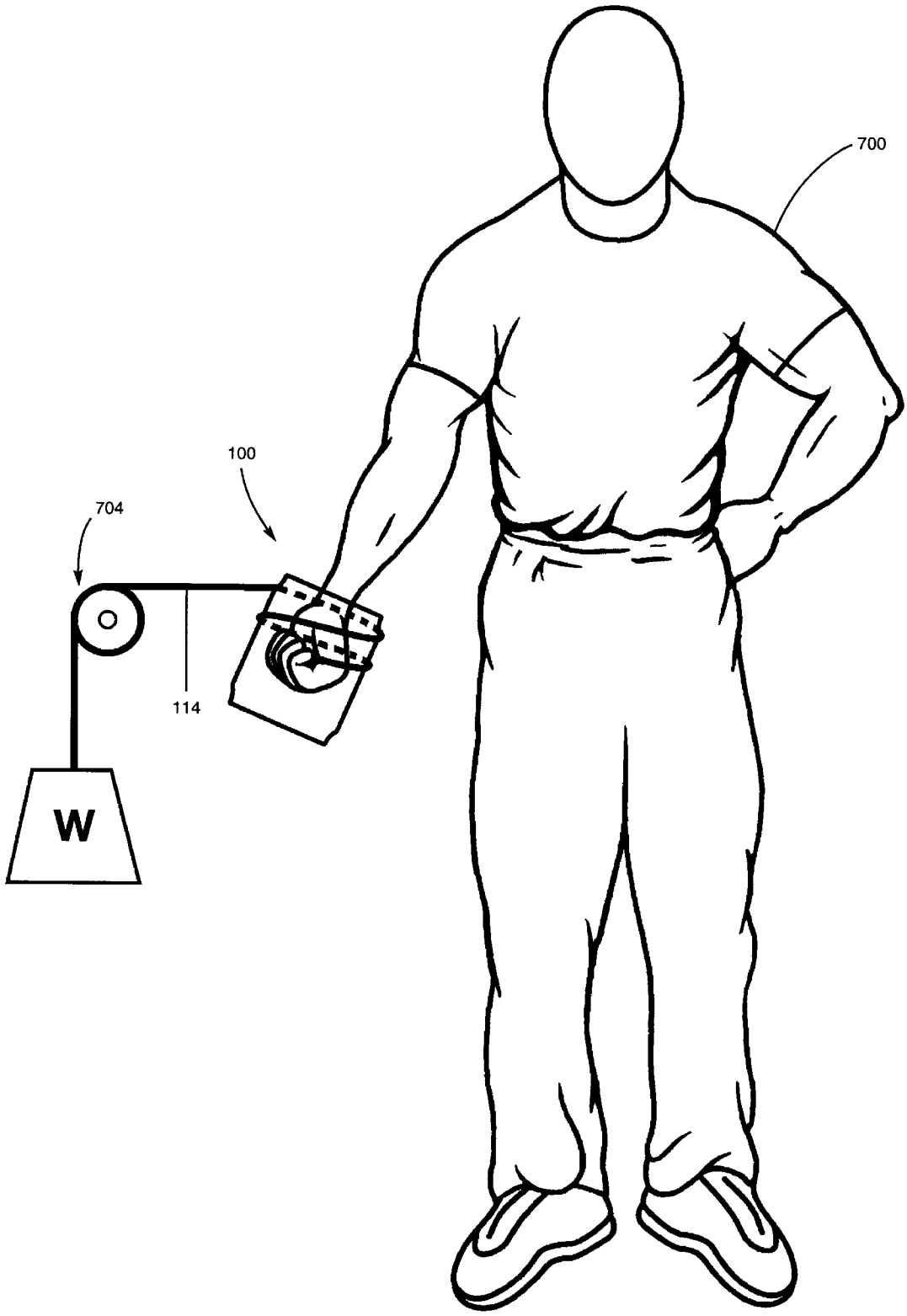

First, the exerciser 700 assumes an initial position in which he has pronated his right forearm and internally rotated his right shoulder joint to his substantially maximal supination-external-rotation range of motion, as shown in FIG. 7A, which may or may not be his full anatomic range of motion, depending on his degree of conditioning and skill at performing the exercise. The exerciser 700 preferably holds this position for a predetermined amount of time so that a substantially maximal voluntary stretch is attained. Next, the exerciser 700 supinates his right forearm and externally rotates his right shoulder joint against the pull of the flexible member 114 to a supination-external-rotation substantially maximal range of motion, as shown in FIG. 7D, which may or may not be his full anatomic range of motion, depending on his degree of conditioning and skill at performing the exercise. FIGS. 7B and 7C illustrate intermediate phases of the external rotation exercise between the positions shown in FIGS. 7A and 7D. The step of supinating preferably includes extending and radially deviating the exerciser's 700 right wrist, while the step of pronating preferably includes flexing and ulnarly deviating the exerciser's 700 right wrist. It is preferable that the exerciser 700 hold each substantially maximal position for a predetermined time period of at least one second, and preferably between one and two seconds, before he continues the exercise. The exerciser 700 can repeat the supinating and pronating steps with his right arm as many times as desired. Following performance of the exercise with the right arm, the exercise can be performed with the left arm in a manner that will be apparent to those skilled in the art.

FIGS. 7E–7H are identical to FIGS. 7A–7D, except that the inertial resistance is a movable resistance, represented by weight 704, and the flexible member 114 is inelastic.

Figure 8A:
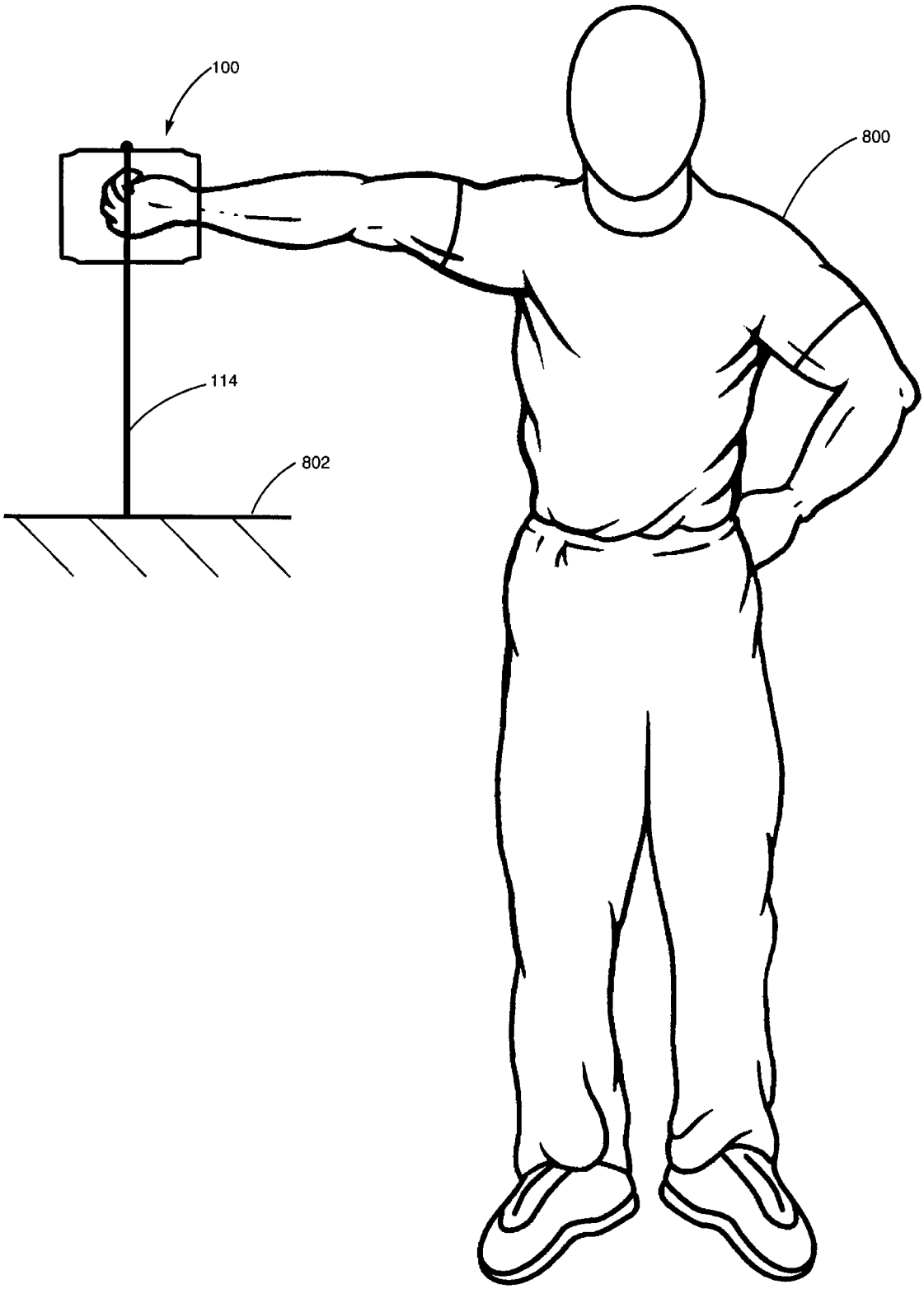
FIGS. 8A–8F are illustrations of an exerciser at various phases of performing a straight-arm lateral external shoulder rotation exercise in accordance with the teachings of the present invention.
Figure 8B:
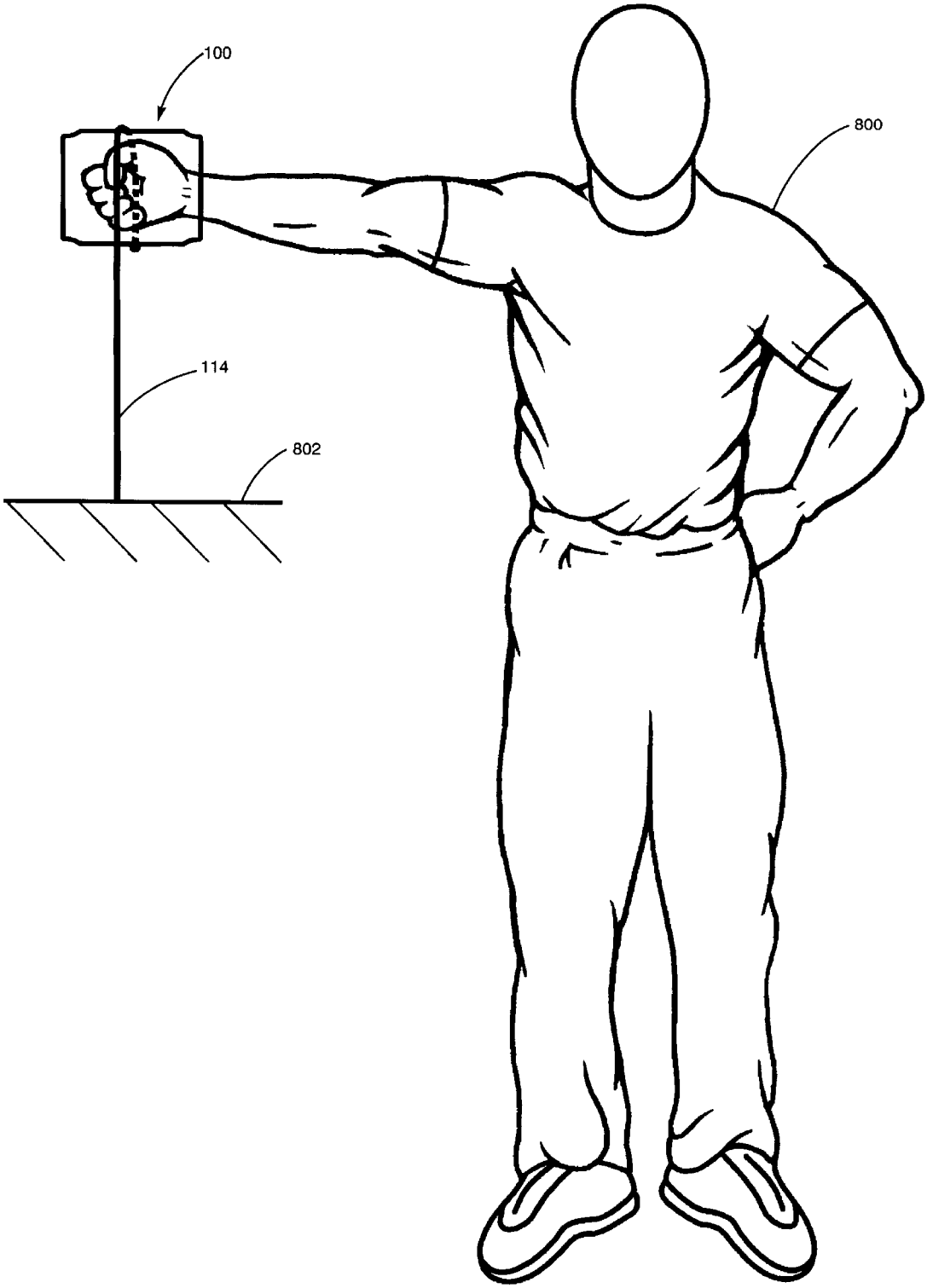
Figure 8C:
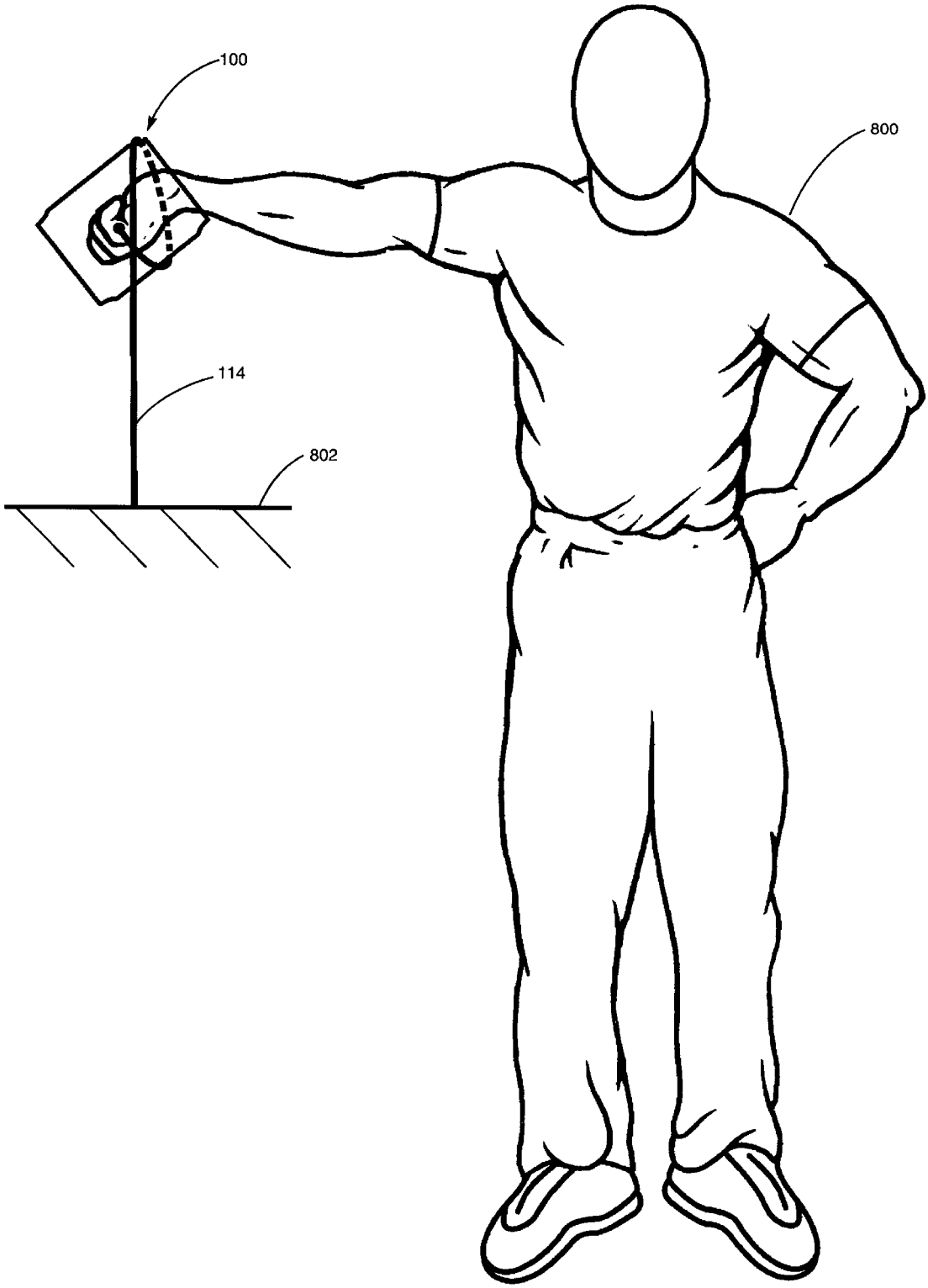

Referring now to FIGS. 8A–8C, shown is an exerciser 800 performing an external shoulder rotation exercise embodying concepts of the present invention. The exerciser 800 is grasping a live-hand device 100 having a handle (not shown) disposed within an opening of the device 100. The first end of a flexible member 114 is attached to the device 100 and a second end of the flexible member 114 is attached to an inertial resistance, shown in FIGS. 8A–8C as a fixed point 802. The flexible member 114 can be elastic or inelastic, and the inertial resistance can be the fixed point 802 or one or more weights, hydraulic resistance devices, springs, or the like. FIGS. 8A–8C depict the flexible member 114 as elastic. It is preferable that the fixed point 802 is located at approximately the exerciser's 800 waist level and in front of the exerciser 800.

If one or more weights are used as the inertial resistance, it is preferable that they can be moved through space by the exerciser via the flexible member 114. The device 100 is positioned at a first position at which the flexible member 114 is substantially taut. It is also preferable that the exerciser 800 marks the distance between the first position and the fixed point 802 after he has positioned the device 100 at the first position. Marking the first position allows the exerciser 800 to record the resistance used when the resistance is supplied by an elastic flexible member 114. Marking is especially valuable when the exerciser 800 wants to perform an exercise with each arm in succession with substantially equal resistance through an elastic flexible member 114.

The exerciser's 800 right hand is preferably closer to the fixed point 802 than his second hand and the fixed point 802 is preferably located in front of the exerciser 800; however, any comfortable position in which the fixed point 802 resists external shoulder rotation is acceptable. The exerciser 800 grasps the handle of the device 100 with his right palm facing substantially backward and with his right arm substantially extended substantially laterally and horizontally from his side, as shown in FIG. 8A. The device 100 is positioned so that the flexible member 114 is wrapped around at least one-eighth of the exterior surface of the device 100 such that the flexible member 114 resists external rotation of the exerciser's 800 right shoulder joint.

Next, the exerciser 800 supinates his right forearm and externally rotates his right shoulder joint to his substantially maximal supination-external-rotation range of motion, as shown in FIG. 8C, which may or may not be his full anatomic range of motion, depending on his degree of conditioning and skill at performing the exercise. FIG. 8B illustrates an intermediate phase of the exercise between the positions shown in FIGS. 8A and 8C.

Next, the exerciser 800 pronates his right forearm and internally rotates his right shoulder joint from the position of FIG. 8C to his substantially maximal pronation-internal-rotation range of motion, shown in FIG. 8A, which may or may not be his full anatomic range of motion, depending on his degree of conditioning and skill at performing the exercise. The step of supinating preferably includes extension and radial deviation of the exerciser's 800 right wrist, while the step of pronating preferably includes flexion and ulnar deviation of the exerciser's 800 right wrist.

The first end of the flexible member 114 can be, but need not be, attached adjacent to the handle of the device 100. The exerciser 800 can attach the flexible member 114 to any part of the device 100 as desired to achieve his exercise objectives.

It is preferable that the exerciser 800 holds each substantially maximal position for a predetermined time period of at least one second, and preferably one to two seconds, before he continues the exercise. The exerciser 800 can repeat the supinating and pronating steps as many times as he desires.

Although FIGS. 8A–8D shows the exerciser 800 performing the straight-arm lateral external shoulder rotation exercise with his right arm, it will be obvious that the exercise can be performed with either arm as desired by the exerciser 800.

Figure 8D:
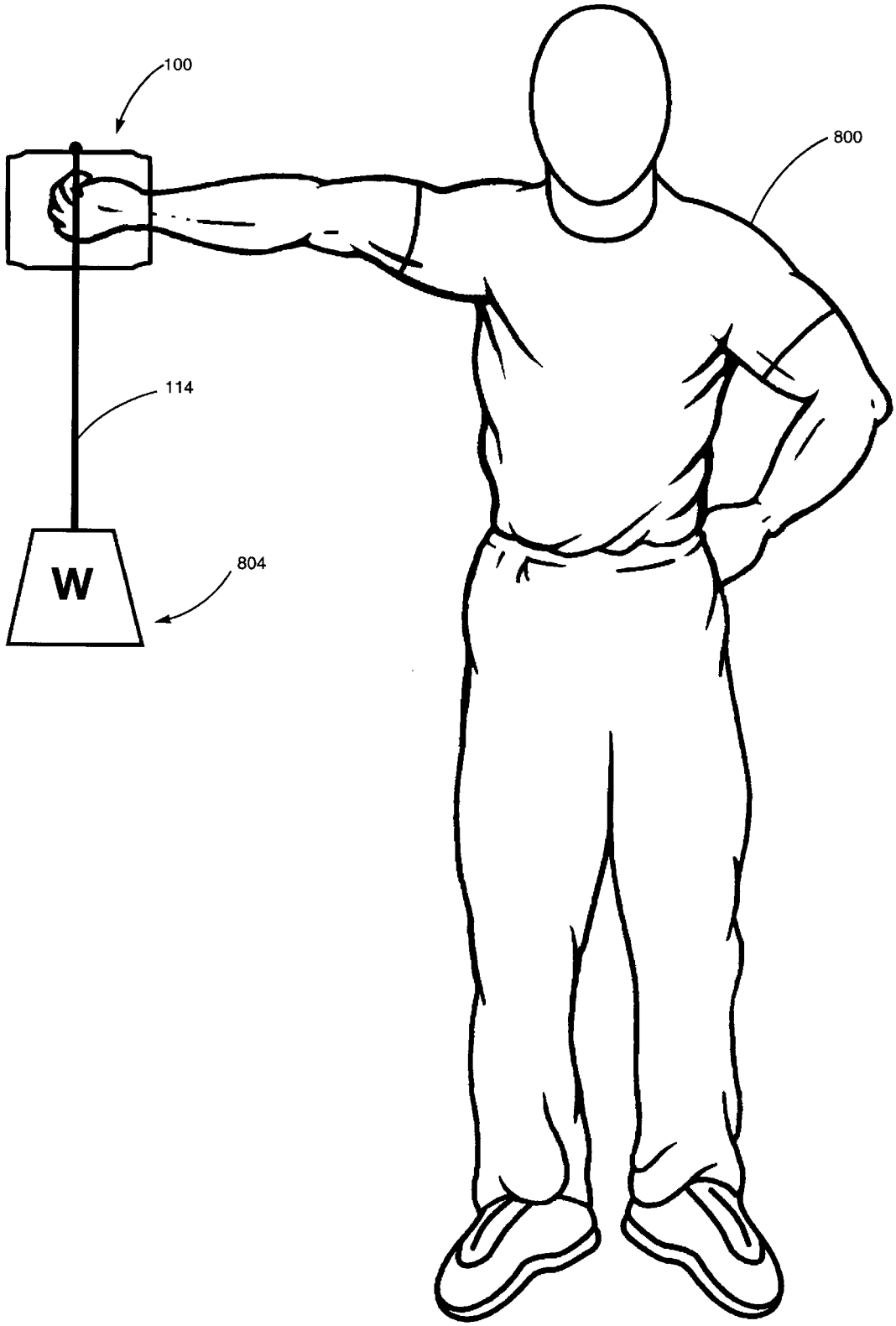
Figure 8E:
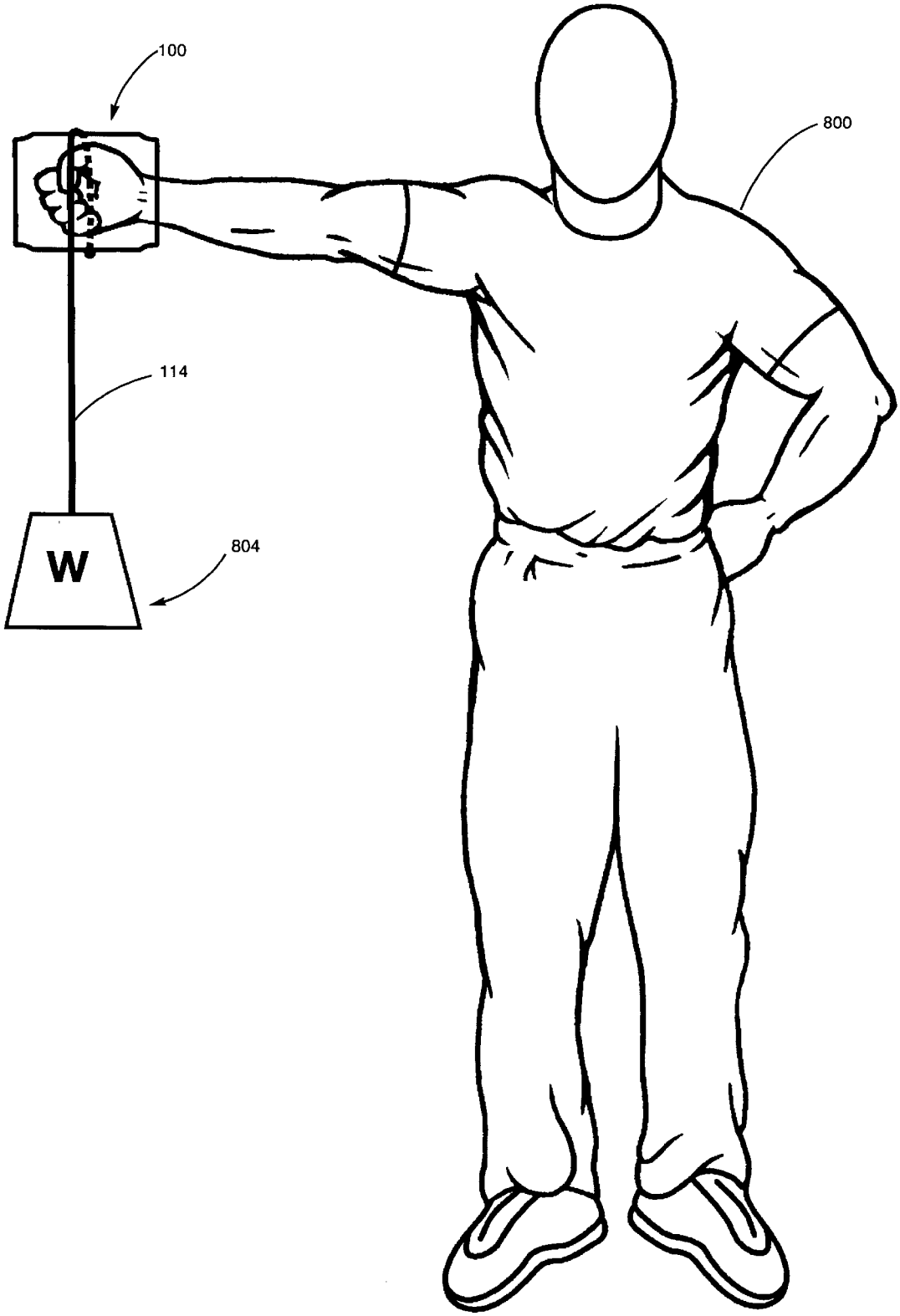
Figure 8F:
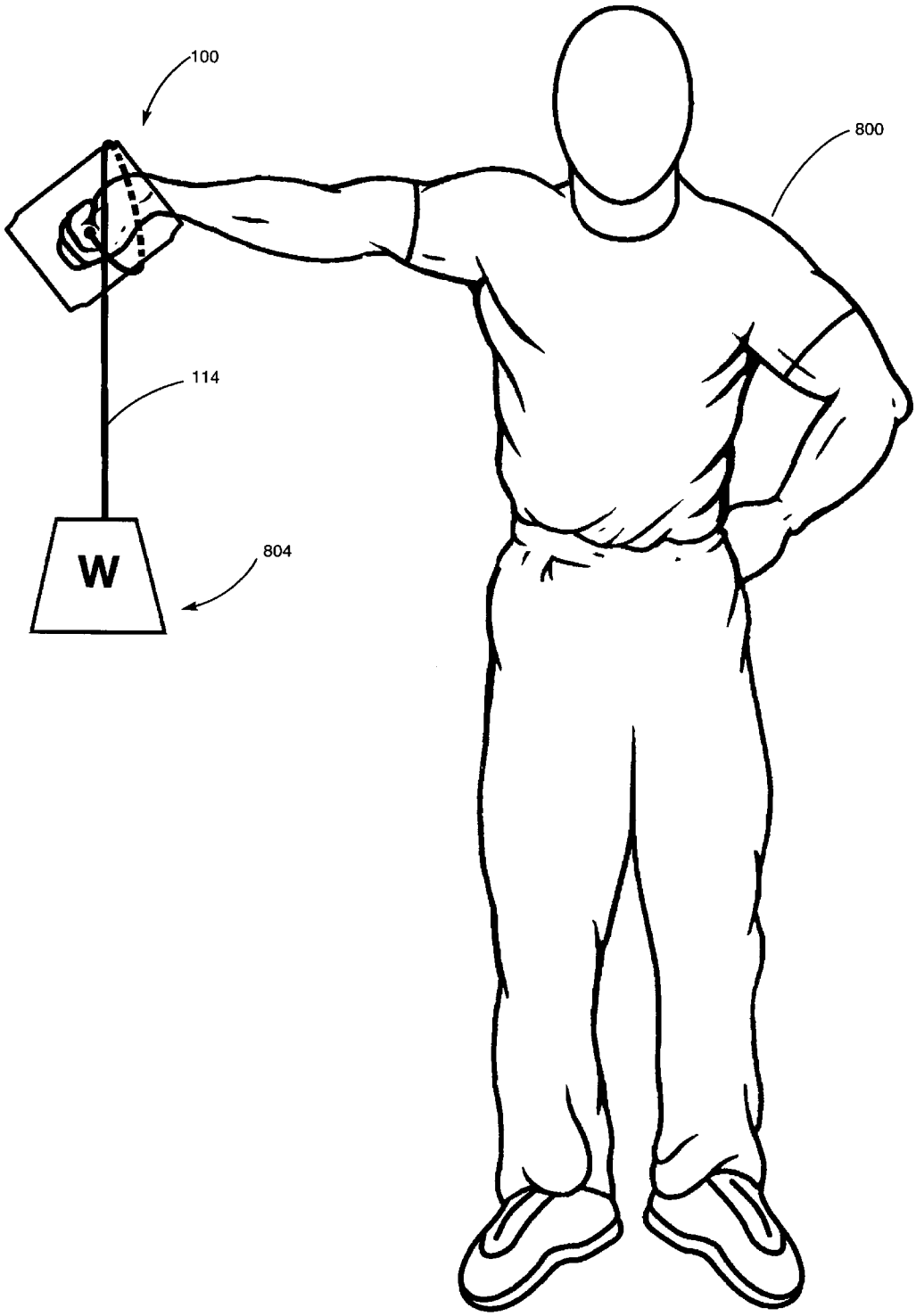

FIGS. 8D–8F are identical to FIGS. 8A–8C except that the inertial resistance is a weight 804 and the flexible member 114 is inelastic.

Figure 9A:
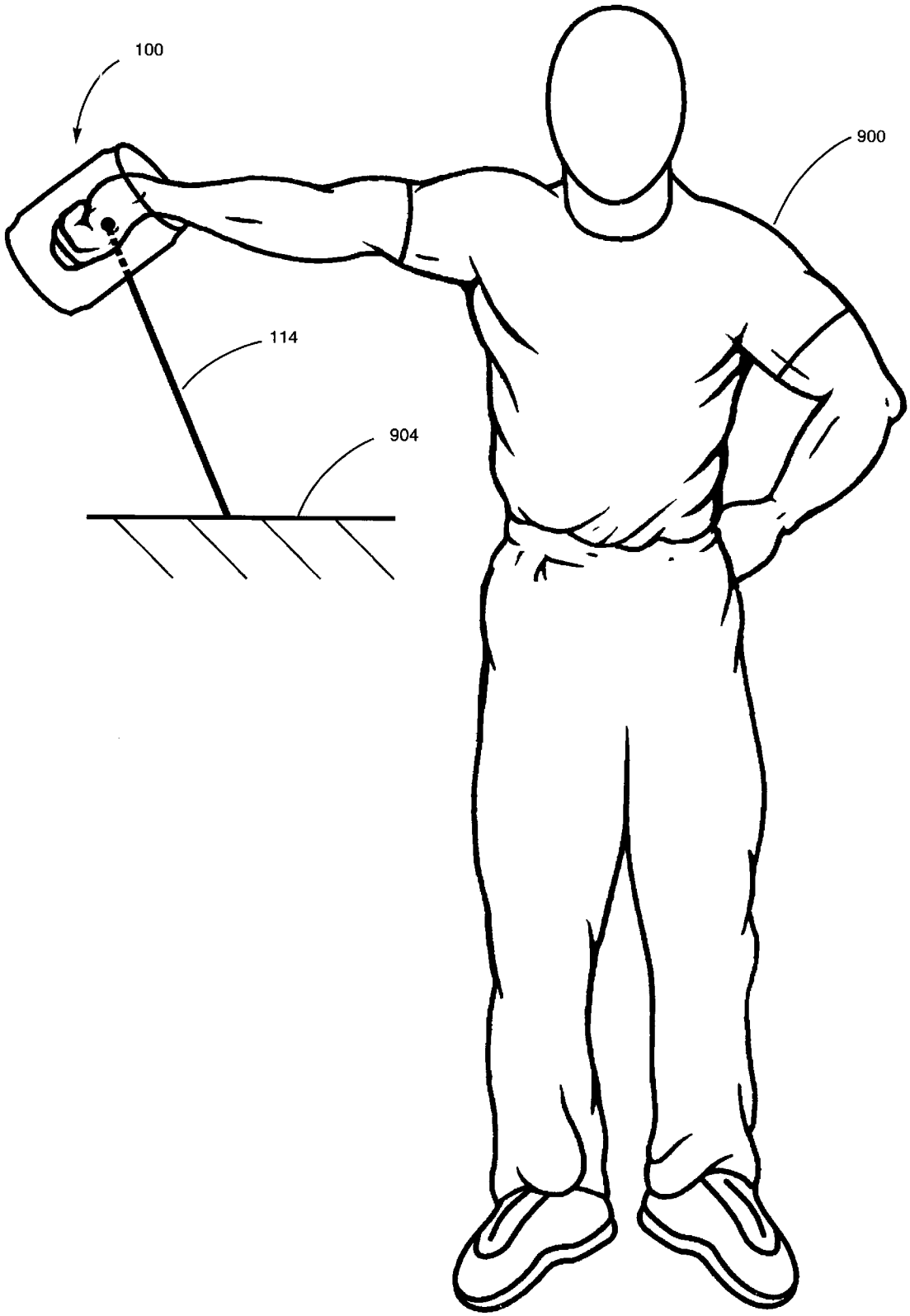
FIGS. 9A–9F are illustrations of an exerciser at various phases of performing a straight-arm lateral internal shoulder rotation exercise in accordance with the teachings of the present invention.
Figure 9B:
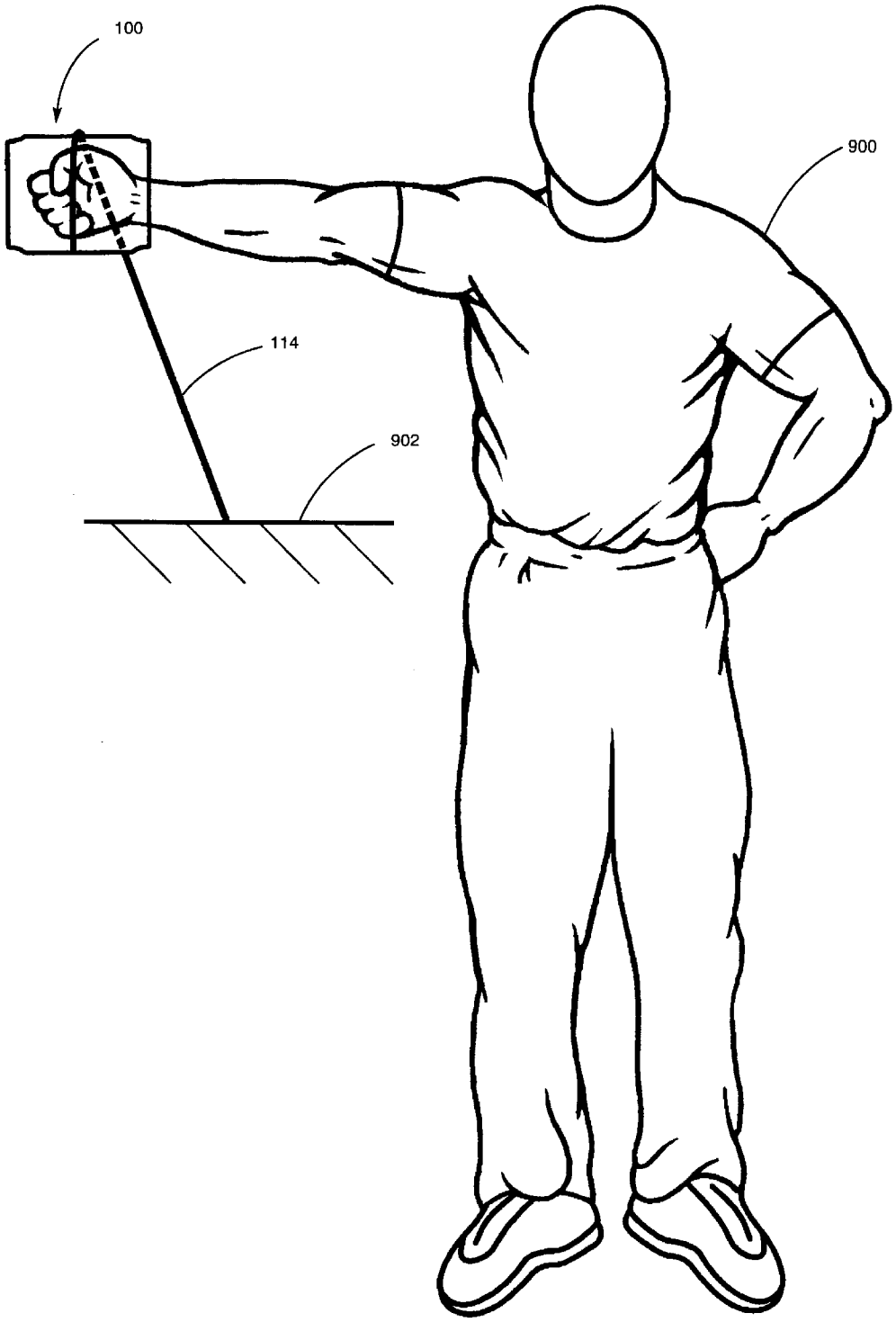
Figure 9C:
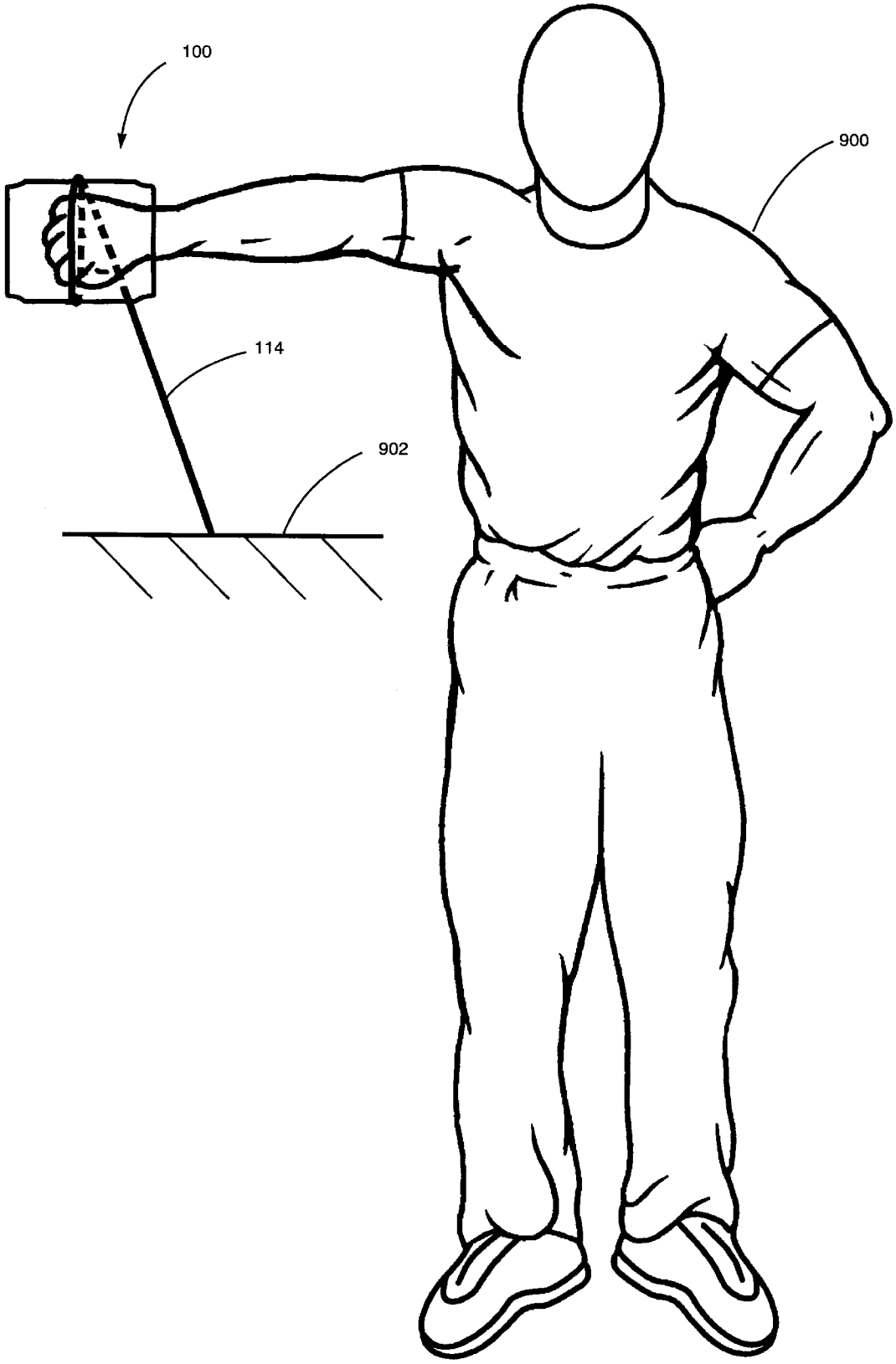

Referring now to FIGS. 9A–9C, shown is an exerciser 900 performing an internal shoulder rotation exercise embodying concepts of the present invention. The exerciser 900 is grasping with his right hand a live-hand device 100 having a handle (not shown) disposed within an opening of the device 100. The first end of a flexible member 114 is attached to the device 100 and a second end of the flexible member 114 is attached to an inertial resistance, shown in FIGS. 8A–8C as a fixed point 902. The flexible member 114 can be elastic or inelastic, and the inertial resistance can be a fixed point or one or more weights, hydraulic resistance devices, springs, or the like. FIGS. 9A–9C depict the flexible member 114 as elastic. It is preferable that the fixed point 902 is located at approximately the exerciser's waist level and in front of the exerciser.

If one or more weights are used as the inertial resistance, it is preferable that they can be moved through space by the exerciser 900 via the flexible member 114. The device 100 is positioned at a first position at which the flexible member 114 is substantially taut. It is also preferable that the exerciser 900 marks the distance between the first position and the fixed point 902 after he has positioned the device 100 at the first position. Marking the first position allows the exerciser 900 to record the resistance used when the resistance is supplied by an elastic flexible member 114. Marking is especially valuable when the exerciser 900 wants to perform an exercise with each arm in succession with substantially equal resistance through an elastic flexible member 114.

The exerciser's right hand is preferably closer to the inertial resistance than his left hand and the inertial resistance is preferably located in front of the exerciser; however, any comfortable position in which the inertial resistance resists internal shoulder rotation is acceptable. The exerciser 900 grasps the handle of the device 100 with his right palm facing substantially upward and with his right arm substantially extended substantially laterally and horizontally from his side, as shown in FIG. 9A. The device 100 is positioned so that the flexible member 114 is wrapped around at least one-eighth of the exterior of the device 100 such that the flexible member 114 resists internal rotation of the exerciser's right shoulder joint.

Next, the exerciser 900 pronates his right forearm and internally rotates his right shoulder joint to his substantially maximal pronation-internal-rotation range of motion, as shown in FIG. 9C, which may or may not be his full anatomic range of motion, depending on his degree of conditioning and skill at performing the exercise. FIG. 9B illustrates an intermediate phase of the exercise between the positions shown in FIGS. 9A and 9C.

Next, the exerciser 900 supinates his right forearm and externally rotates his right shoulder joint to his substantially maximal supination-external-rotation range of motion, as shown in FIG. 9A, which may or may not be his full anatomic range of motion, depending on his degree of conditioning and skill at performing the exercise. The step of supinating preferably includes extension and radial deviation of the exerciser's right wrist, while the step of pronating preferably includes flexion and ulnar deviation of the exerciser's right wrist.

The first end of the flexible member 114 can be, but need not be, attached adjacent to the handle of the device 100. The exerciser 900 can attach the flexible member 114 to any part of the device 100 as desired to achieve his exercise objectives.

It is preferable that the exerciser 900 holds each substantially maximal position for a predetermined time period of at least one second, and preferably one to two seconds, before he continues the exercise. The exerciser 900 can repeat the supinating and pronating steps as many times as he desires.

Although FIGS. 9A–9C show the exerciser 900 performing the straight-arm lateral internal shoulder rotation exercise with his right arm, it will be obvious that the exercise can be performed with either arm as desired by the exerciser.

Figure 9D:
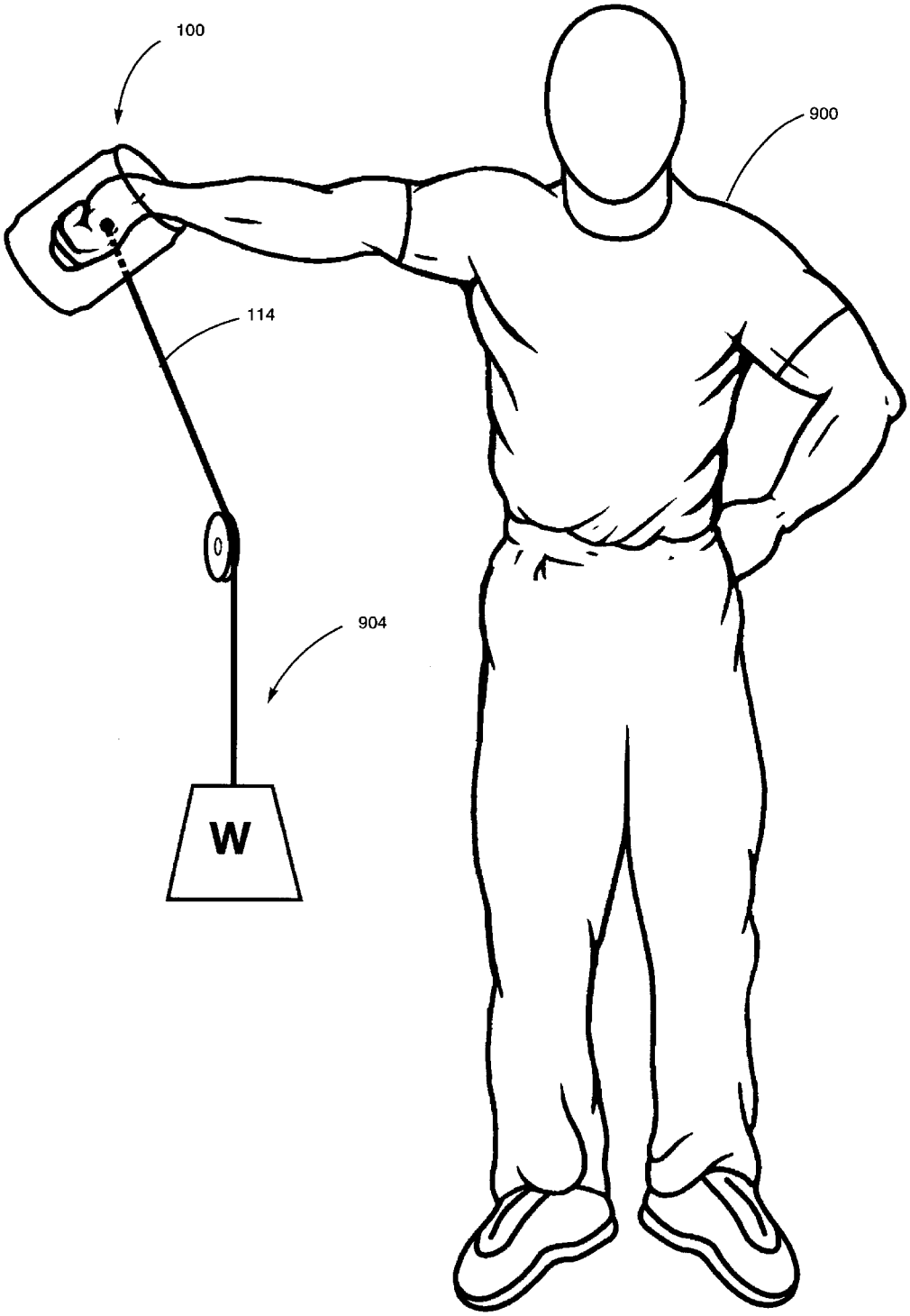
Figure 9E:
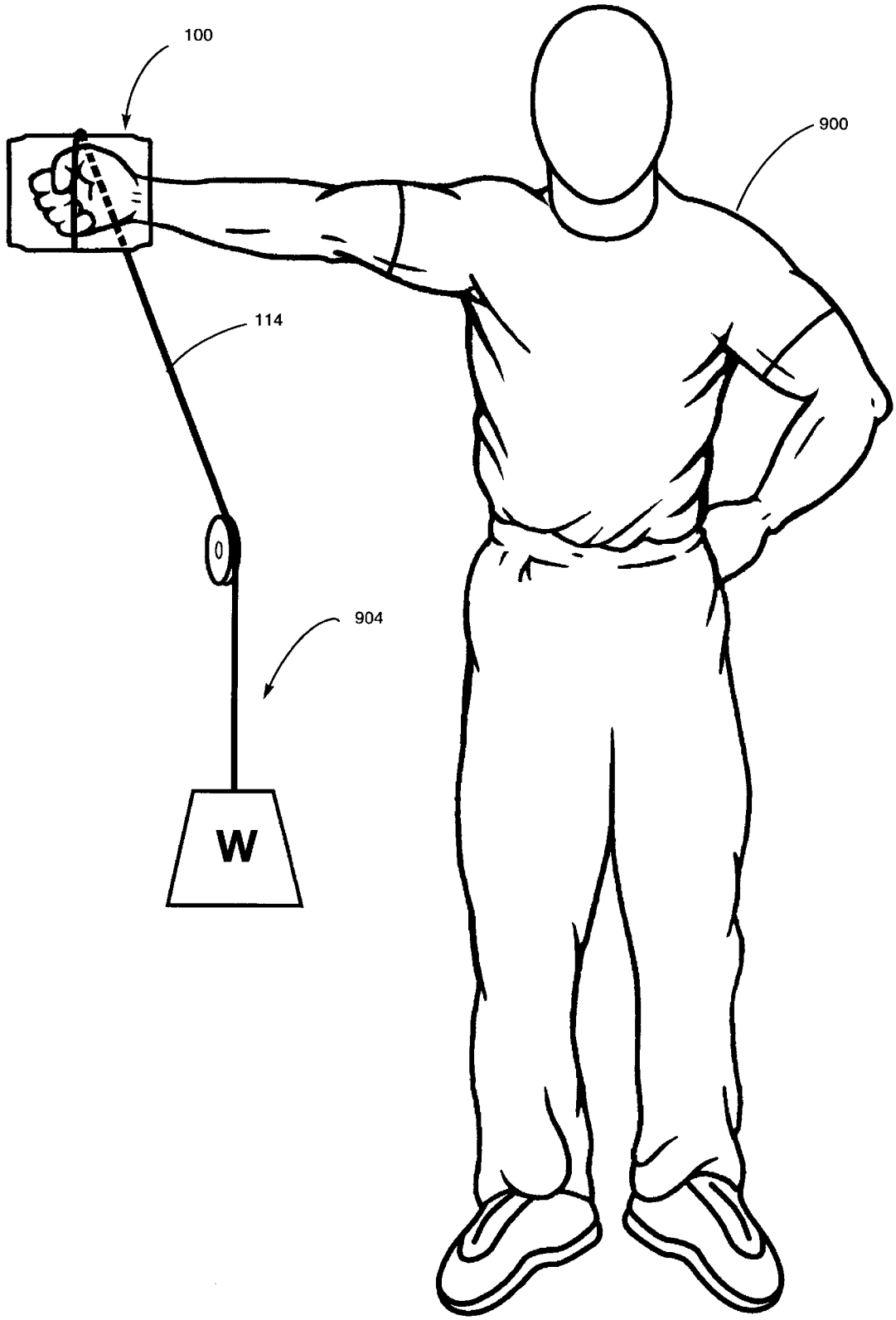
Figure 9F:
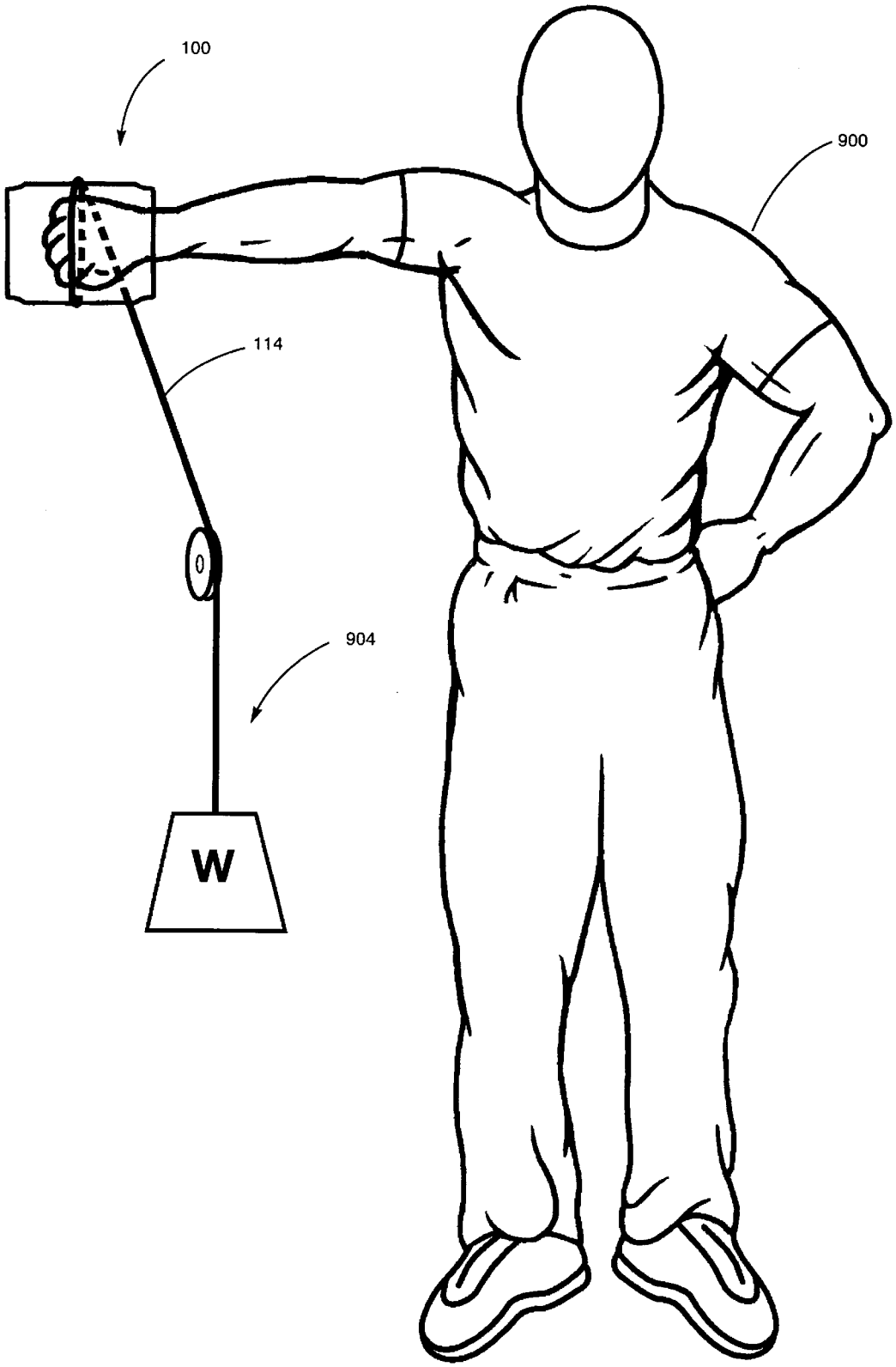

FIGS. 9D–9F are identical to FIGS. 9A–9C except that the movable inertial resistance represented by weight 904 and the flexible member 114 is inelastic.

Referring now to FIGS. 10A–10D, shown is an exerciser 1000 performing a shoulder/torso adduction exercise embodying concepts of the present invention. The exerciser 1000 is grasping with his right hand a live-hand device 100 having a handle (not shown) disposed within an opening of the device 100, as shown in FIGS. 10A–10D. The first end of a flexible member 114 is attached to the device 100 and a second end of the flexible member 114 is attached to an inertial resistance, depicted in FIGS. 10*a*–10D as a fixed point 1002. The flexible member 114 can be elastic or inelastic, and the inertial resistance can be a fixed point 1002 or one or more weights, hydraulic resistance devices, springs, or the like. The flexible member 114 depicted in FIGS. 10A–10D is elastic. It is preferable that the fixed point 1002 is located at approximately the exerciser's 1000 waist level.

If one or more weights are used as the inertial resistance, it is preferable that they can be moved through space by the exerciser via the flexible member 114. The device 100 is positioned at a first position at which the flexible member 114 is substantially taut. It is also preferable that the exerciser 1000 marks the distance between the first position and the fixed point 1002 after he has positioned the device 100 at the first position. Marking the first position allows the exerciser 1000 to record the resistance used when the resistance is supplied by an elastic flexible member 114. Marking is especially valuable when the exerciser 1000 wants to perform an exercise with each arm in succession with substantially equal resistance through an elastic flexible member 114.

Figure 10A:
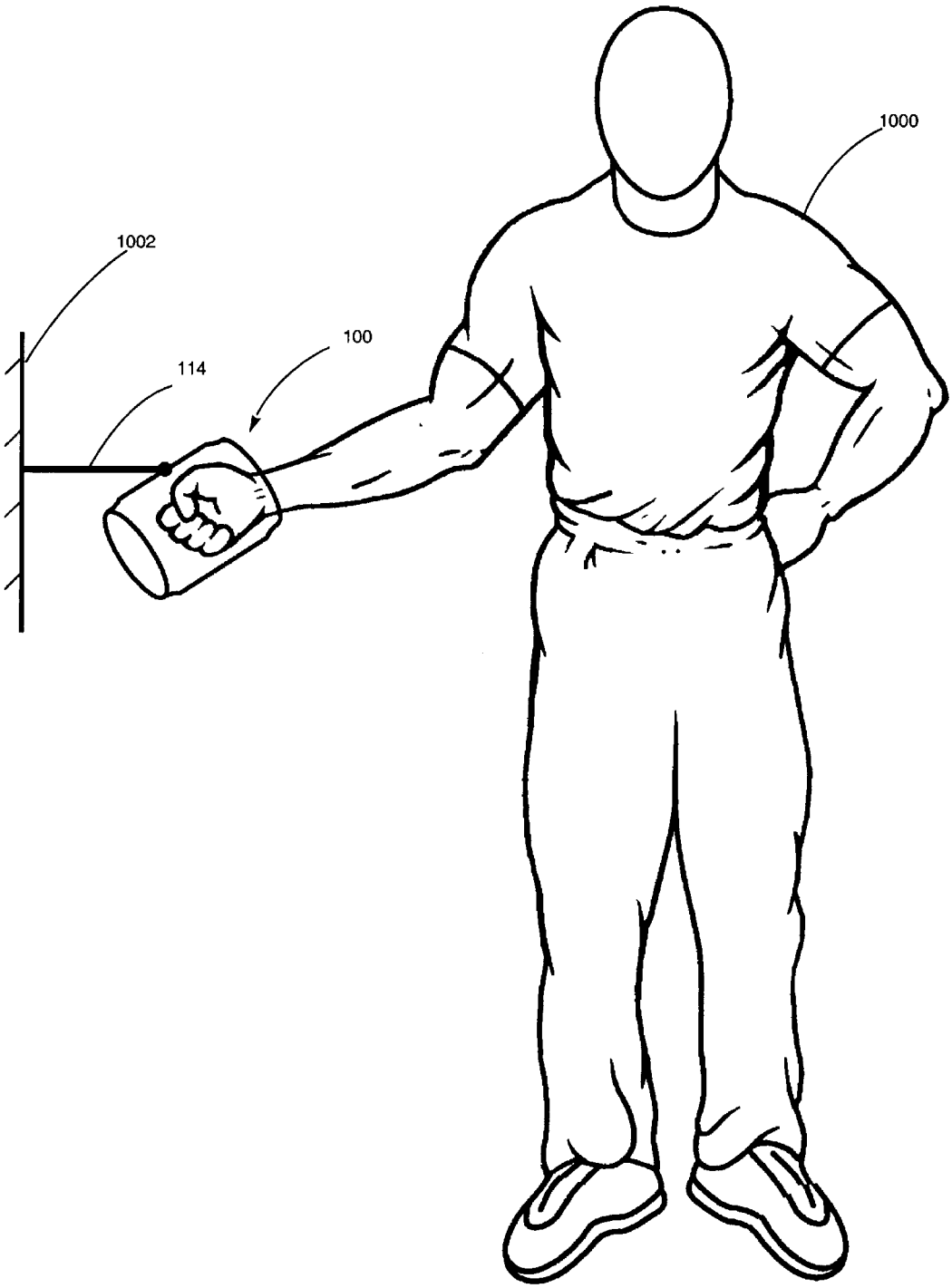
FIGS. 10A–10H are illustrations of an exerciser at various phases of performing a shoulder/torso anterior/posterior adduction exercise in accordance with the teachings of the present invention.

The exerciser's first hand is preferably closer to the inertial resistance, shown as the fixed point 1002 in FIGS. 10A–10D, than his second hand and the inertial resistance is preferably located lateral to the exerciser 1000 as shown in FIGS. 10A–10D; however, any comfortable position in which the inertial resistance resists adduction of the right arm across the exerciser's 1000 torso is acceptable. The exerciser 1000 grasps the handle of the device 100 with his right palm facing substantially forward and with his right arm substantially extended at his side as shown in FIG. 10A. The device 100 can be positioned so that the flexible member 114 is wrapped around at least one-eighth of the exterior of the device 100 such that the flexible member 114 unwraps anteriorly away from the anterior portion of the torso of the exerciser 1000. The first end of the flexible member 114 can be, but need not be, attached adjacent to the handle of the device 100. The exerciser 1000 can attach the flexible member 114 to any part of the device 100 as desired to achieve his exercise objectives.

Figure 10B:
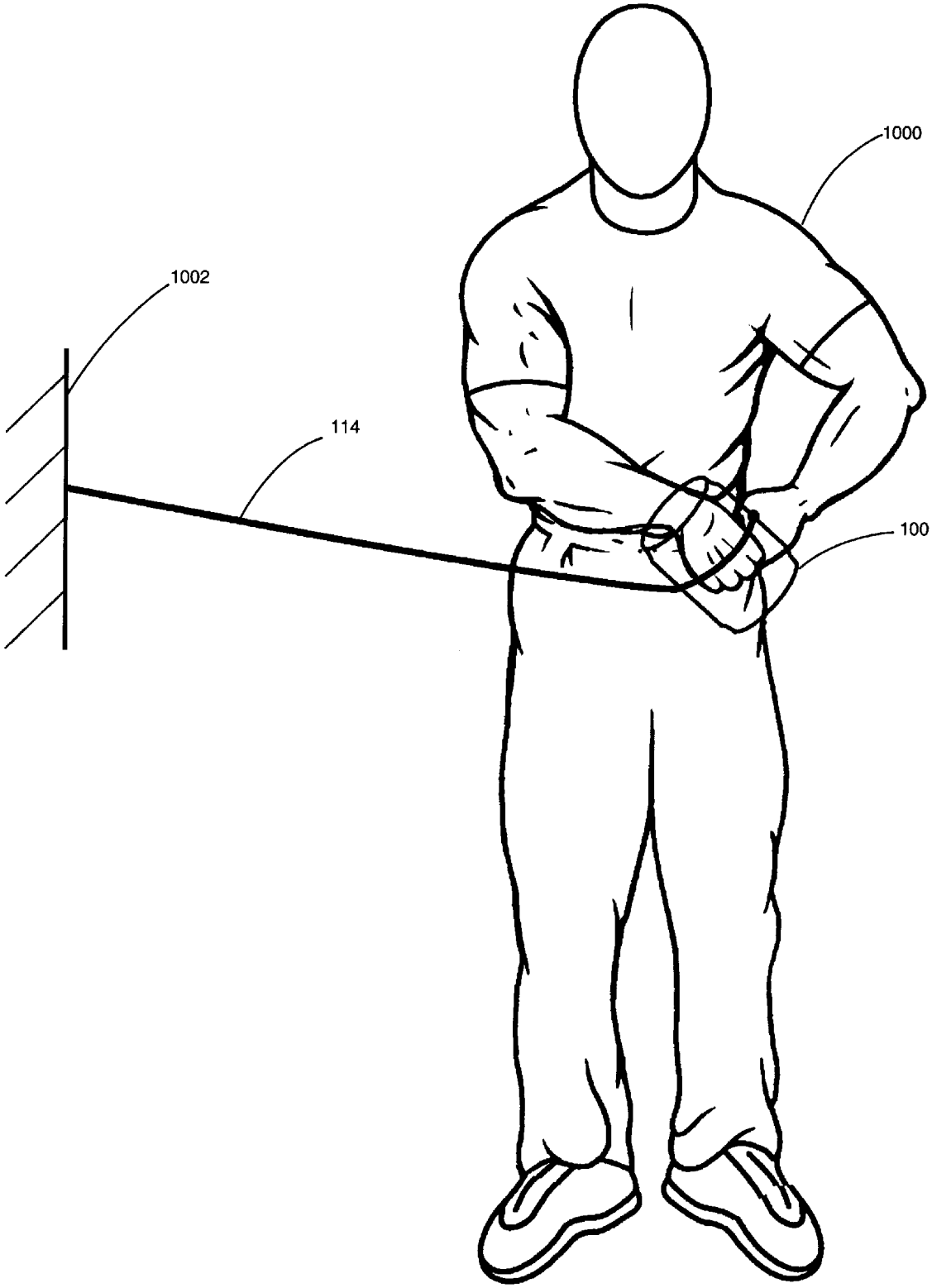

Next, the exerciser adducts his right arm across the anterior portion of his torso and pronates his right forearm and internally rotates his right shoulder against the inertial resistance through the flexible member 114 until the exerciser's right arm reaches the exerciser's 1000 substantially maximal adduction-pronation-internal rotation range of motion, as shown in FIG. 10B, which may or may not be his full anatomic range of motion, depending on his degree of conditioning and skill at performing the exercise. Next, the exerciser 1000 abducts his right arm across the anterior portion of his torso and supinates his forearm and externally rotates his shoulder toward the inertial resistance until his right hand is substantially extended at his side, as shown in FIG. 10A. The step of pronating preferably includes flexion and ulnar deviation of the exerciser's 1000 right wrist as shown in FIG. 10B, while the step of supinating preferably includes extension and radial deviation of the exerciser's 1000 right wrist as shown in FIG. 10A.

Figure 10C:
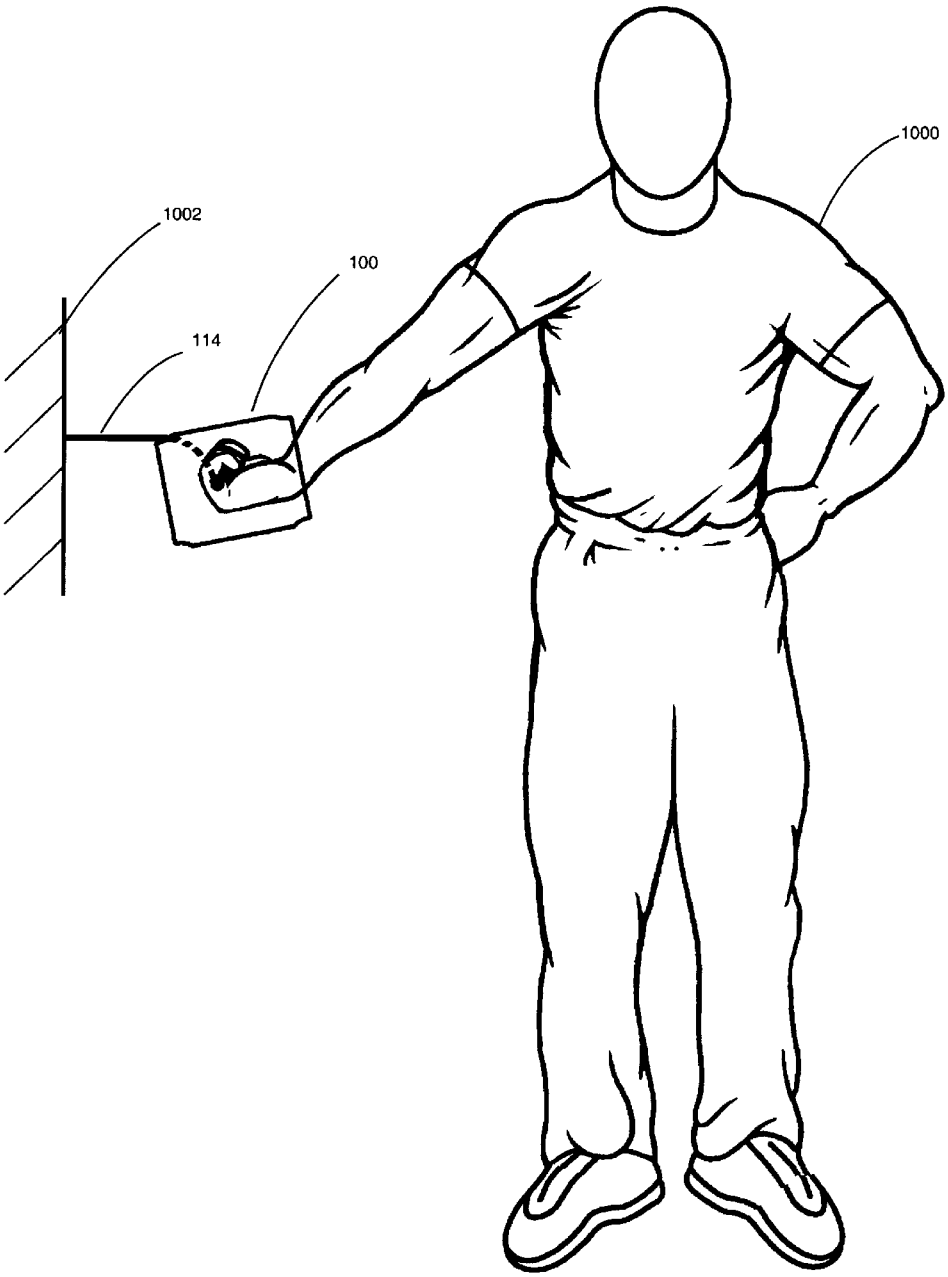
Figure 10D:
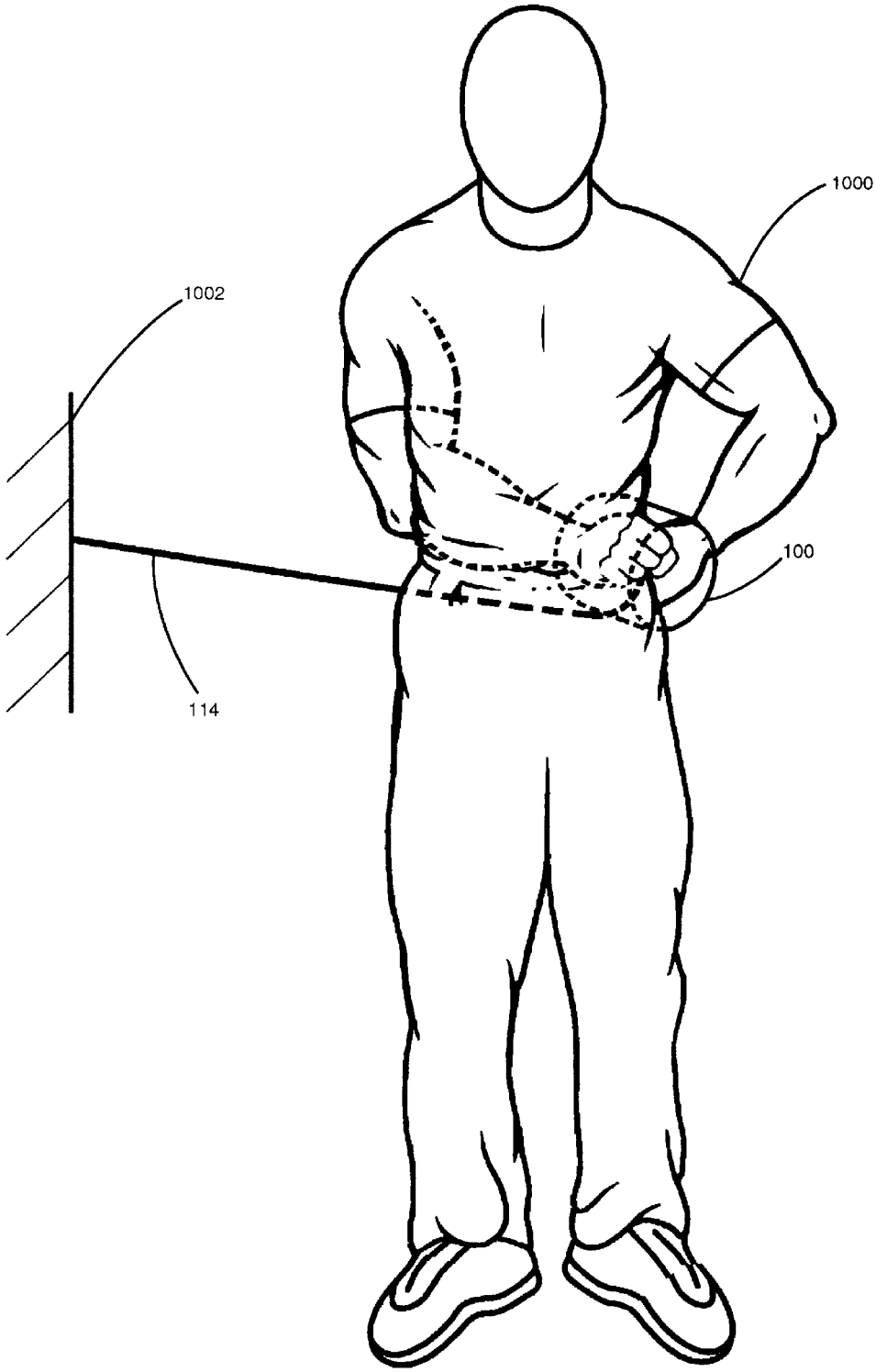
Figure 10E:
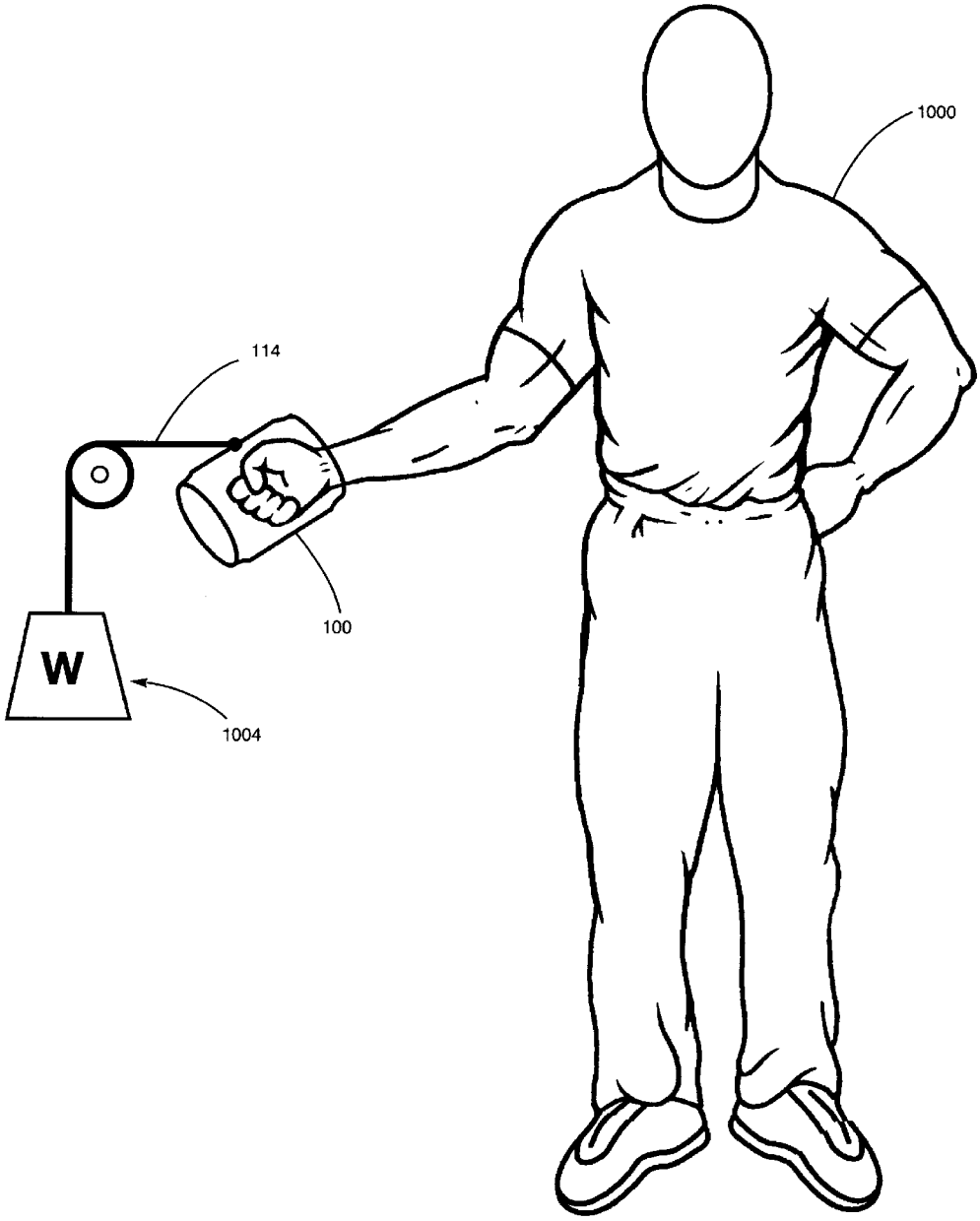
Figure 10F:
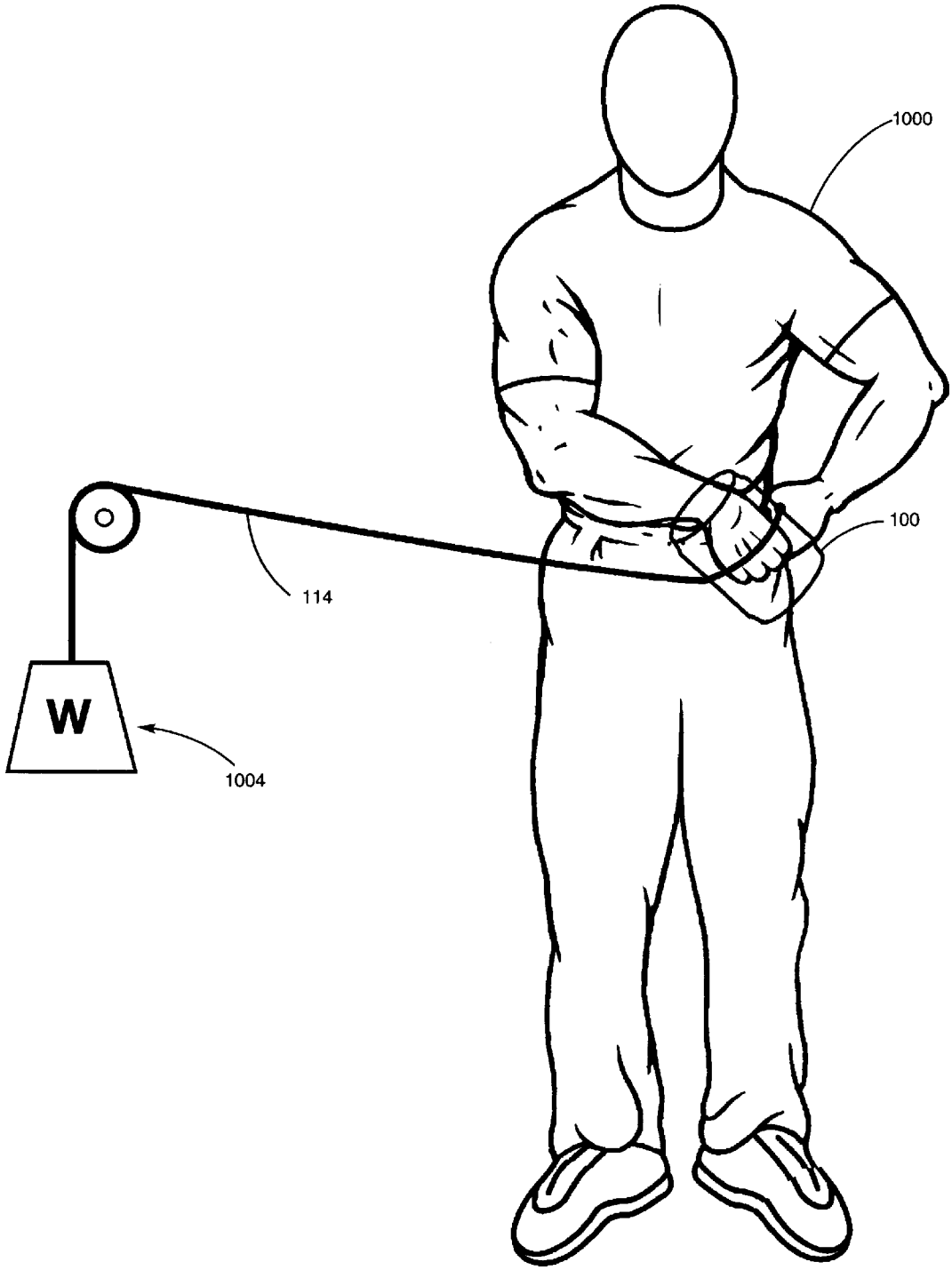
Figure 10G:
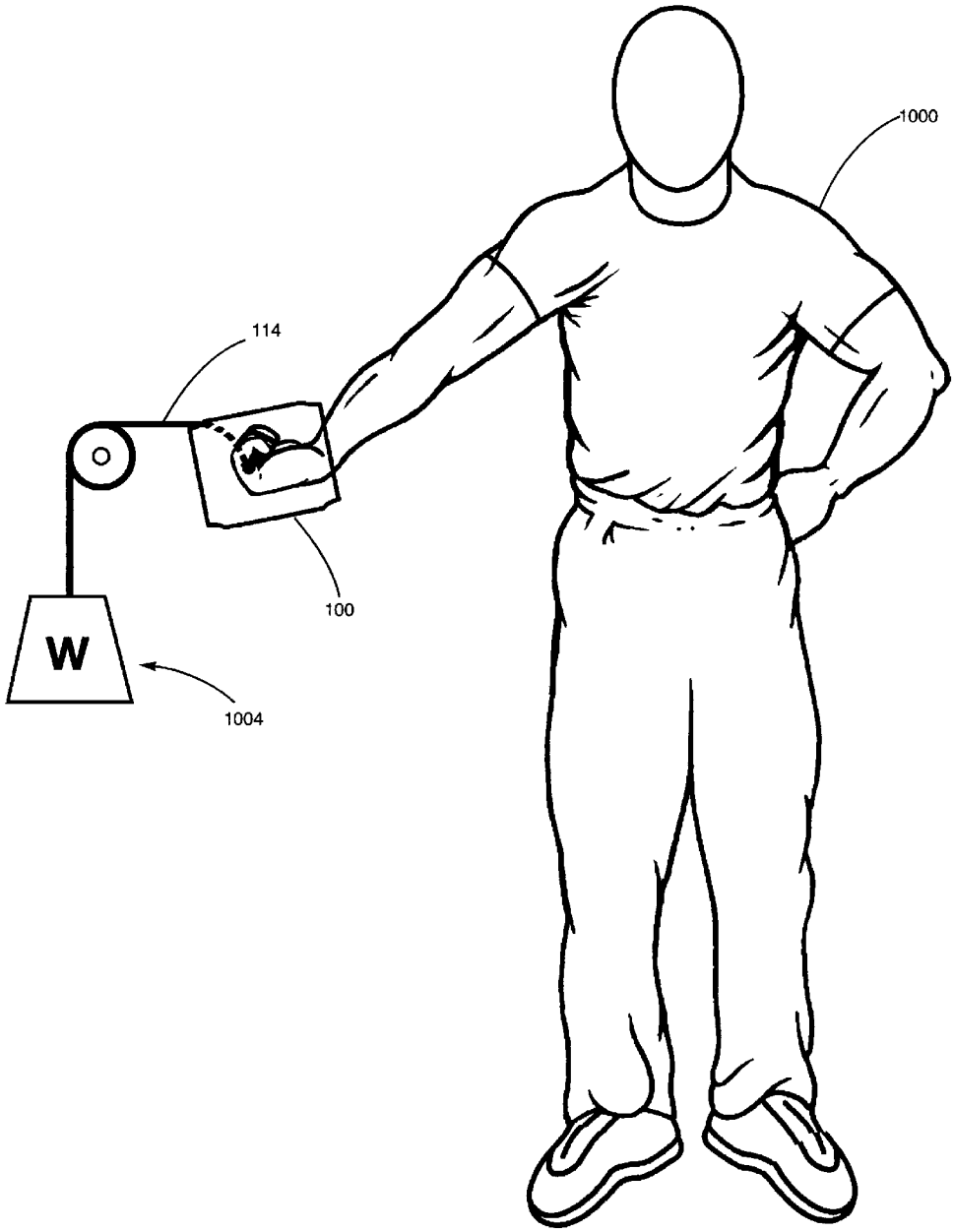
Figure 10H:
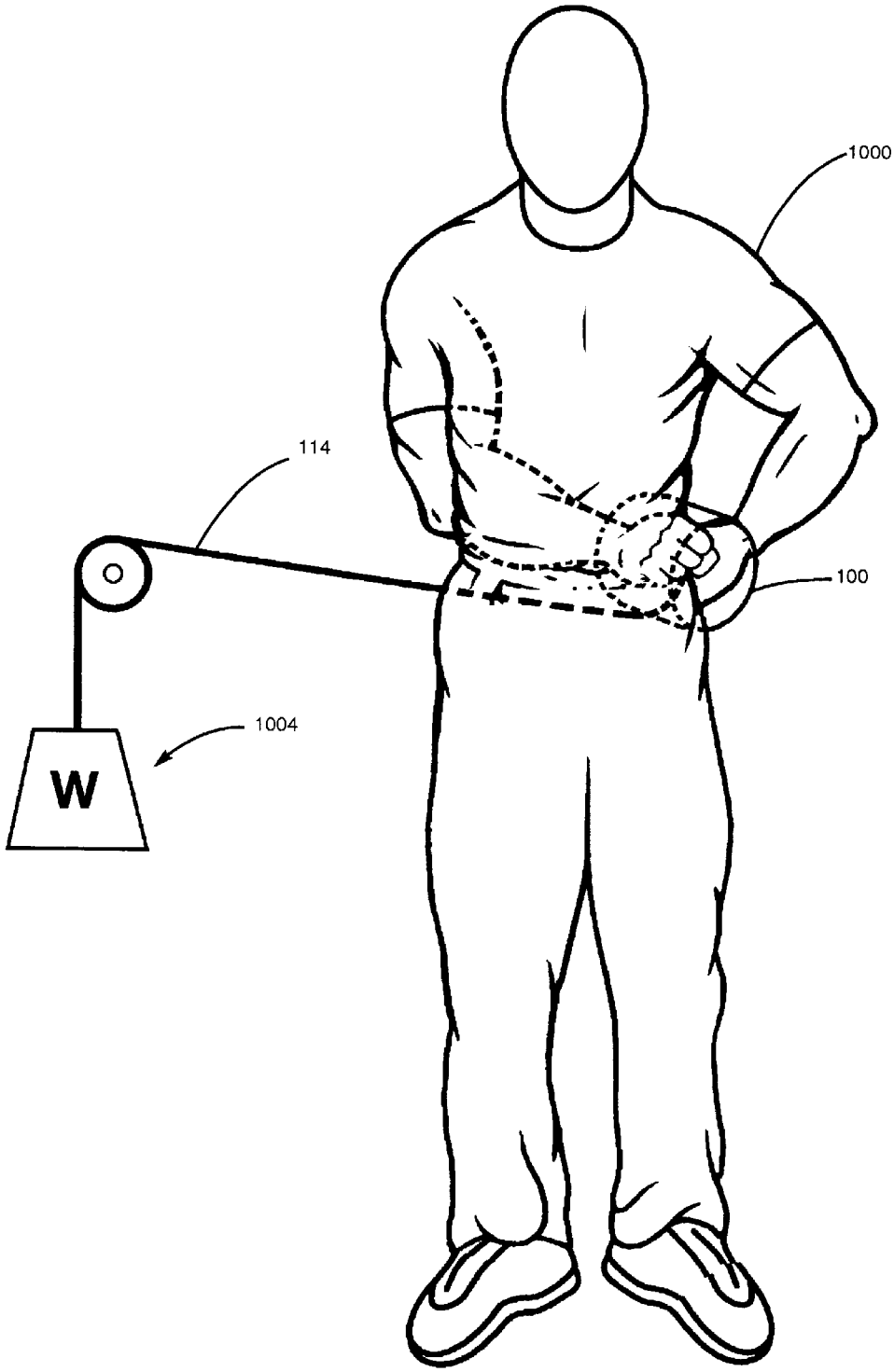

Next, the exerciser 1000 adducts his right arm and pronates his right forearm and internally rotates his right shoulder across the posterior portion of his torso against the inertial resistance through the flexible member 114 until his right arm reaches his substantially maximal adduction-pronation-internal rotation range of motion, which may or may not be his full anatomic range of motion, depending on his degree of conditioning and skill at performing the exercise. FIG. 10C shows the exerciser 1000 with his right arm abducted, right forearm pronated, and right shoulder internally rotated just prior to adduction of his right arm across the posterior portion of his torso. FIG. 10D shows the right arm when it has been adducted across the posterior portion of the exerciser's 1000 torso.

Next, the exerciser 1000 abducts his right arm across the posterior portion of his torso and externally rotates his right shoulder and supinates his right forearm until his right arm is substantially extended at his side as shown in FIG. 10A. The step of pronating preferably includes flexion and ulnar deviation of the exerciser's 1000 right wrist, as shown in FIG. 10C, while the step of supinating preferably includes extension and radial deviation of the exerciser's 1000 right wrist, as shown in FIG. 10A.

It is preferable that the exerciser 1000 holds the substantially maximal positions (both posterior torso and anterior torso) for a predetermined time period of at least one second, and preferably one to two seconds, before he continues the exercise. The exerciser 1000 can repeat the supinating and pronating steps as many times as he desires.

Although FIGS. 10A–10D show the exerciser 1000 performing the shoulder/torso adduction exercise with his right arm, it will be obvious that the exercise can be performed with either arm as desired by the exerciser.

FIGS. 10E–10H are identical to FIGS. 10A–10D except that the inertial resistance is a moveable inertial resistance, depicted as weight 1004 and the flexible member 114 is inelastic.

Figure 11A:
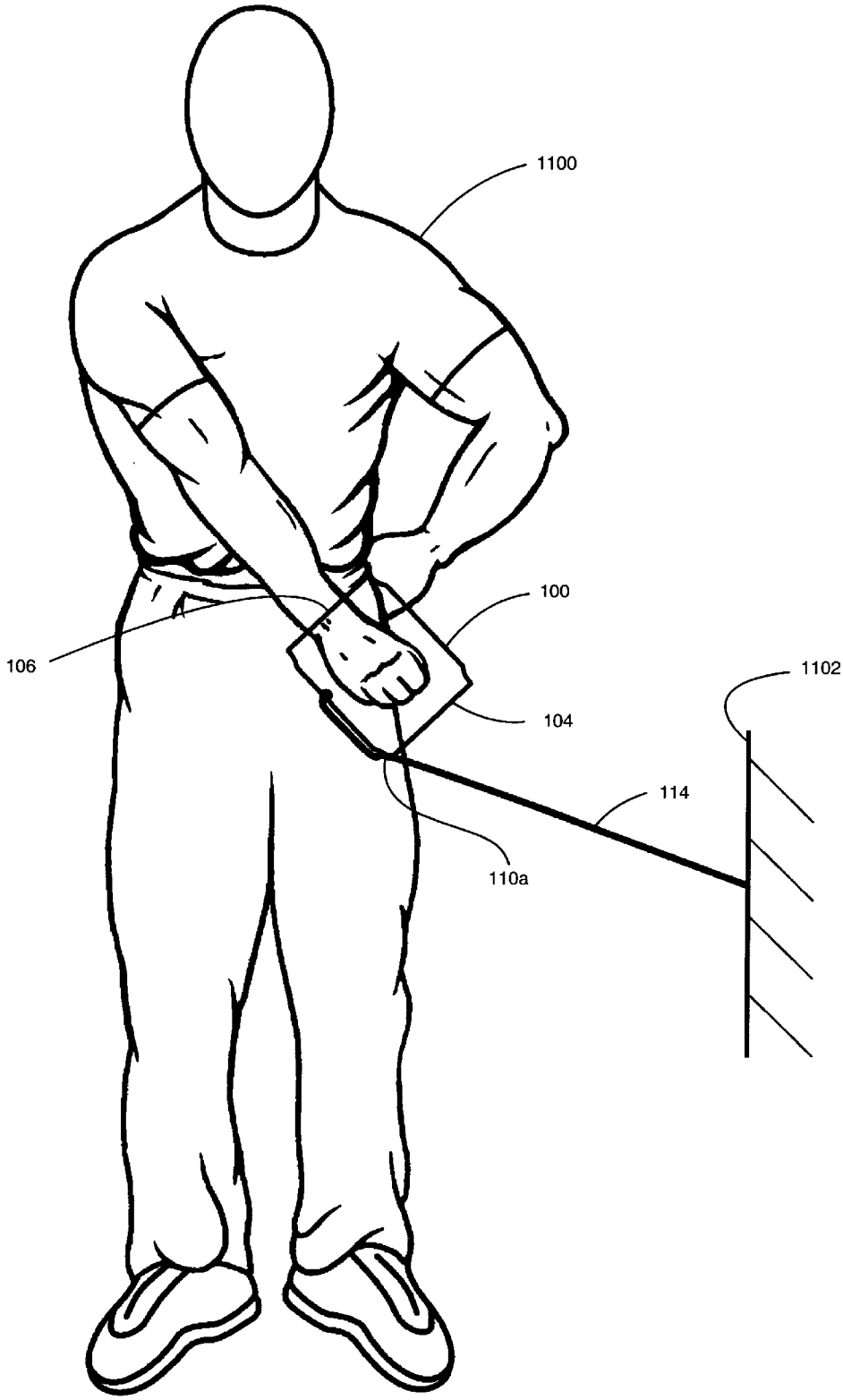
FIGS. 11A–11F are illustrations of an exerciser at various phases of performing a straight-arm shoulder fly exercise in accordance with the teachings of the present invention.
Figure 11B:
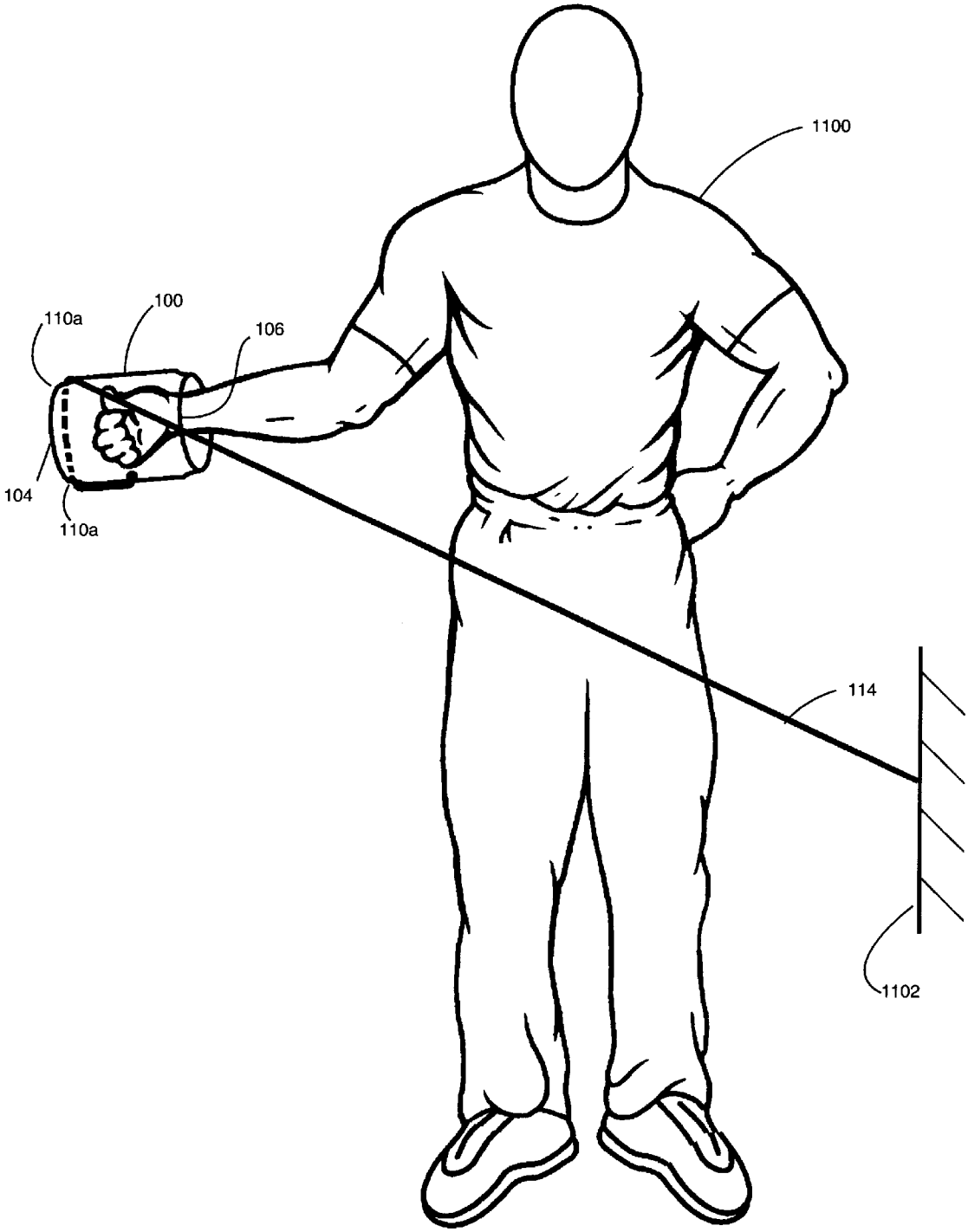
Figure 11C:
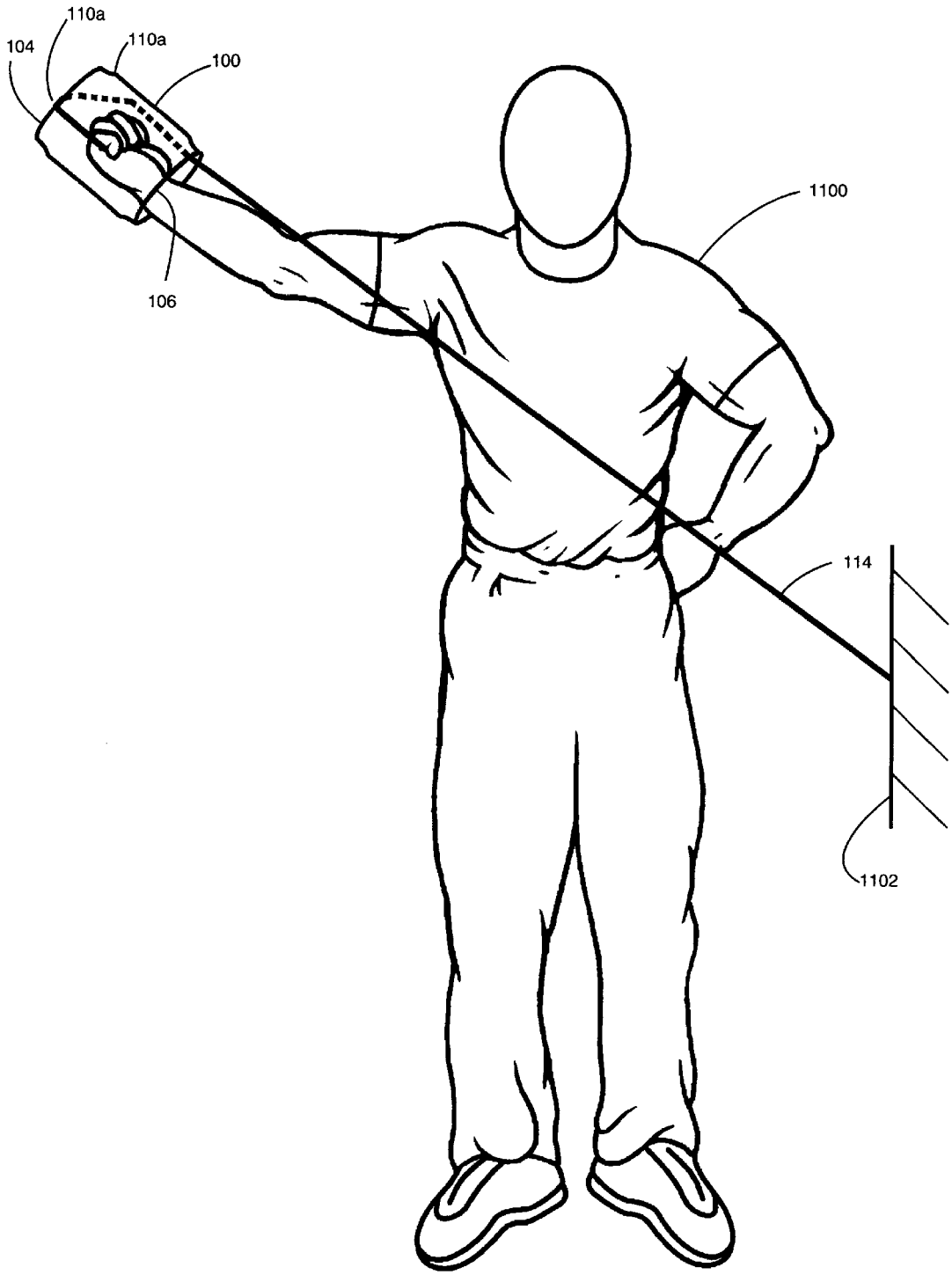

Referring now to FIGS. 10A–10C, shown is an exerciser 1100 performing a shoulder fly exercise embodying concepts of the present invention. The exerciser 1100 is grasping with his right hand a live-hand device 100 having a handle (not shown) disposed within an opening of the device 100, a distal end 104 and a proximal end 106, and a plurality of distal notches 110*a*. The first end of a flexible member 114 is attached to the device 100 and a second end of the flexible member 114 is attached to an inertial resistance, shown in FIGS. 11A–11C as a fixed point 1102. The flexible member 114 depicted in FIGS. 11A–11C is elastic. The flexible member's 114 first end is preferably attached to the device 100 at a position adjacent to the exerciser's right-hand little finger. The flexible member 114 can be elastic or inelastic, and the inertial resistance can be a fixed point 1102 or one or more weights, hydraulic resistance devices, springs, or the like. It is preferable that the fixed point 1102 is located at approximately the exerciser's 1100 floor level.

If one or more weights are used as the inertial resistance, it is preferable that they can be moved through space by the exerciser via the flexible member 114. The device 100 is positioned at a first position at which the flexible member 114 is substantially taut. It is also preferable that the exerciser 1100 marks the distance between the first position and the fixed point 1102 after he has positioned the device 100 at the first position. Marking the first position allows the exerciser 1100 to record the resistance used when the resistance is supplied by an elastic flexible member 114. Marking is especially valuable when the exerciser 1100 wants to perform an exercise with each arm in succession with substantially equal resistance through an elastic flexible member 114.

The inertial resistance is preferably located lateral to the exerciser 1100; however, any comfortable position in which the inertial resistance resists abduction of the right arm across the exerciser's 1100 torso is acceptable. The exerciser 1100 grasps the handle of the device 100 with his right palm facing substantially toward his torso and with his right arm in front of his torso such that the flexible member 114 extends from the device 100 across his torso toward the inertial resistance, as shown in FIG. 11A. The first end of the flexible member 114 can be, but need not be, attached adjacent to the handle (not shown) of the device 100. The exerciser 1100 can attach the flexible member 114 to any part of the device 100 as desired to achieve his exercise objectives. The flexible member 114 is preferably attached to the device 100 adjacent to the exerciser's right-hand little finger. FIG. 11A shows that the flexible member 114 is engaging one of the distal notches 110*a* of the device 100, which results in a variation in moment arm applied during the exercise.

Next, the exerciser 1100 abducts his right arm, externally rotates his right shoulder, and supinates his right forearm against the tensile resistance of the flexible member 114 to his substantially maximal range of motion, as shown in FIG. 11C, which may or may not be his full anatomic range of motion, depending on his degree of conditioning and skill at performing the exercise. FIG. 11B shows an intermediate phase of the exercise between the positions of FIGS. 11A and 11C. FIGS. 11B and 11C also show that the flexible member 114 is engaging two distal 110*a* notches of the device 100, resulting in additional variations in moment arm applied during the exercise. The abduction is preferably at substantially a 45 degree angle from horizontal until the exerciser's 1100 right hand is at a maximal distance from the torso of the exerciser 1100.

Next, the exerciser 1100 adducts his right arm, internally rotates his right shoulder, and pronates his right forearm in response to the tensile resistance of the flexible member 114 to his substantially maximal range of motion, as shown in FIG. 11A, which may or may not be his full anatomic range of motion, depending on his degree of conditioning and skill at performing the exercise. The step of adducting preferably includes flexion and ulnar deviation of the exerciser's 1100 right wrist, while the step of abducting preferably includes extension and radial deviation of the exerciser's 1100 right wrist.

It is preferable that the exerciser 1100 holds the substantially maximal positions for a predetermined time period of at least one second, and preferably one to two seconds, before he continues the exercise. The exerciser 1100 can repeat the abducting and adducting steps as many times as he desires.

Although FIGS. 11A–11C show the exerciser 1100 performing the straight-arm shoulder fly with his right arm, it will be obvious that the exercise can be performed with either arm as desired by the exerciser 1100.

Figure 11D:
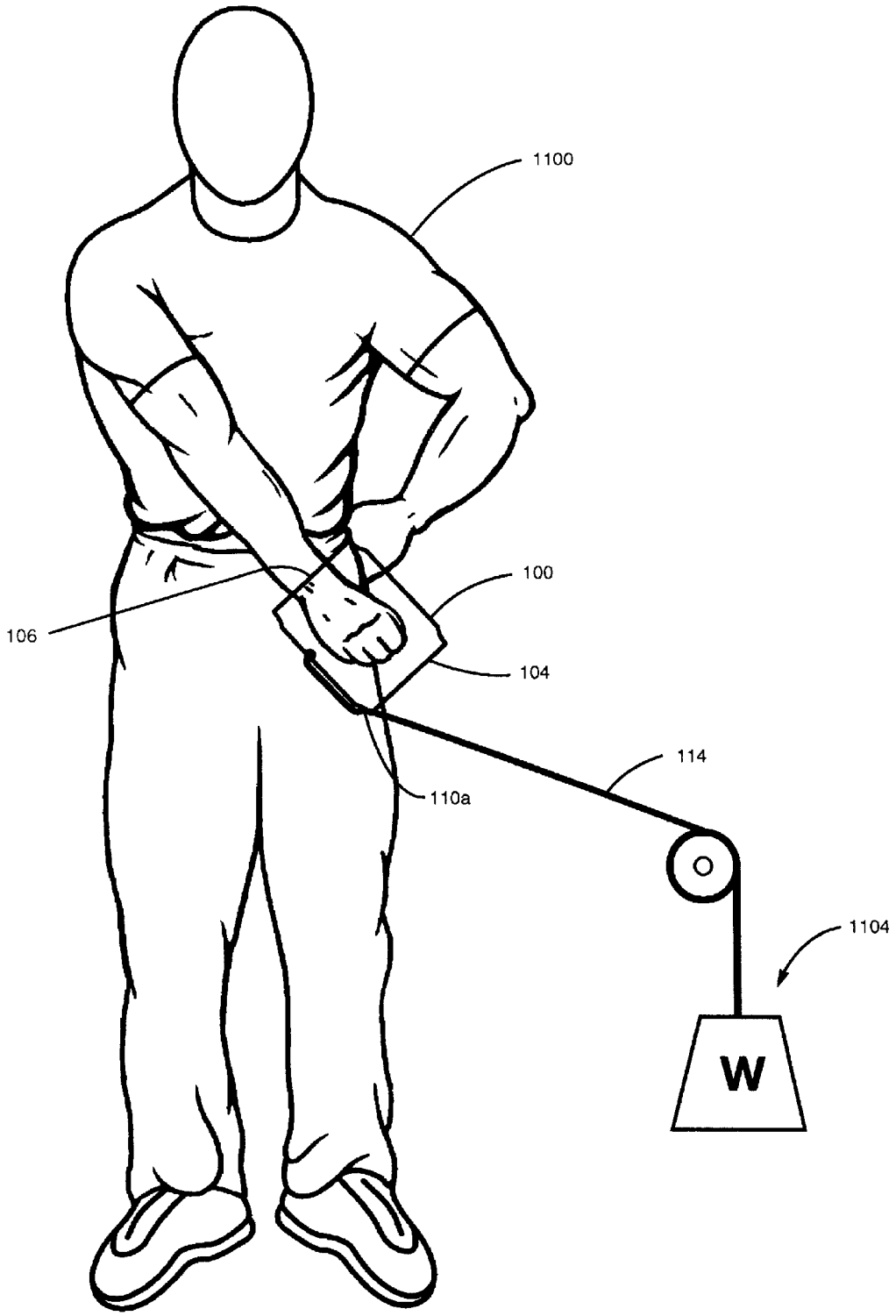
Figure 11E:
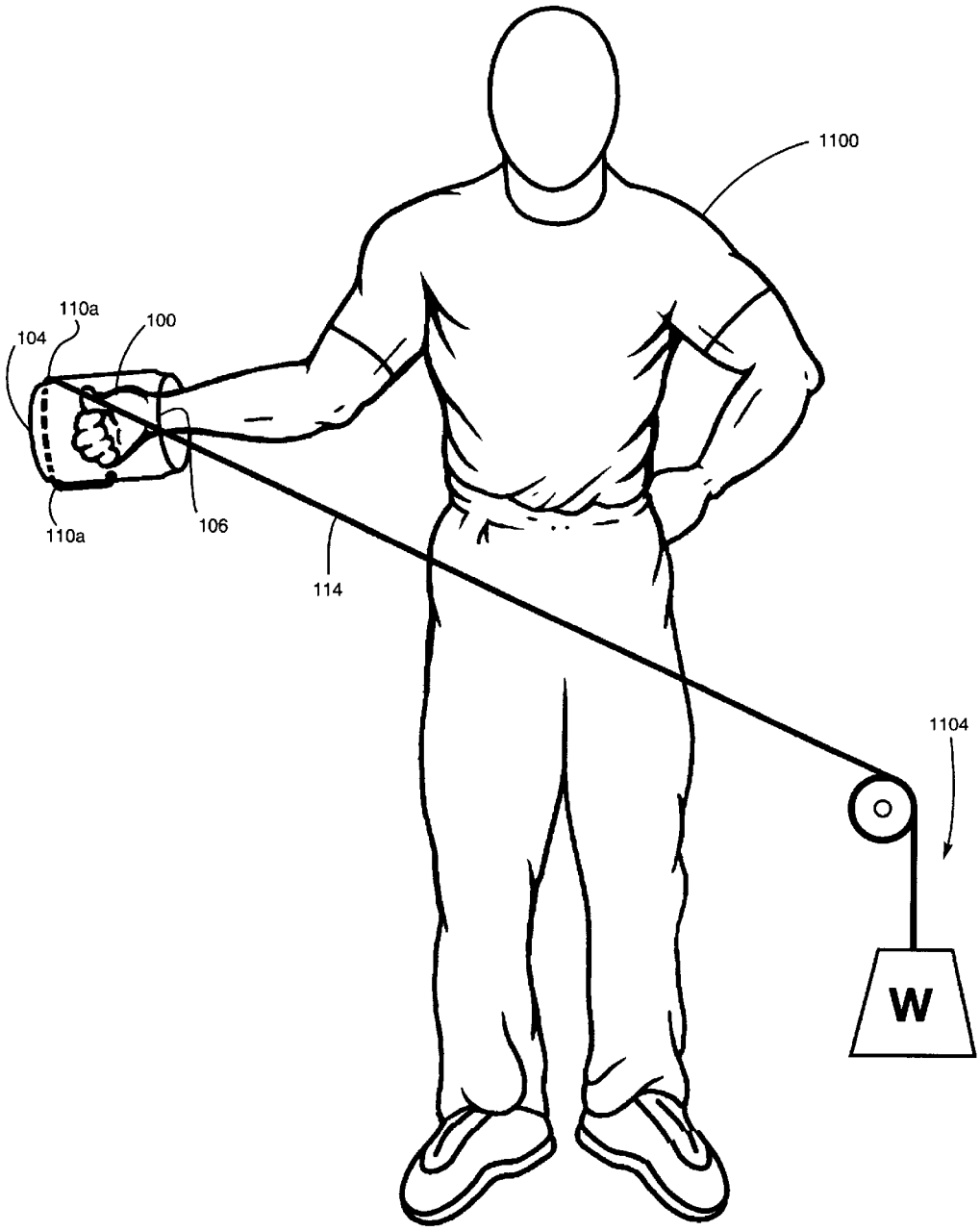
Figure 11F:
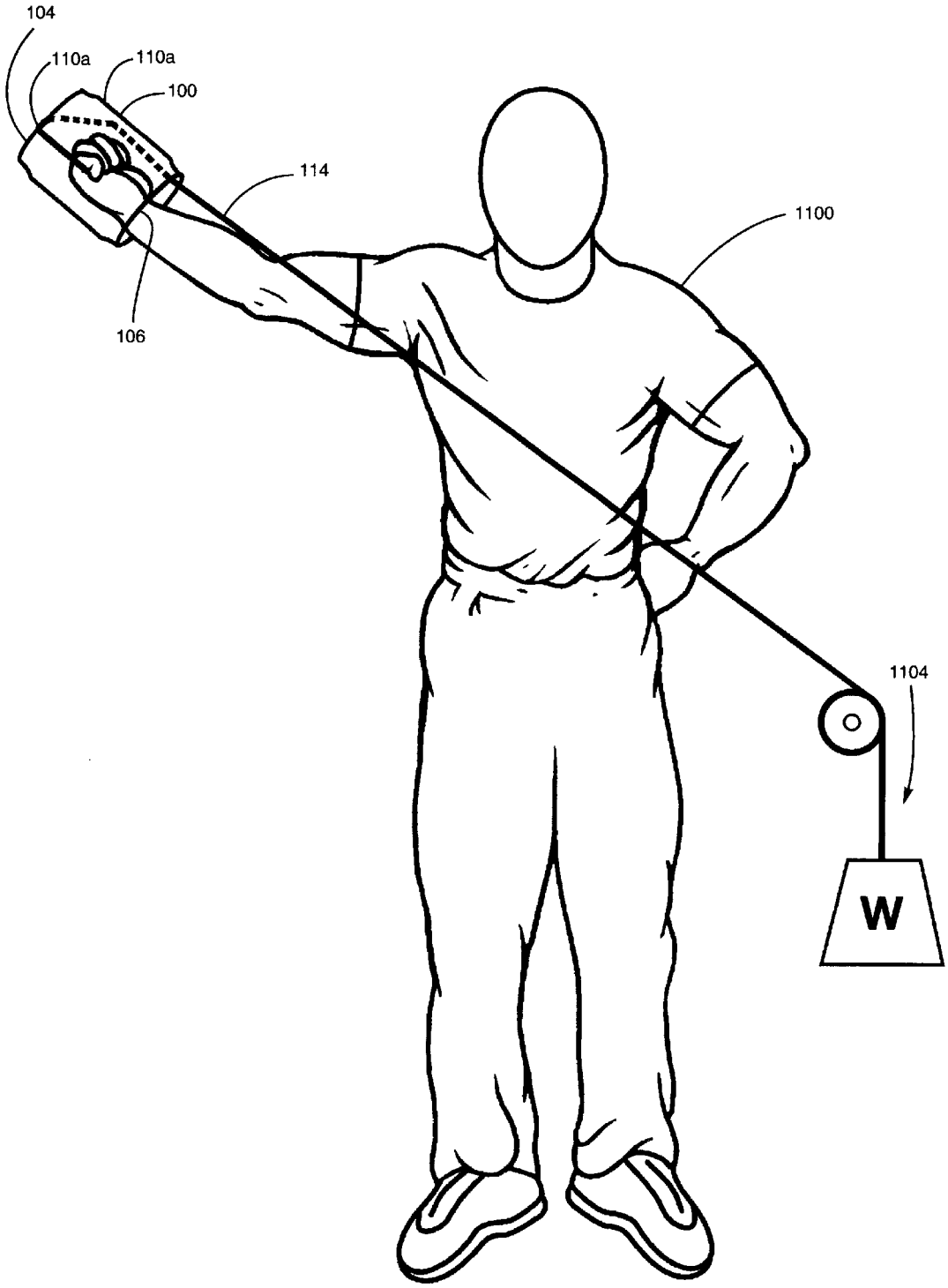

FIGS. 11D–11F are identical to FIGS. 11A–11C, except that the inertial resistance is a moveable inertial resistance, depicted in FIGS. 11D–11F as a weight 1104 and the flexible member 114 is inelastic.

Figure 12A:
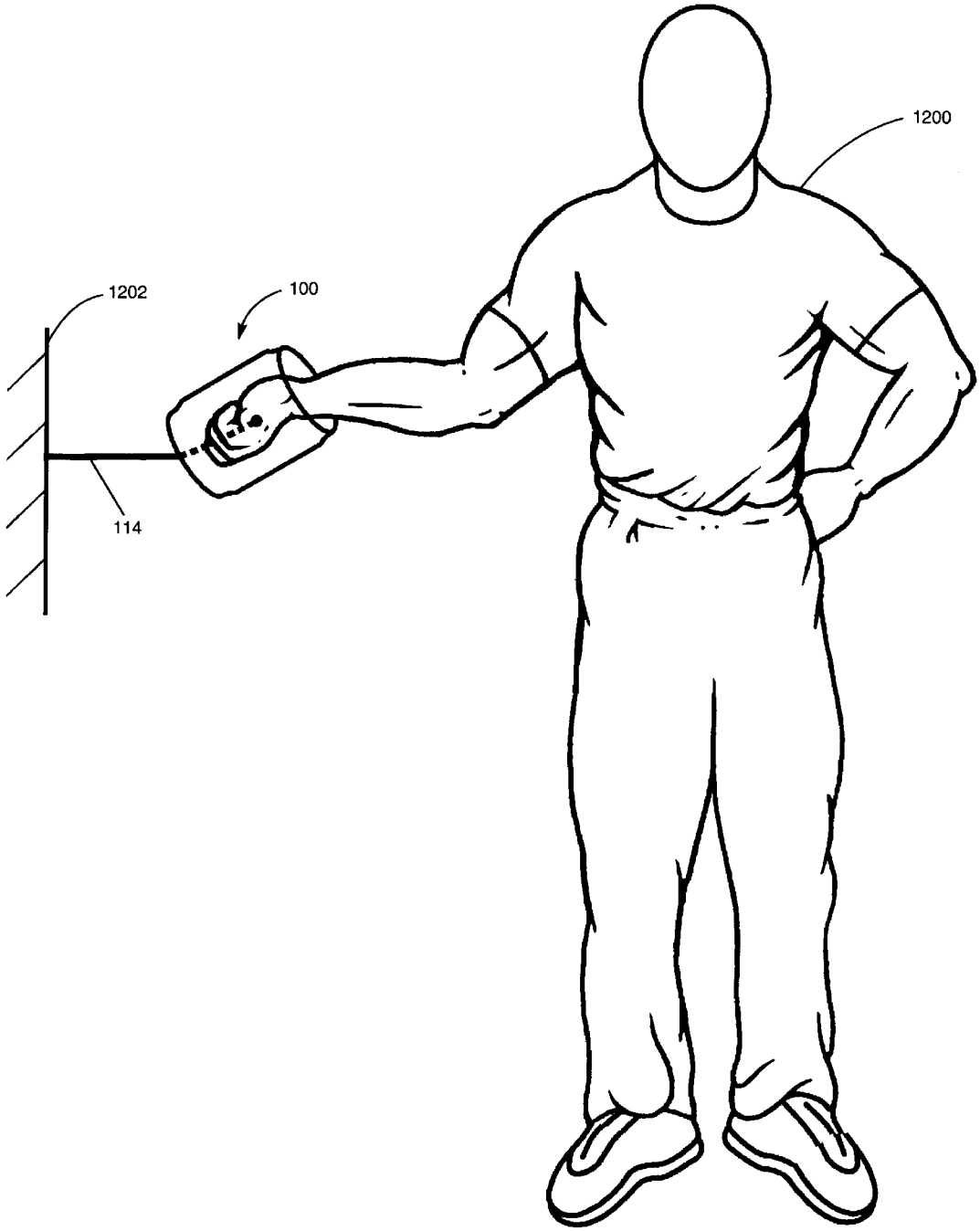
FIGS. 12A–12F are illustrations of an exerciser at various phases of performing a bent-arm internal shoulder rotation exercise in accordance with the teachings of the present invention.
Figure 12B:
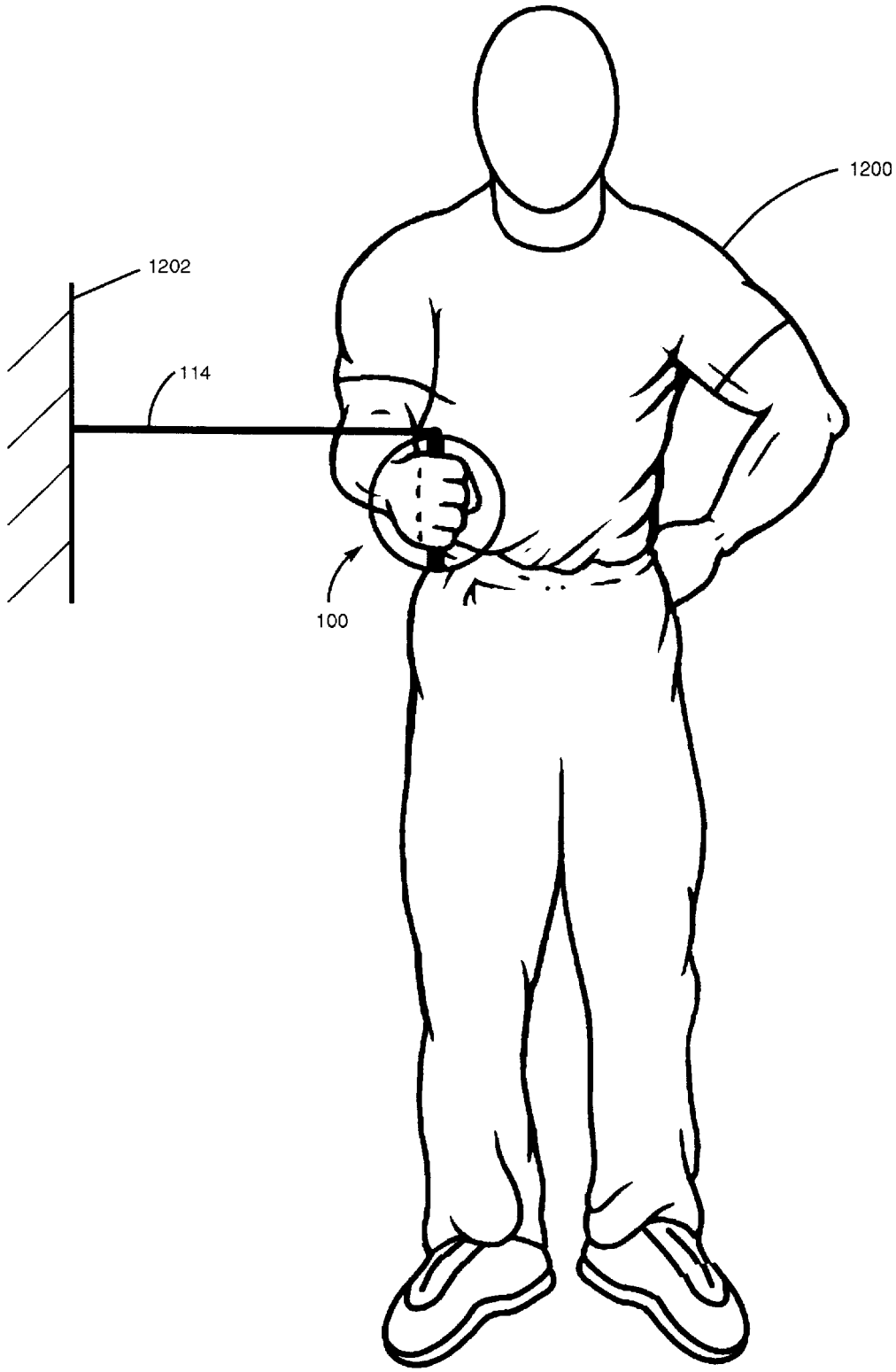
Figure 12C:
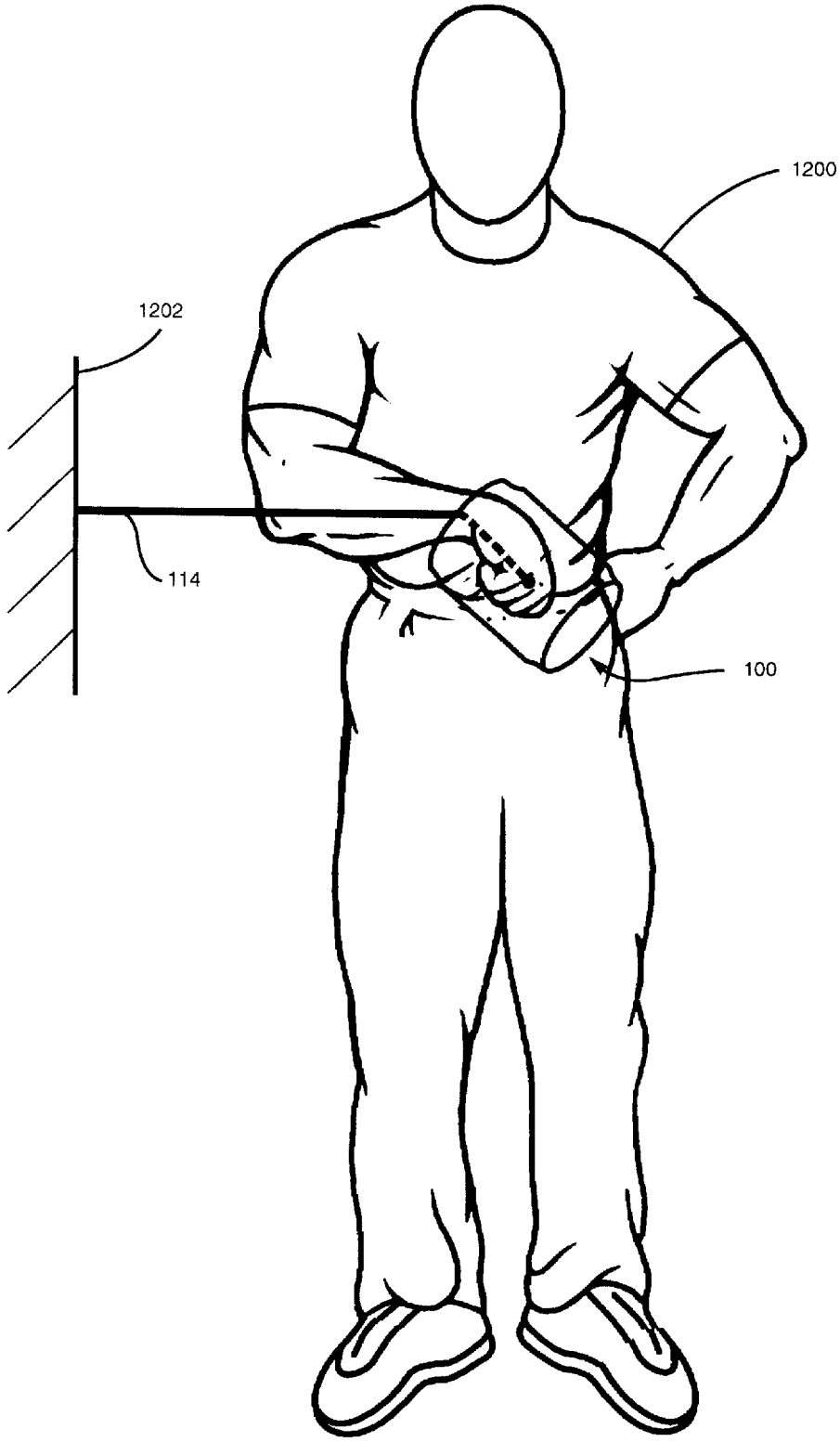

Referring now to FIGS. 12A–12C, shown is an exerciser 1200 performing an internal shoulder rotation exercise embodying concepts of the present invention. The exerciser 1200 is grasping with his right hand a live-hand device 100 having a handle (not shown) disposed within an opening of the device 100 as well as with more than one distal notches 110*a* and proximal notches 110. The first end of a flexible member 114 is attached to the device 100 and a second end of the flexible member 114 is attached to an inertial resistance, depicted in FIGS. 12A–12C as a fixed point 1202. The flexible member 114 depicted in FIGS. 12A–12C is elastic. The flexible member 114 can be elastic or inelastic, and the inertial resistance can be a fixed point 1202 or one or more weights, hydraulic resistance devices, springs, or the like. It is preferable that, if inertial resistance is a fixed point 1202, the fixed point 1202 is located at approximately the exerciser's waist level. If one or more weights are used as the inertial resistance, it is preferable that they can be moved through space by the exerciser via the flexible member 114.

The device 100 is positioned at a first position at which the flexible member 114 is substantially taut. It is also preferable that the exerciser 1200 marks the distance between the first position and the fixed point 1202 after he has positioned the device 100 at the first position. Marking the first position allows the exerciser 1200 to record the resistance used when the resistance is supplied by an elastic flexible member 114. Marking is especially valuable when the exerciser wants to perform an exercise with each arm in succession with substantially equal resistance through an elastic flexible member 114.

The exerciser's 1200 right hand is preferably closer to the inertial resistance than his left hand and the inertial resistance is preferably located lateral to the exerciser; however, any comfortable position in which the inertial resistance resists internal rotation of the right shoulder joint across the exerciser's 1200 torso is acceptable.

The exerciser 1200 grasps the handle of the device 100 with his right palm facing substantially upward and with his right forearm substantially extended laterally, as shown in FIG. 12A. The step of grasping preferably includes the right forearm being supinated and the right wrist being radially deviated and substantially extended, as also shown in FIG. 12A.

The flexible member 114 preferably exits the device 100 adjacent the exerciser's 1200 right-hand thumb. The first end of the flexible member 114 can be, but need not be, attached adjacent to the handle of the device 100. The exerciser 1200 can attach the flexible member 114 to any part of the device 100 as desired to achieve his exercise objectives.

Next, the exerciser 1200 internally rotates his right shoulder against the inertial resistance via the flexible member 114 and pronates his right forearm until the right forearm is pointed substantially forward and the forearm is in a semi-pronated position, as shown in FIG. 12B. Next, the exerciser 1200 further internally rotates his right shoulder and pronates his right forearm against the inertial resistance until the right forearm is against the exerciser's 1200 torso and the forearm is pronated to the exerciser's 1200 substantially maximal pronation range of motion, as shown in FIG. 12C, which may or may not be his full anatomic range of motion, depending on his degree of conditioning and skill at performing the exercise.

Next, the exerciser 1200 externally rotates his right shoulder and supinates his right forearm toward the inertial resistance via the flexible member 114 until his right forearm is pointed substantially forward and the right forearm is in a semi-pronated position, as shown in FIG. 12B. Next, the exerciser 1200 externally rotates his right shoulder further and supinates the right forearm toward the inertial resistance via the flexible member 114 until the palm of the right hand is facing substantially upward and the right forearm is substantially extended laterally from the exerciser, as shown in FIG. 12A.

The step of internally rotating preferably includes flexion and ulnar deviation of the exerciser's 1200 right wrist (see FIG. 12C), while the step of externally rotating preferably includes extension and radial deviation of the exerciser's 1200 right wrist (see FIG. 12A). As shown in FIG. 12C, the flexion and ulnar deviation cause a proximal notch 110 to be engaged by the flexible member 114, which results in a variation of the moment arm applied during the exercise. Moreover, the extension and radial deviation of the right wrist cause a distal notch 110*a* to be engaged by the flexible member 114 (see FIG. 12A), which also results in a variation of the moment arm applied during the exercise. It is preferable that the exerciser 1200 holds each substantially maximal position for a pre-determined time period of at least one second, and preferably between one and two seconds, before he continues the exercise. The exerciser 1200 can repeat the internal and external rotation steps as many times as he desires.

Although FIGS. 12A–12C show the exerciser performing the bent-arm internal shoulder rotation exercise with his right arm, it will be obvious that the exercise can be performed with either arm as desired by the exerciser.

Figure 12D:
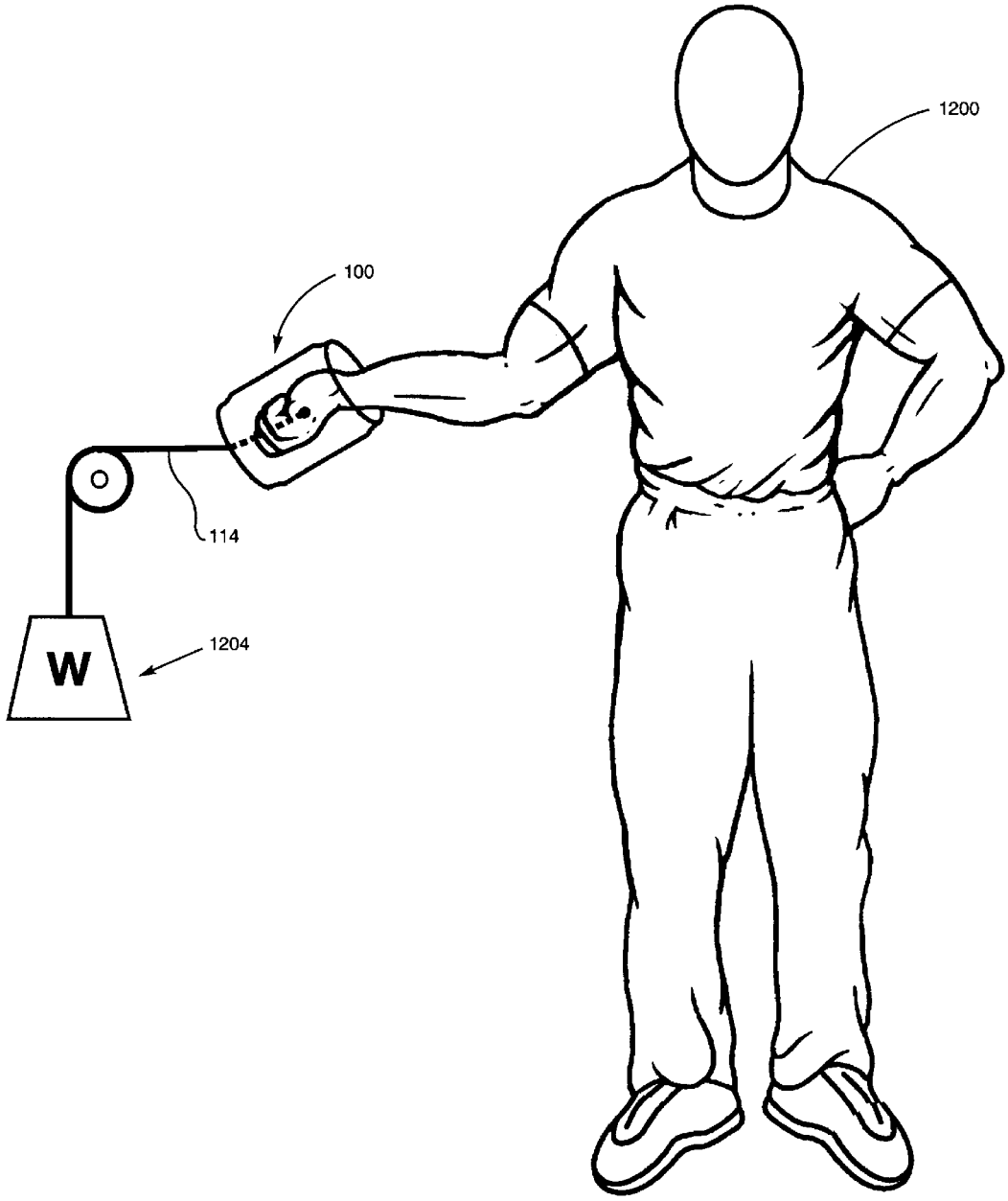
Figure 12E:
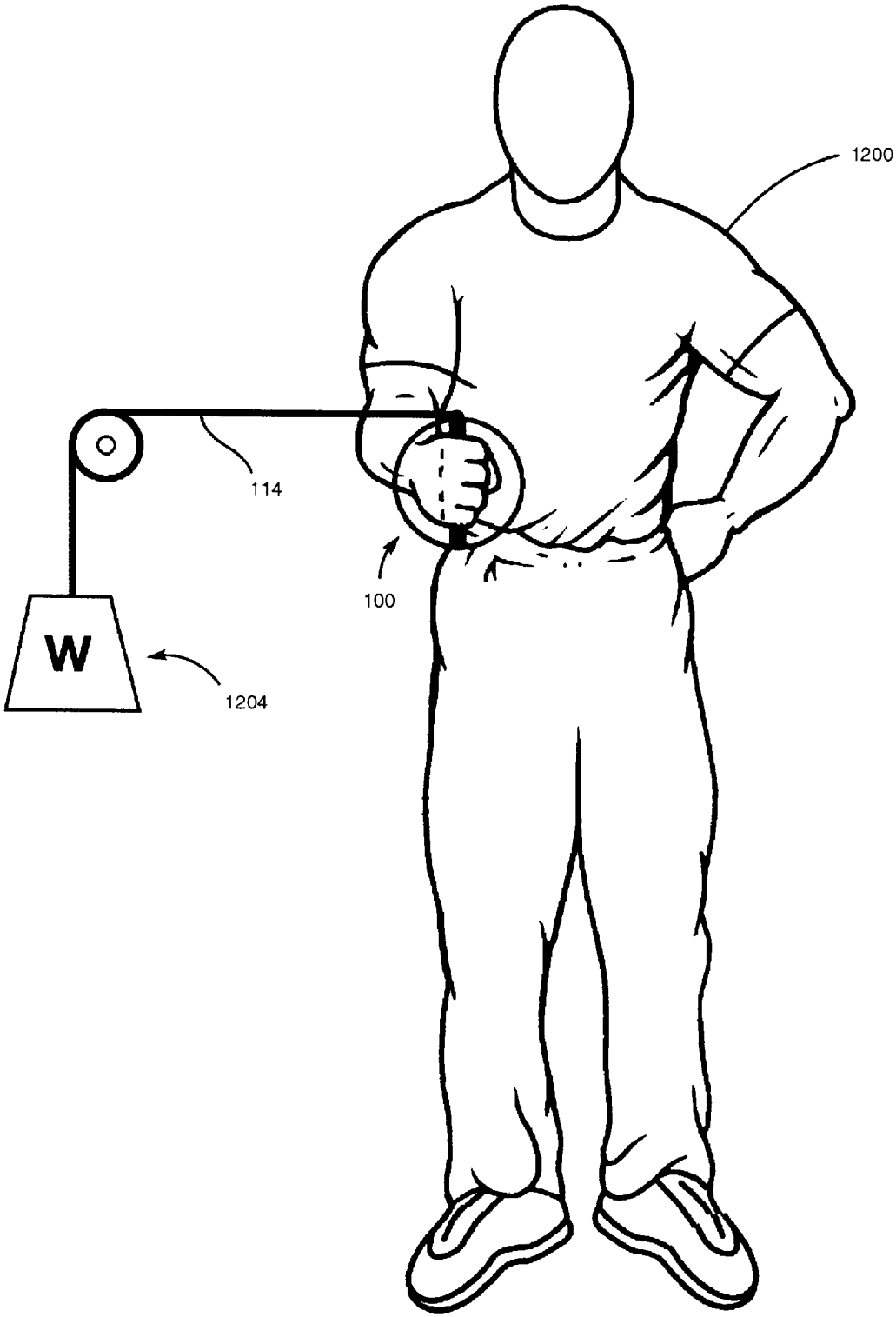
Figure 12F:
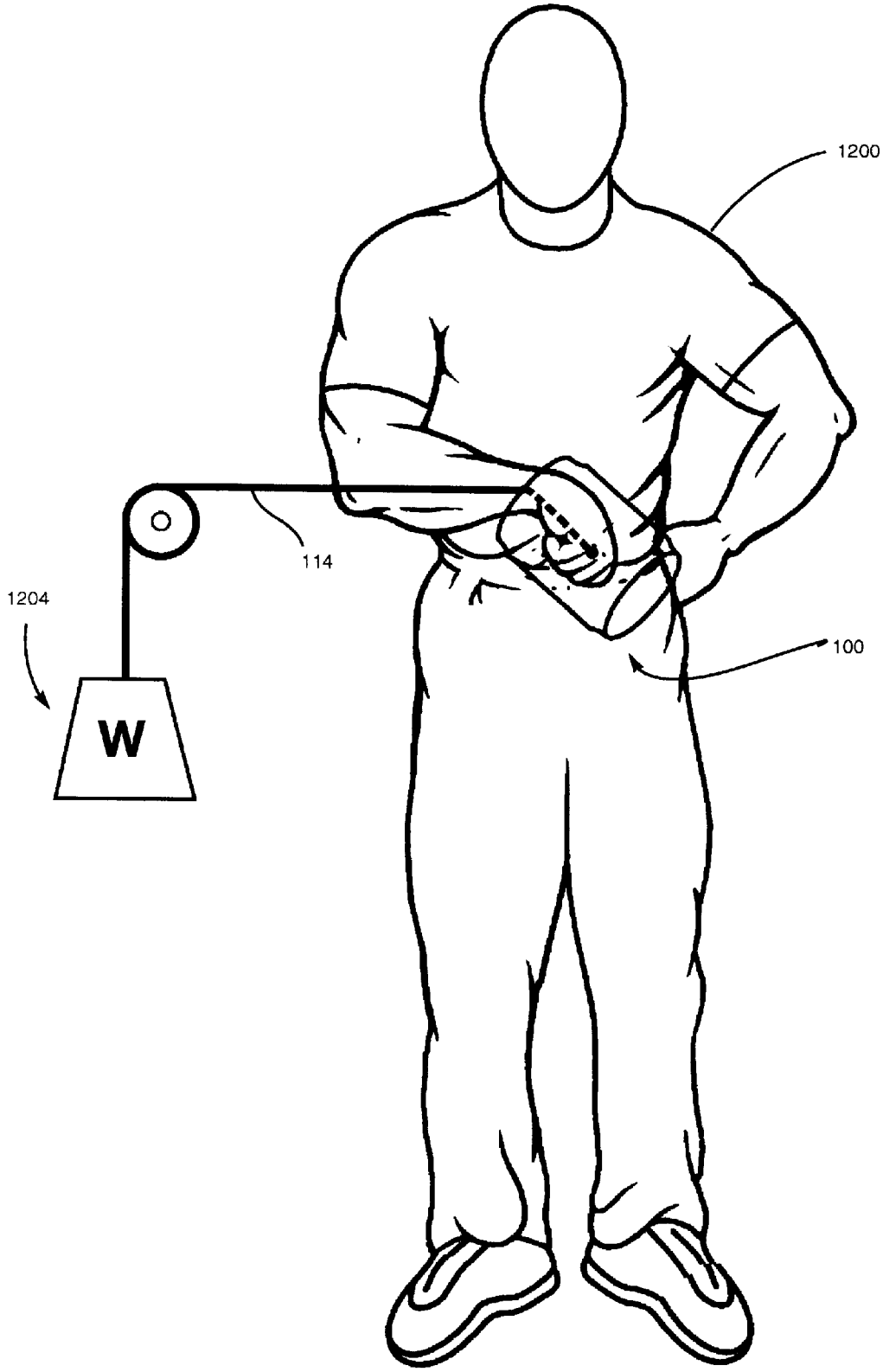

FIGS. 12D–12F are identical to FIGS. 12A–12C, except that the inertial resistance is a moveable inertial resistance, depicted in FIGS. 12*d*–12*f* as a weight 1204, and the flexible member 114 is inelastic.

Figure 13A:
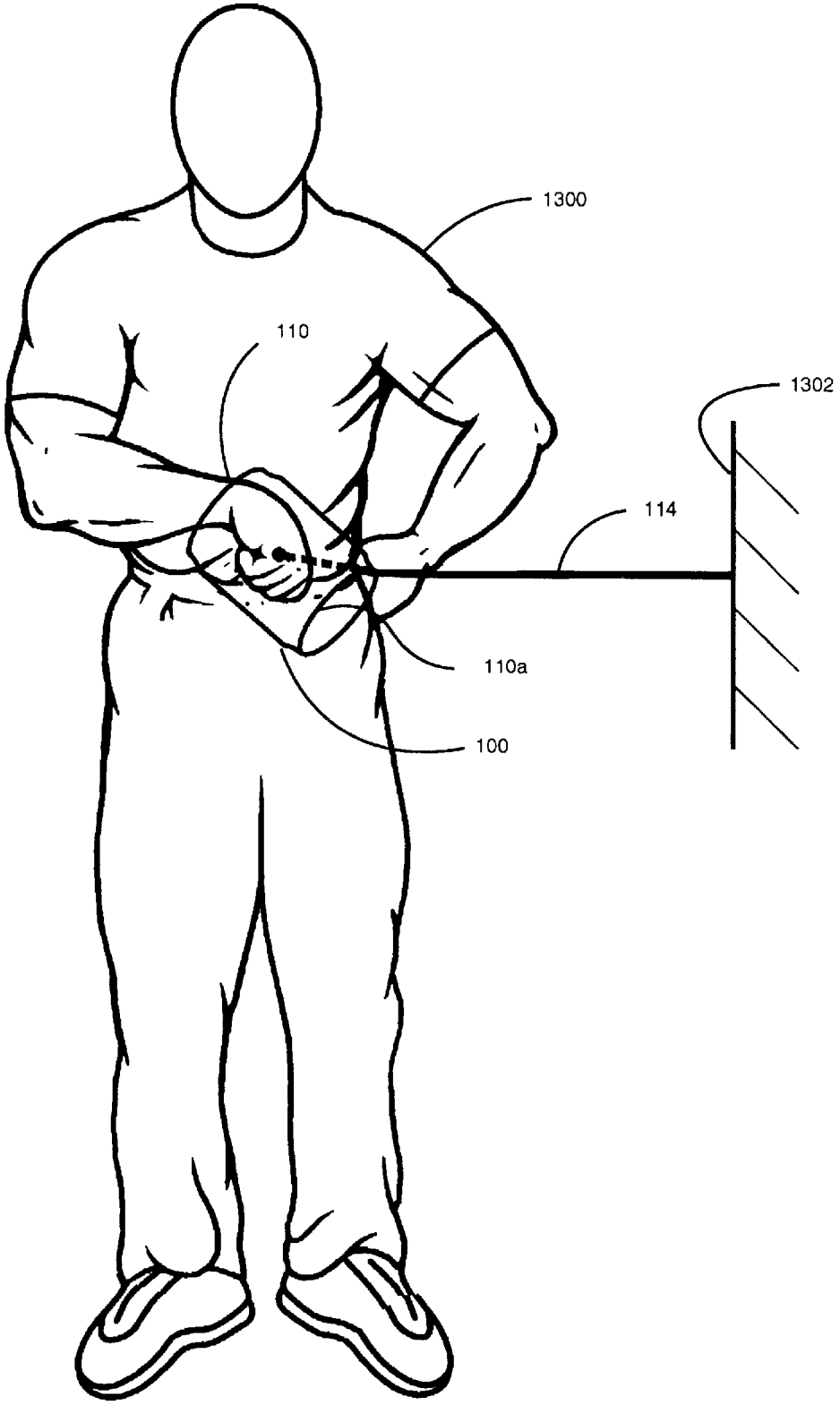
FIGS. 13A–13F are illustrations of an exerciser at various phases of performing a bent-arm external shoulder rotation exercise in accordance with the teachings of the present invention.
Figure 13B:
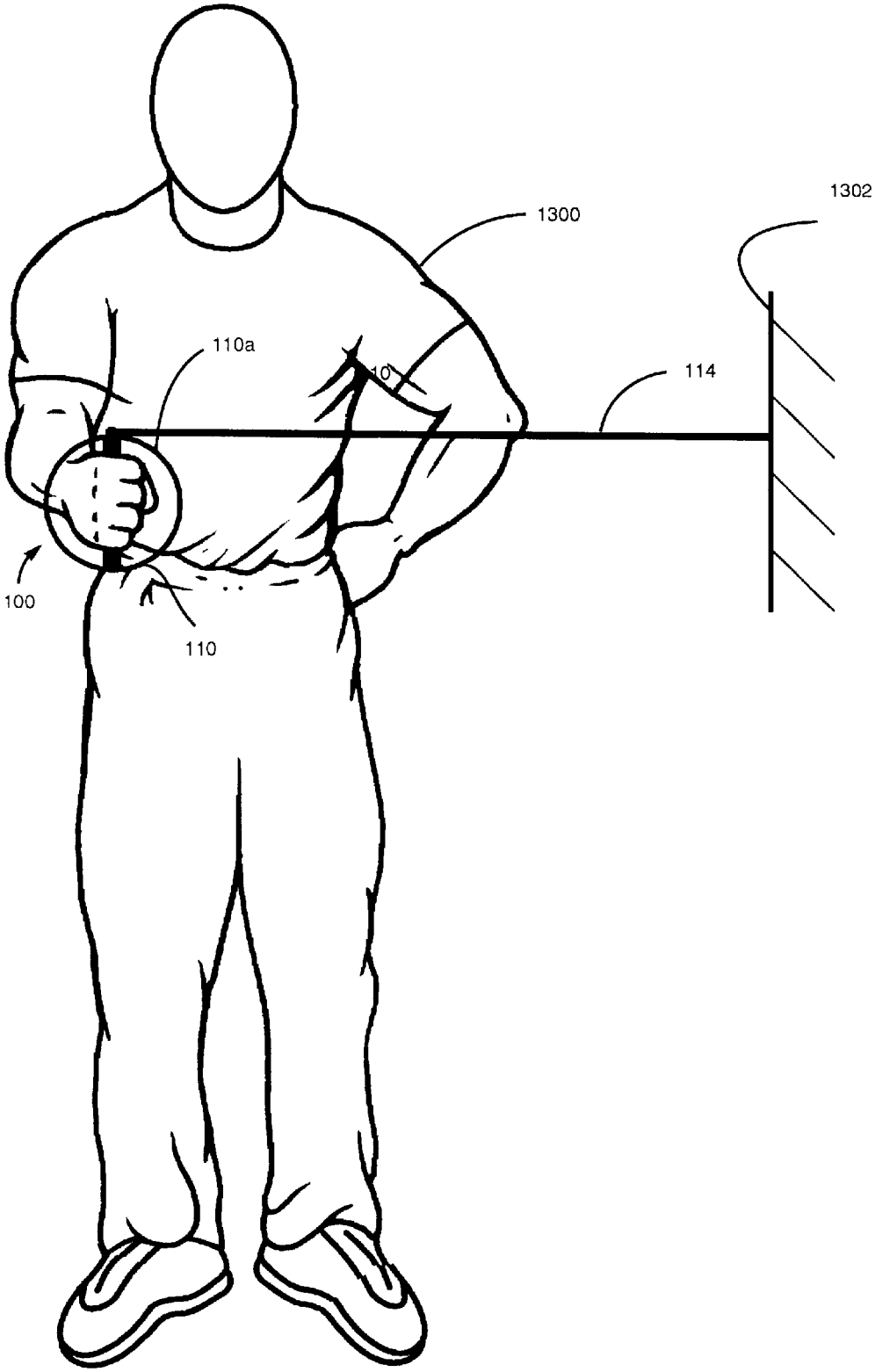
Figure 13C:
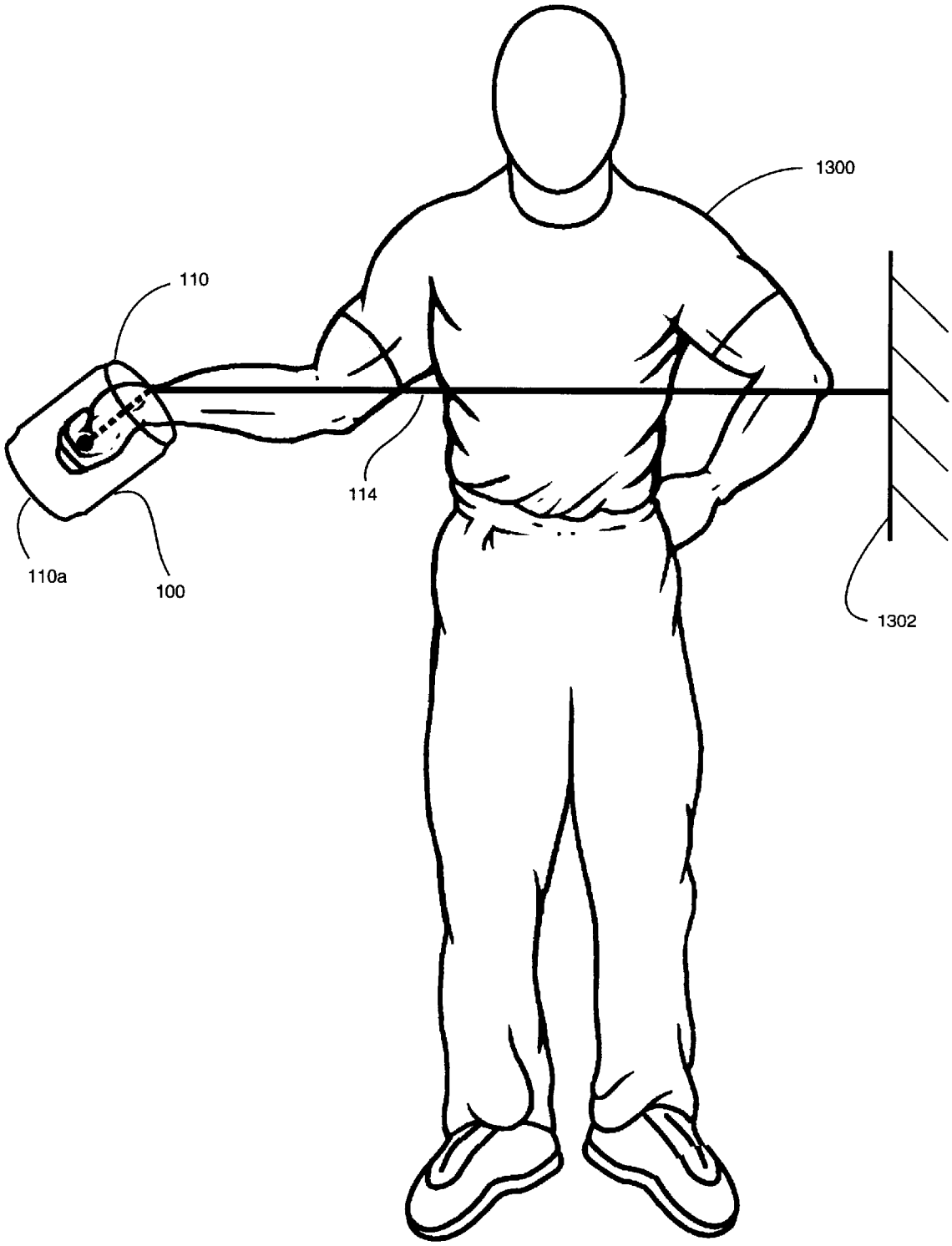

Referring now to FIGS. 13A–13C, shown is an exerciser 1300 performing an external shoulder rotation exercise embodying concepts of the present invention. The exerciser 1300 is grasping with his right hand a live-hand device 100 having a handle (not shown) disposed within an opening of the device 100 as well as more than one distal notches 110*a* and proximal notches 110. The first end of a flexible member 114 is attached to the device 100 and a second end of the flexible member 114 is attached to an inertial resistance, depicted in FIGS. 13A–13C as a fixed point 1302. The flexible member 114 shown in FIGS. 13A–13C is elastic. The flexible member 114 can be elastic or inelastic, and the inertial resistance can be a fixed point 1302 or one or more weights, hydraulic resistance devices, springs, or the like. It is preferable that, if the inertial resistance is a fixed point 1302, the fixed point 1302 is located at approximately the exerciser's waist level.

If one or more weights are used as the inertial resistance, it is preferable that they can be moved through space by the exerciser via the flexible member 114. The device 100 is positioned at a first position at which the flexible member 114 is substantially taut and the flexible member 114 extends substantially laterally away from the exerciser 1300. It is also preferable that the exerciser 1300 marks the distance between the first position and the fixed point 1302 after he has positioned the device 100 at the first position. Marking the first position allows the exerciser 1300 to record the resistance used when the resistance is supplied by an elastic flexible member 114. Marking is especially valuable when the exerciser 1300 wants to perform an exercise with each arm in succession with substantially equal resistance through an elastic flexible member 114.

The inertial resistance is preferably located lateral to the exerciser; however, any comfortable position in which the inertial resistance resists external rotation of the right shoulder across the exerciser's 1300 torso is acceptable.

The exerciser 1300 grasps the handle of the device 100 with his right palm facing substantially downward, with his right upper arm against his side, and with his right forearm substantially horizontal and adjacent to his abdomen with the flexible member 114 between the device 100 and the exerciser's 1300 abdomen, as shown in FIG. 13A. The step of grasping preferably includes the right forearm being in a fully pronated position and the right wrist being ulnarly deviated and flexed, as also shown in FIG. 13A. The flexible member 114 preferably exits the device 100 adjacent the exerciser's 1300 right-hand thumb. The first end of the flexible member 114 can be, but need not be, attached adjacent to the handle of the device 100. The exerciser 1300 can attach the flexible member 114 to any part of the device 100 as desired to achieve his exercise objectives.

Next, the exerciser 1300 externally rotates his right shoulder against the inertial resistance via the flexible member 114 and supinates his right forearm until the right forearm is pointed substantially forward and the forearm is in a semi-pronated position, as shown in FIG. 13B. Next, the exerciser 1300 further externally rotates his right shoulder and supinates his right forearm against the inertial resistance until his right forearm is substantially extended substantially laterally away from the inertial resistance and is supinated to the exerciser's 1300 substantially maximal range of motion, as shown in FIG. 13C, which may or may not be his full anatomic range of motion, depending on his degree of conditioning and his skill at performing the exercise.

Next, the exerciser 1300 internally rotates his right shoulder and pronates his right forearm toward the inertial resistance via the flexible member 114 until his right forearm is pointed substantially forward and the right forearm is in a semi-supinated position, as shown in FIG. 13B. Next, the exerciser 1300 internally rotates his right shoulder further and pronates his right forearm toward the inertial resistance via the flexible member 114 until the palm of the right hand is facing substantially downward and the right forearm is substantially extended substantially horizontally across the exerciser's abdomen, as shown in FIG. 13A.

The step of internally rotating preferably includes flexion and ulnar deviation of the exerciser's 1300 right wrist (see FIG. 13A), while the step of externally rotating preferably includes extension and radial deviation of the exerciser's 1300 right wrist (see FIG. 13C). As shown in FIG. 13A, the flexion and radial deviation cause a distal notch 110*a* to be engaged by the flexible member 114, which results in a variation of the moment arm applied during the exercise. Moreover, the extension and radial deviation of the right wrist (see FIG. 13C) cause a proximal notch 110 to be engaged by the flexible member 114, which results in a variation of the moment arm applied during the exercise. It is preferable that the exerciser 1300 holds each substantially maximal position for a pre-determined time period of at least one second, and preferably between one and two seconds, before he continues the exercise. The exerciser 1300 can repeat the external and internal rotation steps as many times as he desires.

Although FIGS. 13A–13C show the exerciser 1300 performing the bent-arm shoulder external rotation exercise with his right arm, it will be obvious that the exercise can be performed with either arm as desired by the exerciser 1300.

Figure 13D:
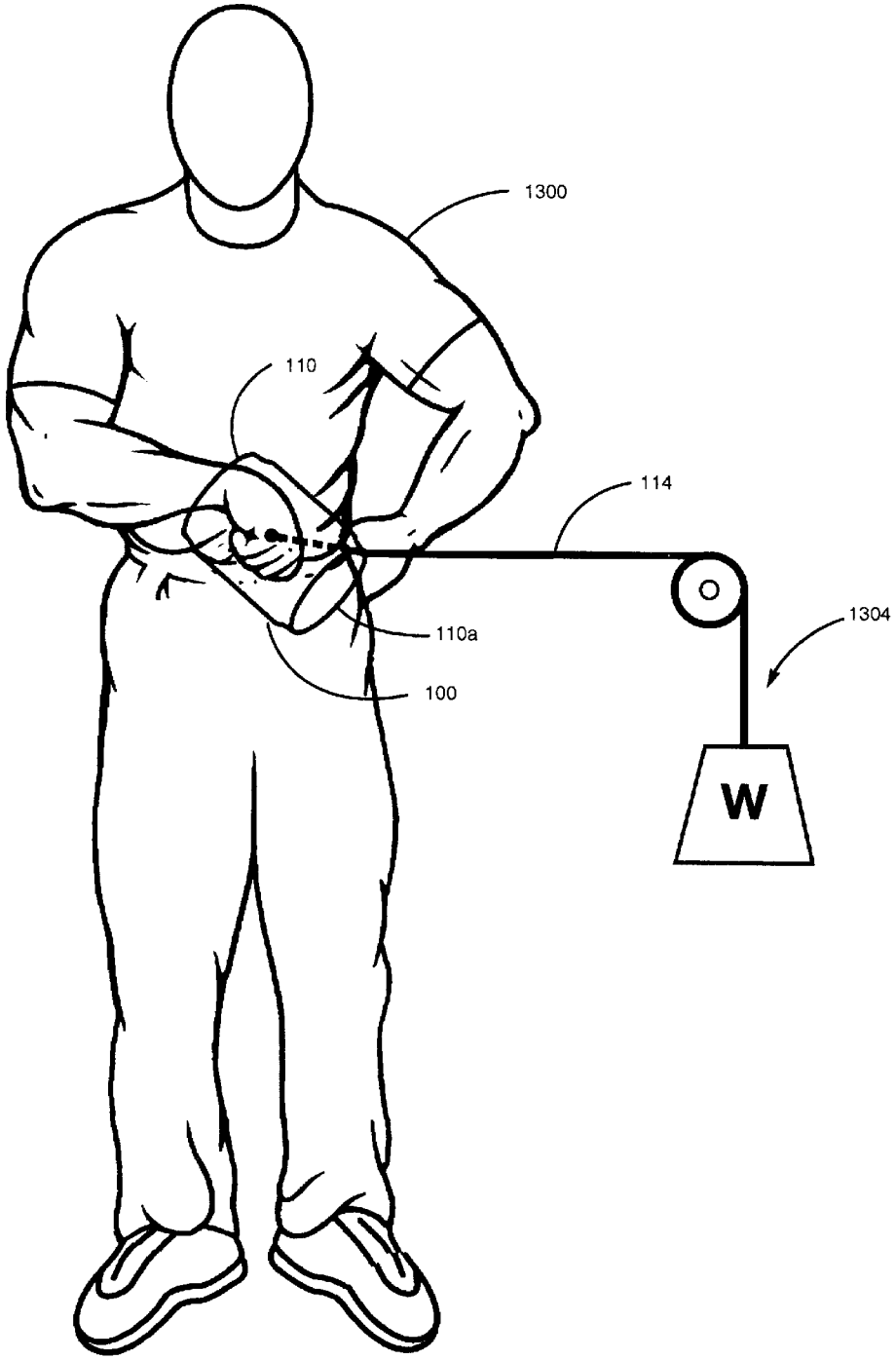
Figure 13E:
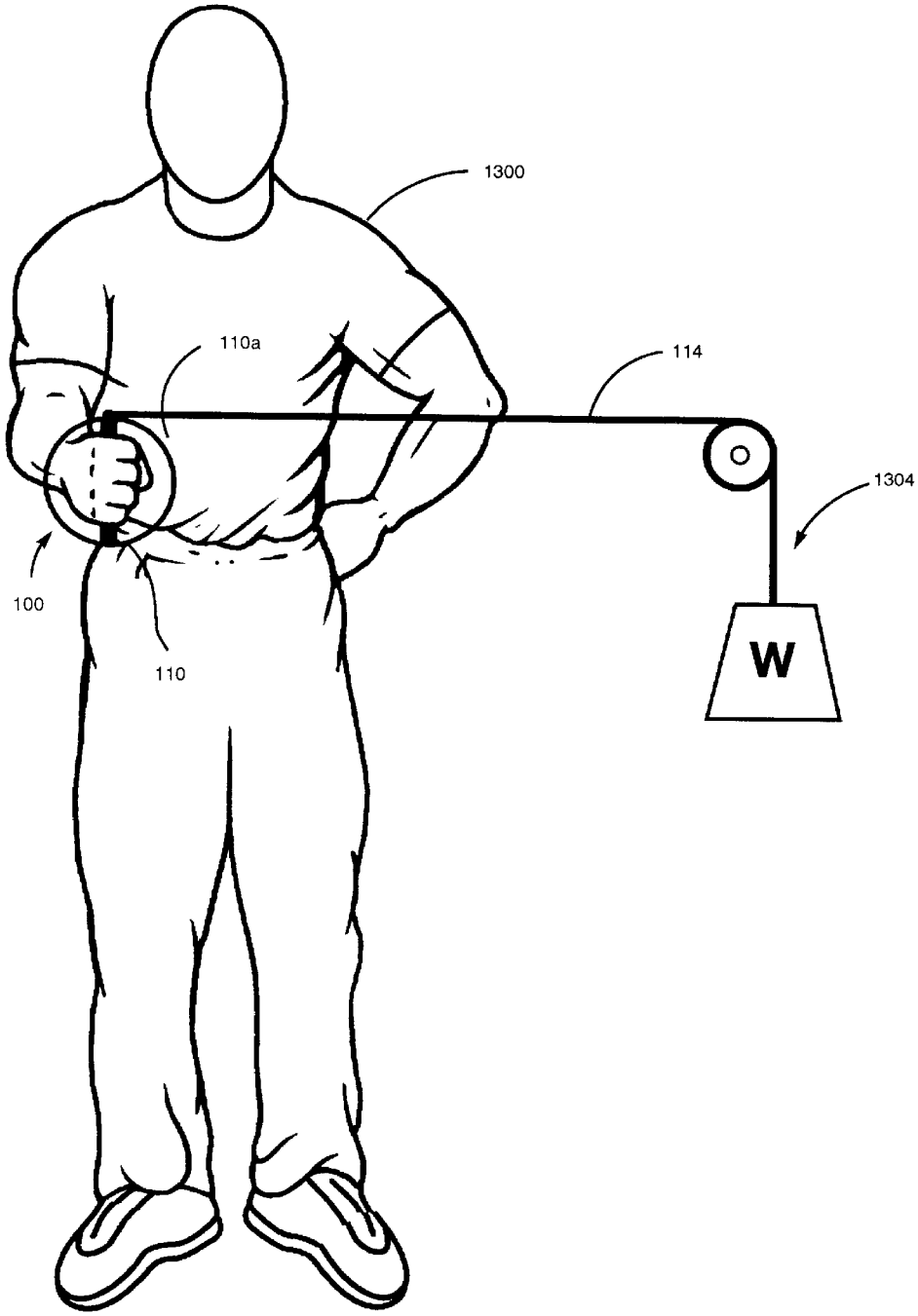
Figure 13F:
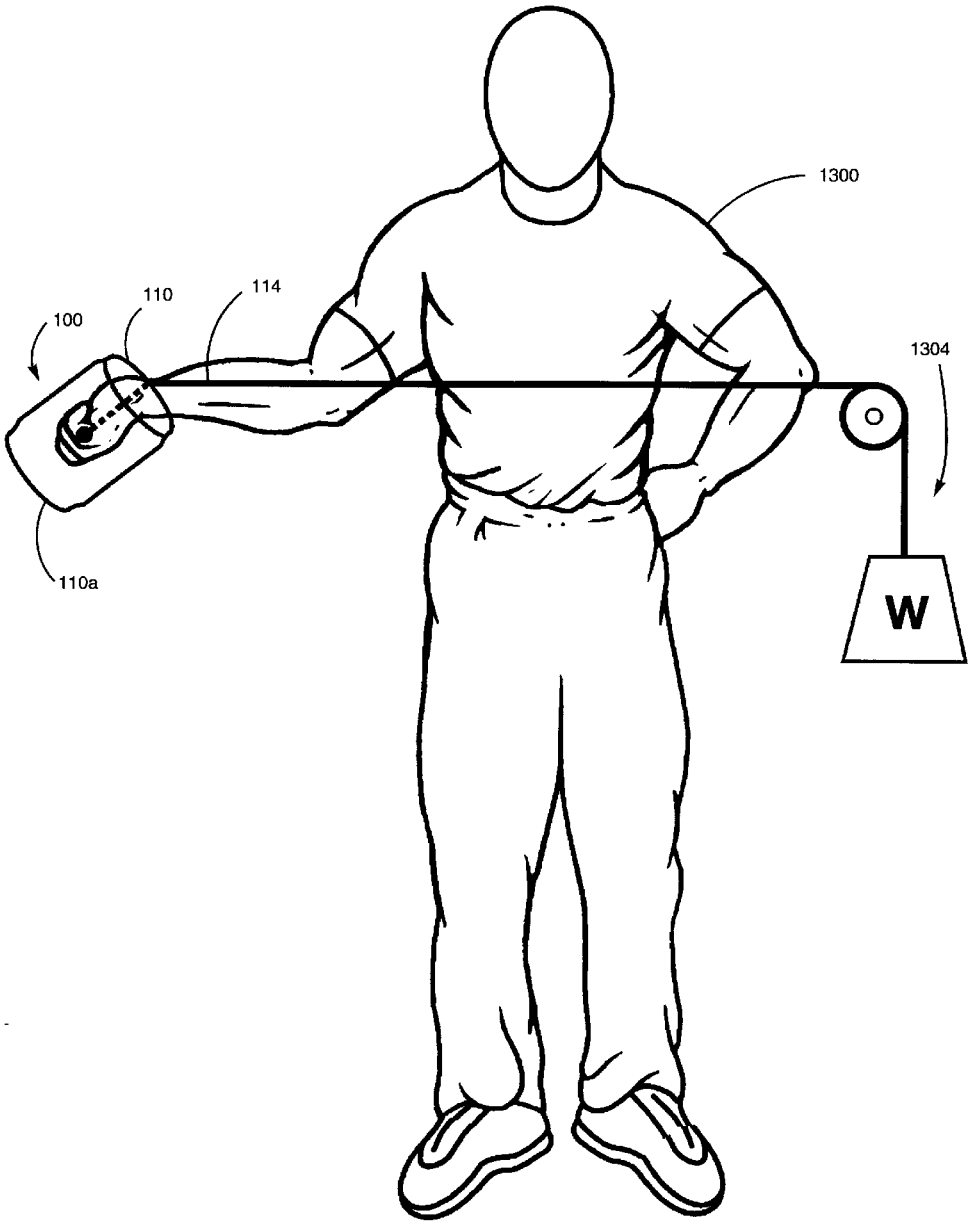

FIGS. 13D–13F are identical to FIGS. 13A–13C, except that the inertial resistance is a moveable inertial resistance, depicted in FIGS. 13D–13F as a weight 1304, and the flexible member is inelastic.

Figure 14A:
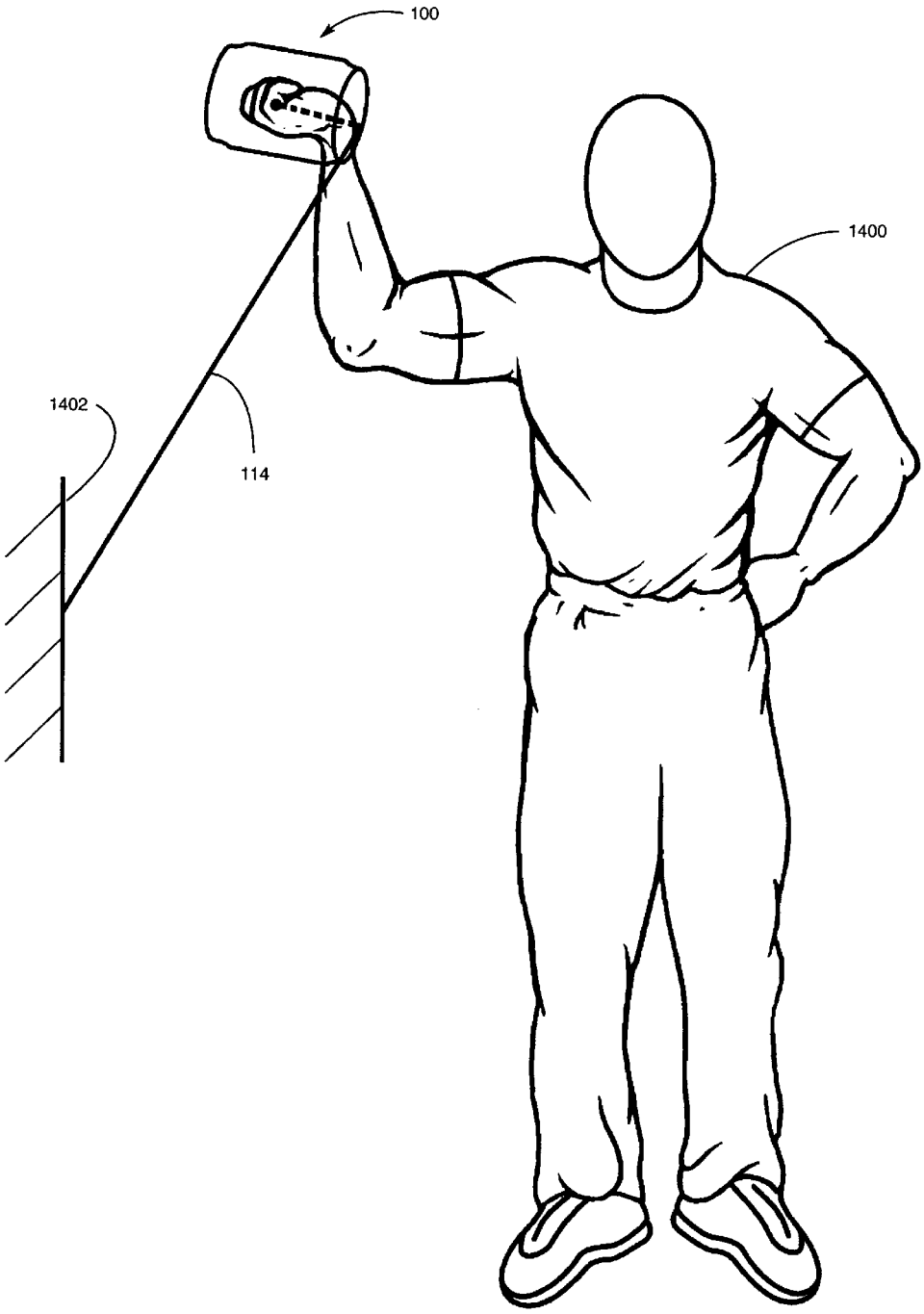
FIGS. 14A–14D are illustrations of an exerciser at various phases of performing an elevated bent-arm external shoulder rotation exercise in accordance with the teachings of the present invention.
Figure 14B:
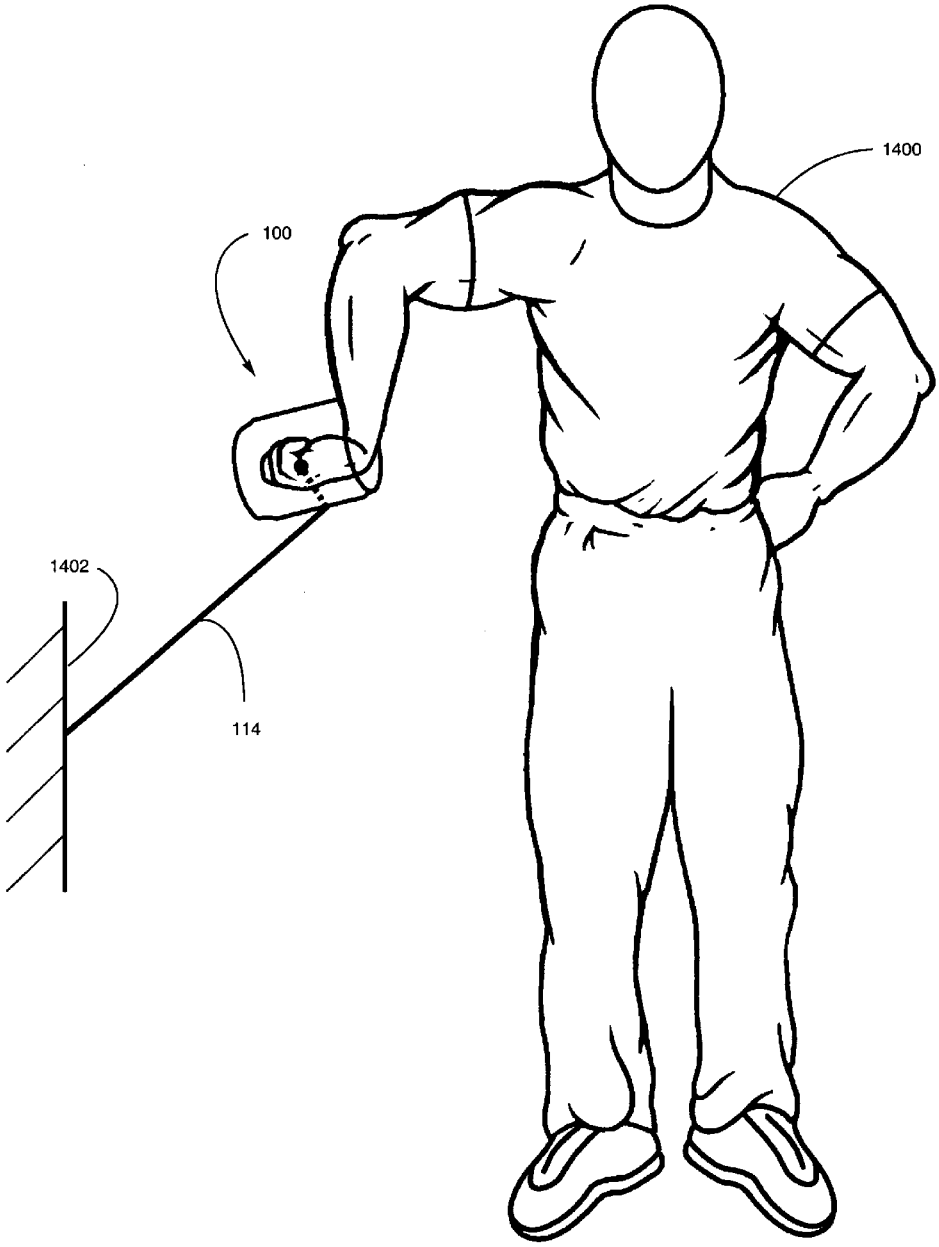

Referring now to FIGS. 14A–14B, shown is an exerciser 1400 performing an external shoulder rotation exercise embodying concepts of the present invention. The exerciser 1400 is grasping with his right hand a live-hand device 100 having a handle (not shown) disposed within an opening of the device 100. The first end of a flexible member 114 is attached to the device 100 and a second end of the flexible member 114 is attached to an inertial resistance, depicted in FIGS. 14A–14B as a fixed point 1402. The flexible member 114 depicted in FIGS. 14A–14B is elastic. The flexible member 114 can be elastic or inelastic, and the inertial resistance can be a fixed point 1402 or one or more weights, hydraulic resistance devices, springs, or the like. It is preferable that the fixed point 1402 is located at approximately the exerciser's waist level.

If one or more weights are used as the inertial resistance, it is preferable that they can be moved through space by the exerciser via the flexible member 114. The device 100 is positioned at a first position at which the flexible member 114 is substantially taut and at which the flexible member 114 extends anteriorly away from the exerciser 1400 toward the inertial resistance. It is also preferable that the exerciser 1400 marks the distance between the first position and the fixed point after he has positioned the device 100 at the first position. Marking the first position allows the exerciser 1400 to record the resistance used when the resistance is supplied by an elastic flexible member 114. Marking is especially valuable when the exerciser 1400 wants to perform an exercise with each arm is succession with substantially equal resistance through an elastic flexible member 114.

The exerciser's 1400 right hand is preferably closer to the inertial resistance than his left hand and the inertial resistance is preferably located in front of the exerciser; however, any comfortable position in which the inertial resistance resists external shoulder rotation is acceptable. The exerciser 1400 grasps the handle of the device 100 such that his right-hand thumb is adjacent the first end of the flexible member 114 and abducts his right shoulder until his right upper arm is substantially perpendicular to his torso.

Next, the exerciser 1400 externally rotates his right shoulder and supinates his right forearm to his substantially maximal range of motion, as shown in FIG. 14A, which may or may not be his full anatomic range of motion, depending on his degree of conditioning and skill at performing the exercise. Next, the exerciser 1400 internally rotates his right shoulder and pronates his right forearm to his substantially maximal range of motion, as shown in FIG. 14B, which may or may not be his full anatomic range of motion, depending on his degree of conditioning and skill at performing the exercise. The step of externally rotating and supinating preferably includes extension and radial deviation of the exerciser's 1400 right wrist, as shown in FIG. 14A, while the step of internally rotating and pronating preferably includes flexion and ulnar deviation of the exerciser's 1400 right wrist, as shown in FIG. 14B. FIG. 14A shows the flexible member 114 engaging a proximal notch 110 of the device 100, which results in a moment arm variation during the exercise.

The first end of the flexible member 114 can be, but need not be, attached adjacent to the handle of the device 100. It is preferable for this exercise that the first end of the flexible member 114 is attached adjacent to the exerciser's right-hand thumb, as shown in FIGS. 14A–14B. However, if, for example, the exerciser wanted to engage one or more distal notches 110*a* during the exercise, the first end of the flexible member 114 could be attached adjacent to the back of the exerciser's hand so that as the exerciser externally rotates the device 100 against the inertial resistance via the flexible member 114, the flexible member 114 engages one or more distal notches 110*a* of the device 100. The exerciser can attach the flexible member 114 to any part of the device 100 as desired to achieve his exercise objectives.

It is preferable that the exerciser 1400 holds each substantially maximal position for a predetermined time period of at least one second, and preferably one to two seconds, before he continues the exercise. The exerciser 1400 can repeat the external and internal rotation steps as many times as he desires.

Although FIGS. 14A–B show the exerciser 1400 performing the straight-arm lateral external shoulder rotation exercise with his right arm, it will be obvious that the exercise can be performed with either arm as desired by the exerciser.

Figure 14C:
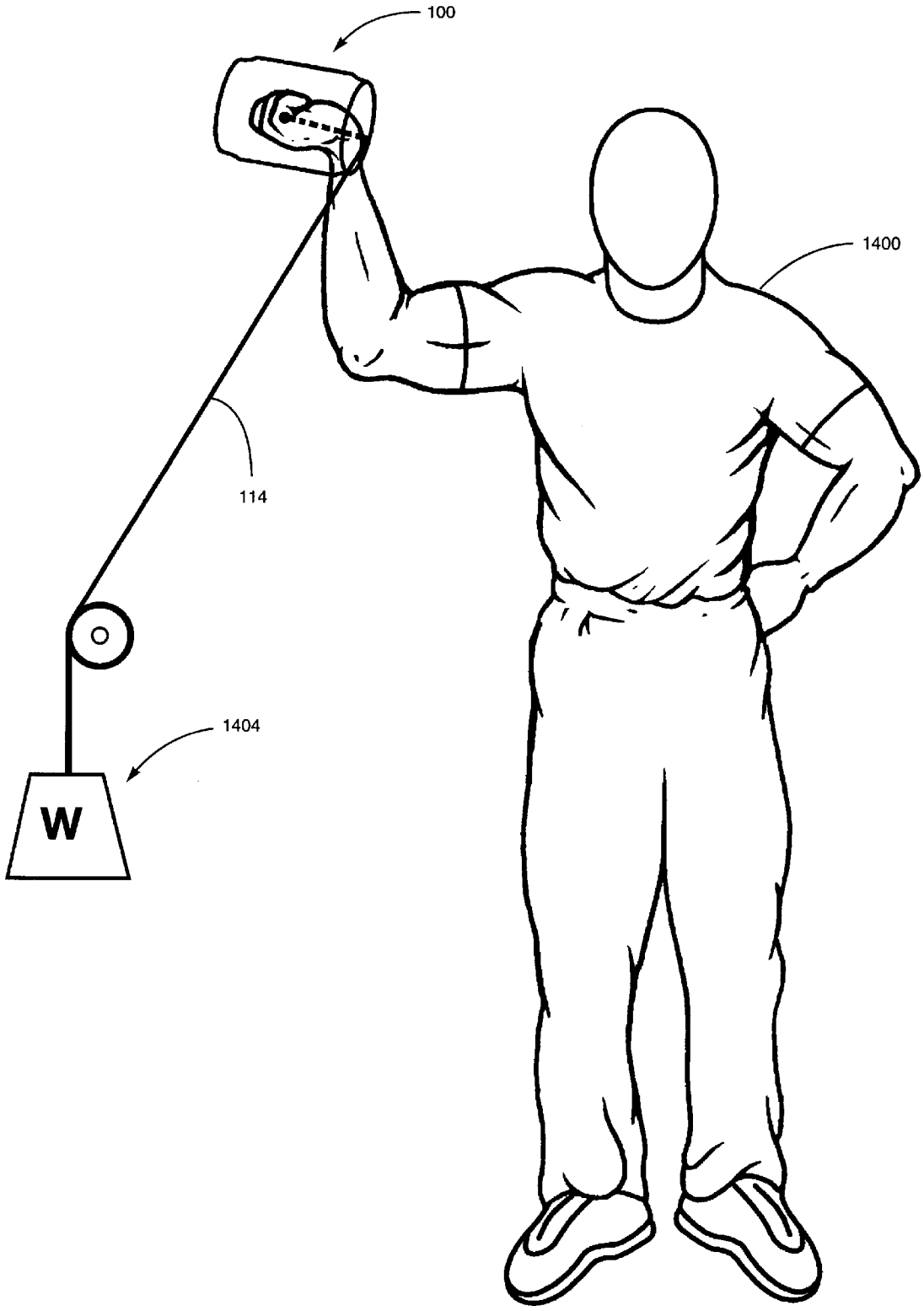
Figure 14D:
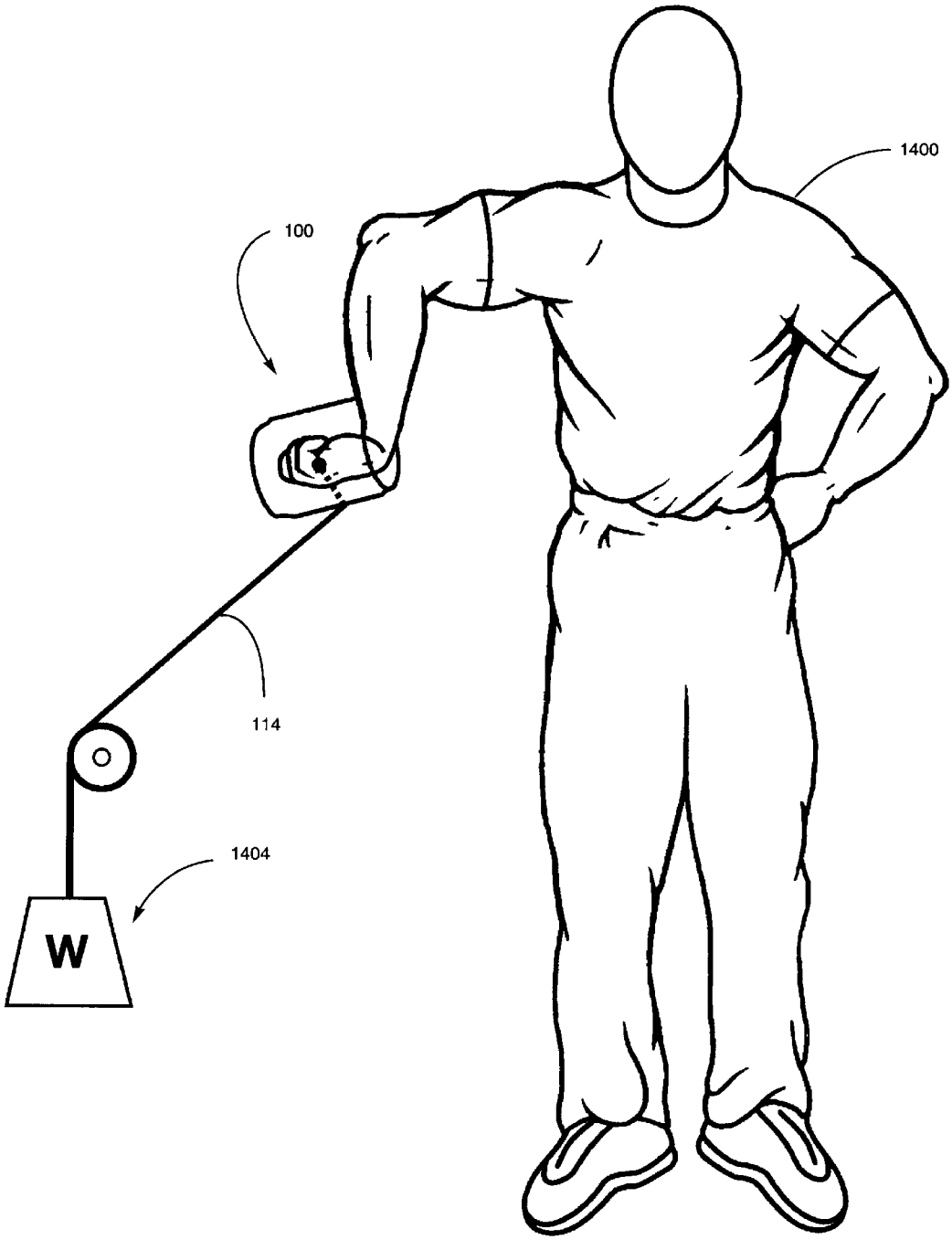

FIGS. 14C–14D are identical to FIGS. 14A–14B, except that the inertial resistance is a moveable inertial resistance, depicted in FIGS. 14C–14D as a weight 1404, and the flexible member 114 is inelastic.

Figure 15A:
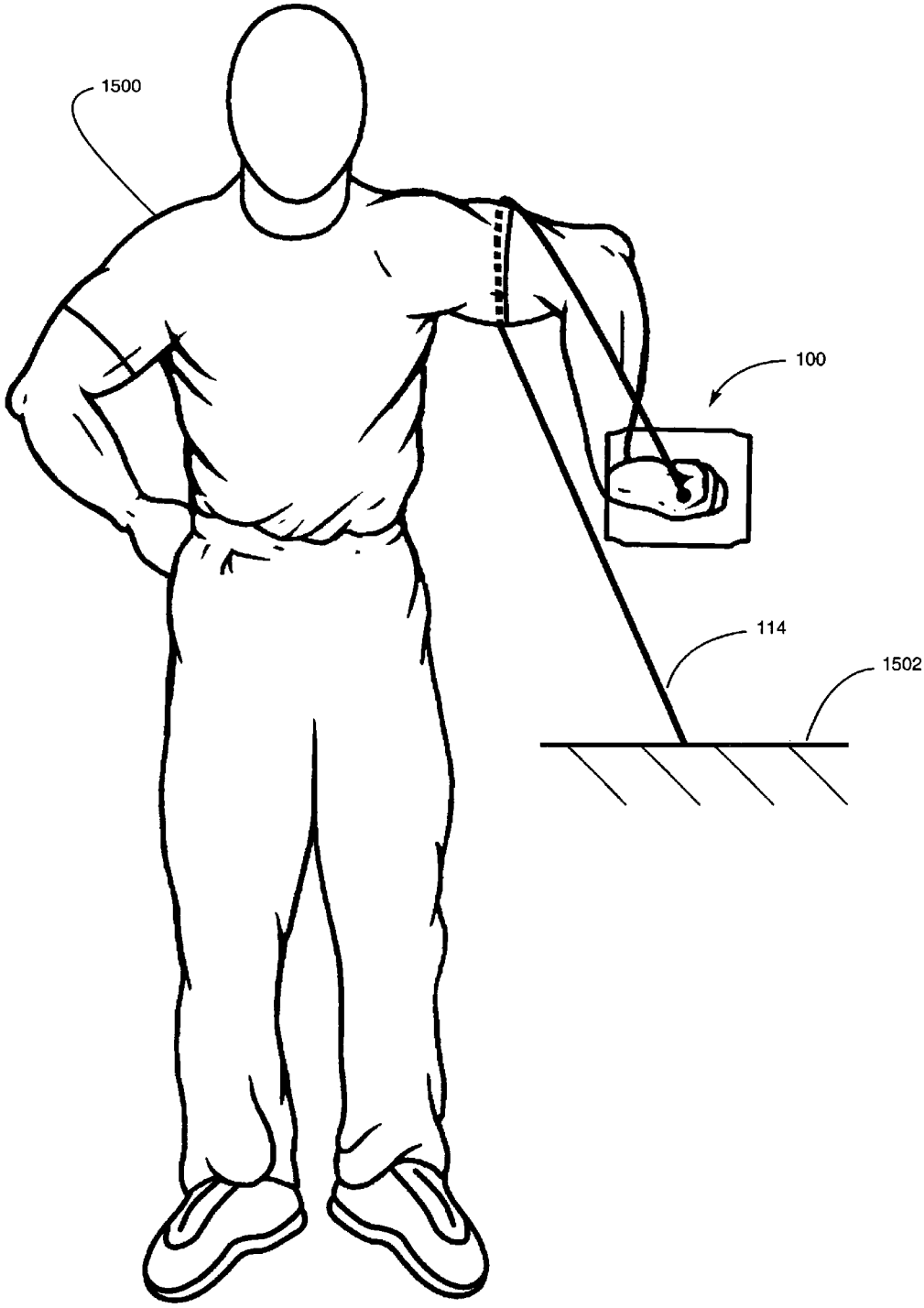
FIGS. 15A–15D are illustrations of an exerciser at various phases of performing an elevated bent-arm internal shoulder rotation exercise in accordance with the teachings of the present invention.
Figure 15B:
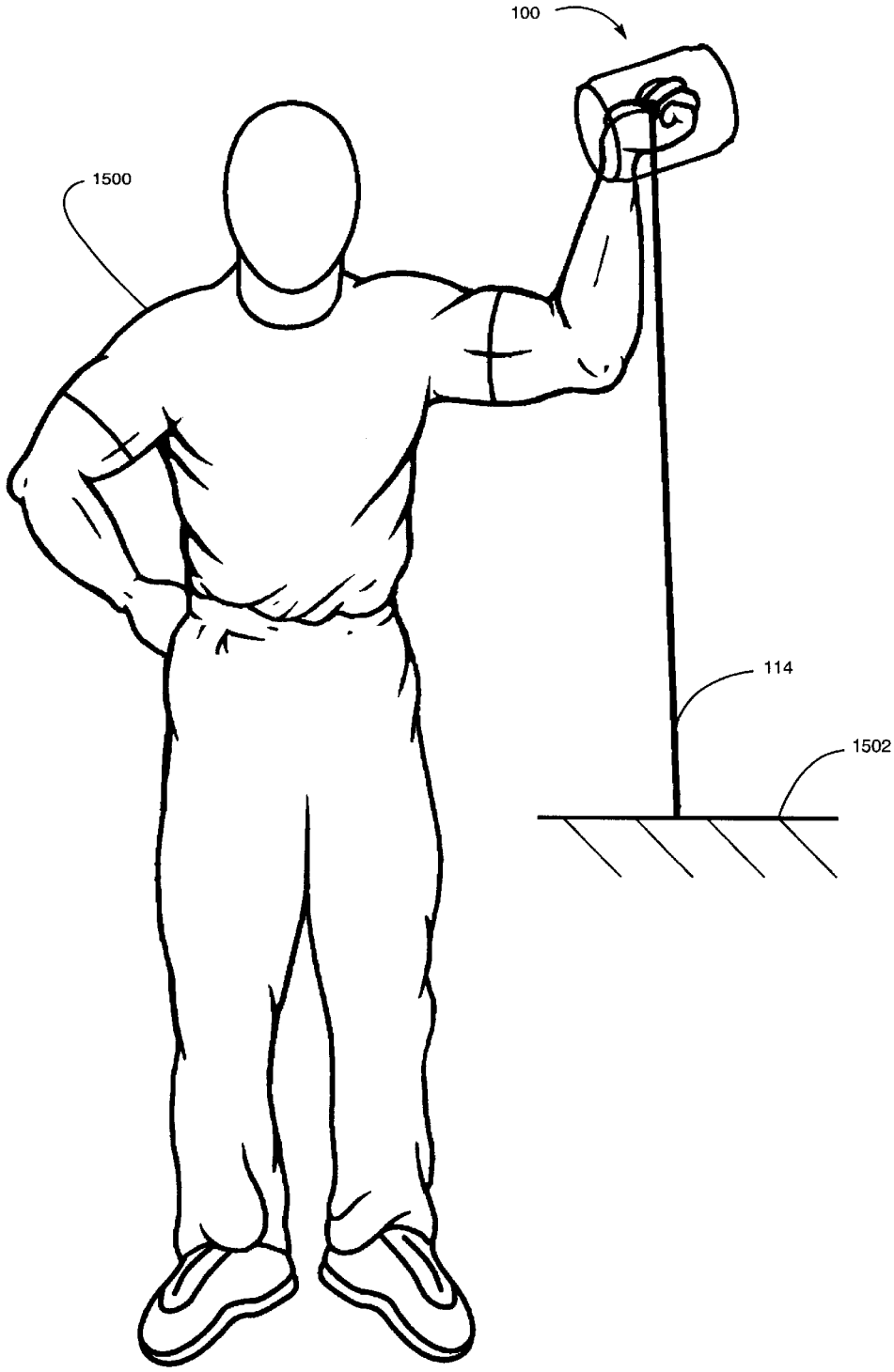

Referring now to FIGS. 15A–15B, shown is an exerciser 1500 performing an internal shoulder rotation exercise embodying concepts of the present invention. The exerciser 1500 is grasping with a left hand a live-hand device 100 having a handle (not shown) disposed within an opening of the device 100. The first end of a flexible member 114 is attached to the device 100 and a second end of the flexible member 114 is attached to an inertial resistance, depicted in FIGS. 15A–15B as a fixed point 1502. The flexible member 114 depicted in FIGS. 15A–15B is elastic. The flexible member 114 can be elastic or inelastic, and the inertial resistance can be a fixed point 1502 or one or more weights, hydraulic resistance devices, springs, or the like. It is preferable that the fixed point 1502 is located at approximately the exerciser's 1502 waist level.

If one or more weights are used as the inertial resistance, it is preferable that they can be moved through space by the exerciser 1502 via the flexible member 114. The device 100 is positioned at a first position at which the flexible member 114 is substantially taut and at which the flexible member 114 extends posteriorly away from the exerciser 1502 toward the inertial resistance. It is also preferable that the exerciser 1502 marks the distance between the first position and the fixed point after he has positioned the device 100 at the first position. Marking the first position allows the exerciser 1502 to record the resistance used when the resistance is supplied by an elastic flexible member 114. Marking is especially valuable when the exerciser 1502 wants to perform an exercise with each arm is succession with substantially equal resistance through an elastic flexible member 114.

The exerciser's 1502 left hand is preferably closer to the inertial resistance than his right hand and the inertial resistance is preferably located behind the exerciser 1502; however, any comfortable position in which the inertial resistance resists internal shoulder rotation is acceptable. The exerciser 1502 grasps the handle of the device 100 such that his left-hand thumb is adjacent the first end of the flexible member 114 and abducts his left shoulder until his left upper arm is substantially perpendicular to his torso.

Next, the exerciser 1502 internally rotates his left shoulder and pronates his left forearm to his substantially maximal range of motion, as shown in FIG. 15A, which may or may not be his full anatomic range of motion, depending on his degree of conditioning and skill at performing the exercise. Next, the exerciser 1502 externally rotates his left shoulder and supinates his left forearm to his substantially maximal range of motion, as shown in FIG. 15B, which may or may not be his full anatomic range of motion, depending on his degree of conditioning and skill at performing the exercise. The step of externally rotating and supinating preferably includes extension and radial deviation of the exerciser's 1502 left wrist, as shown in FIG. 15B, while the step of internally rotating and pronating preferably includes flexion and ulnar deviation of the exerciser's 1502 left wrist, as shown in FIG. 15A.

The first end of the flexible member 114 can be, but need not be, attached adjacent to the handle of the device 100. It is preferable for this exercise that the first end of the flexible member 114 is attached adjacent to the exerciser's 1502 thumb, as shown in FIGS. 15A–15B. However, if, for example, the exerciser wanted to engage one or more distal notches 110*a* during the exercise, the first end of the flexible member 114 could be attached adjacent to the palm of the exerciser's 1502 hand so that as the exerciser 1502 internally rotates the device 100 against the inertial resistance via the flexible member 114, the flexible member 114 engages one or more distal notches 110*a* of the device 100. The exerciser 1502 can attach the flexible member 114 to any part of the device 100 as desired to achieve his exercise objectives.

It is preferable that the exerciser 1502 holds each substantially maximal position for a predetermined time period of at least one second, and preferably one to two seconds, before he continues the exercise. The exerciser 1502 can repeat the external and internal rotation steps as many times as he desires.

Although FIG. 15A–15B shows the exerciser 1502 performing the exercise with his left arm, it will be obvious that the exercise can be performed with either arm as desired by the exerciser 1502.

Figure 15C:
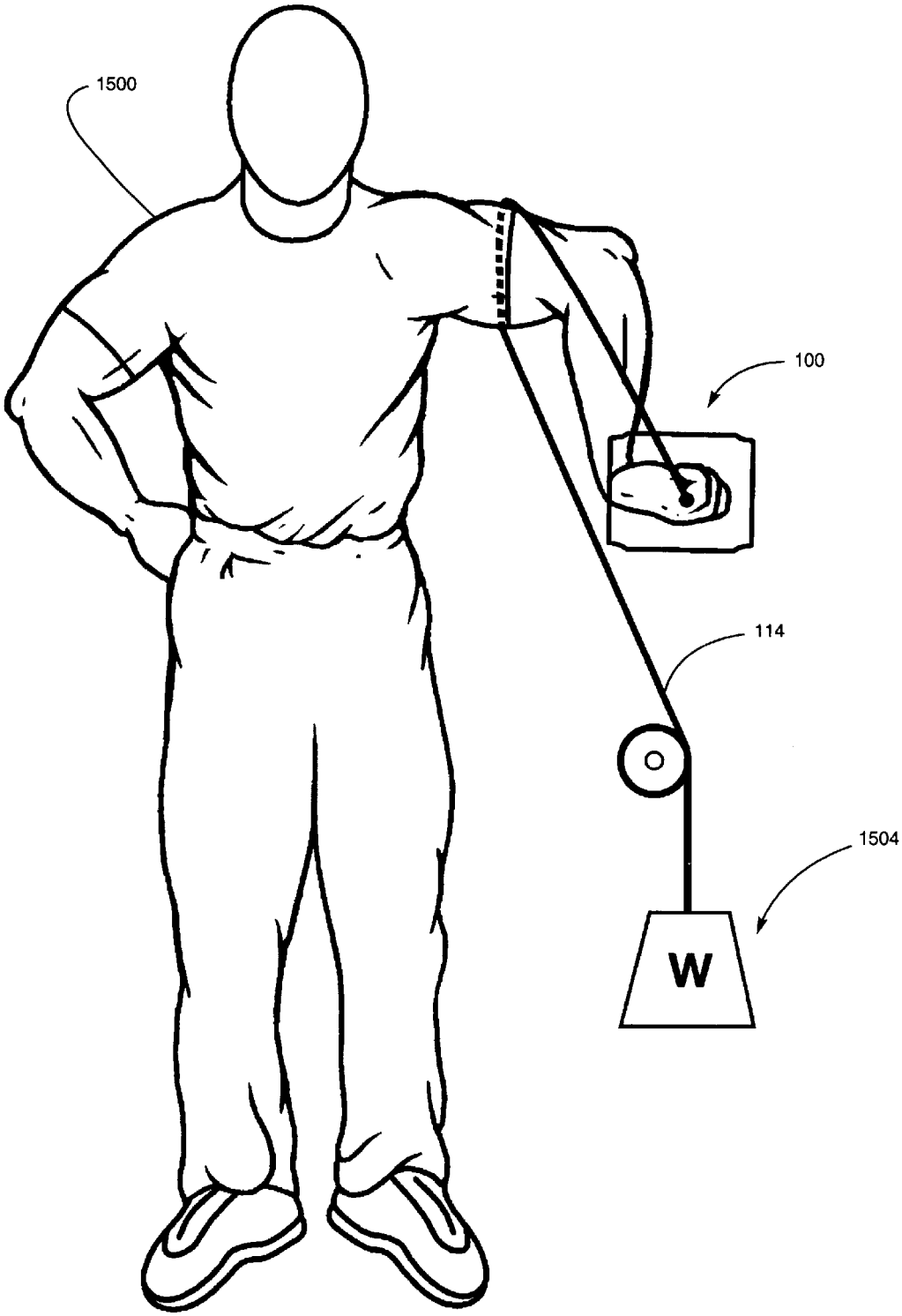
Figure 15D:
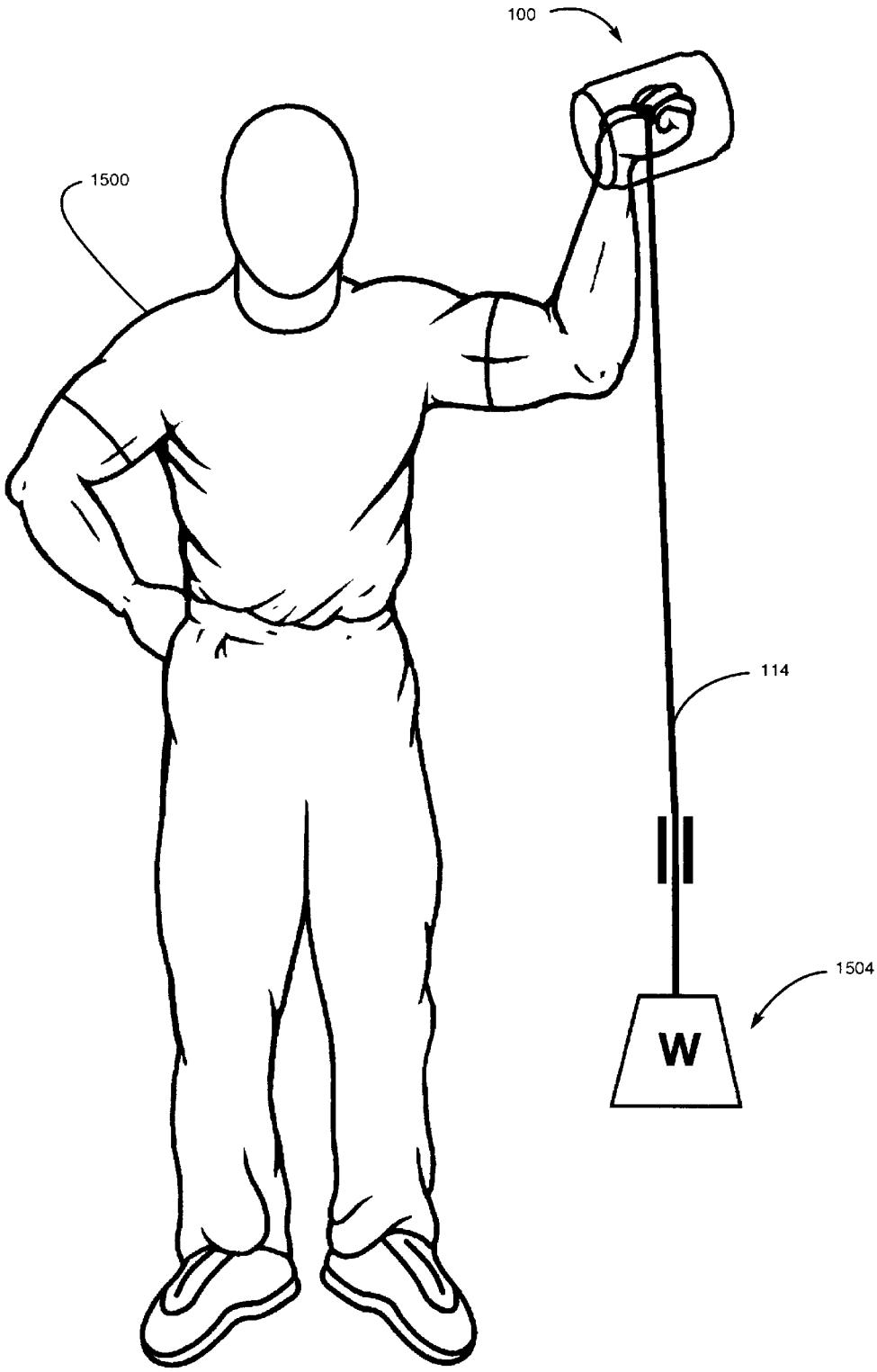

FIGS. 15C–15D are identical to FIGS. 15A–15B, except that the inertial resistance is a moveable inertial resistance, depicted in FIGS. 15C–15D as a weight 1504, and the flexible member 114 is inelastic.

Figure 16A:
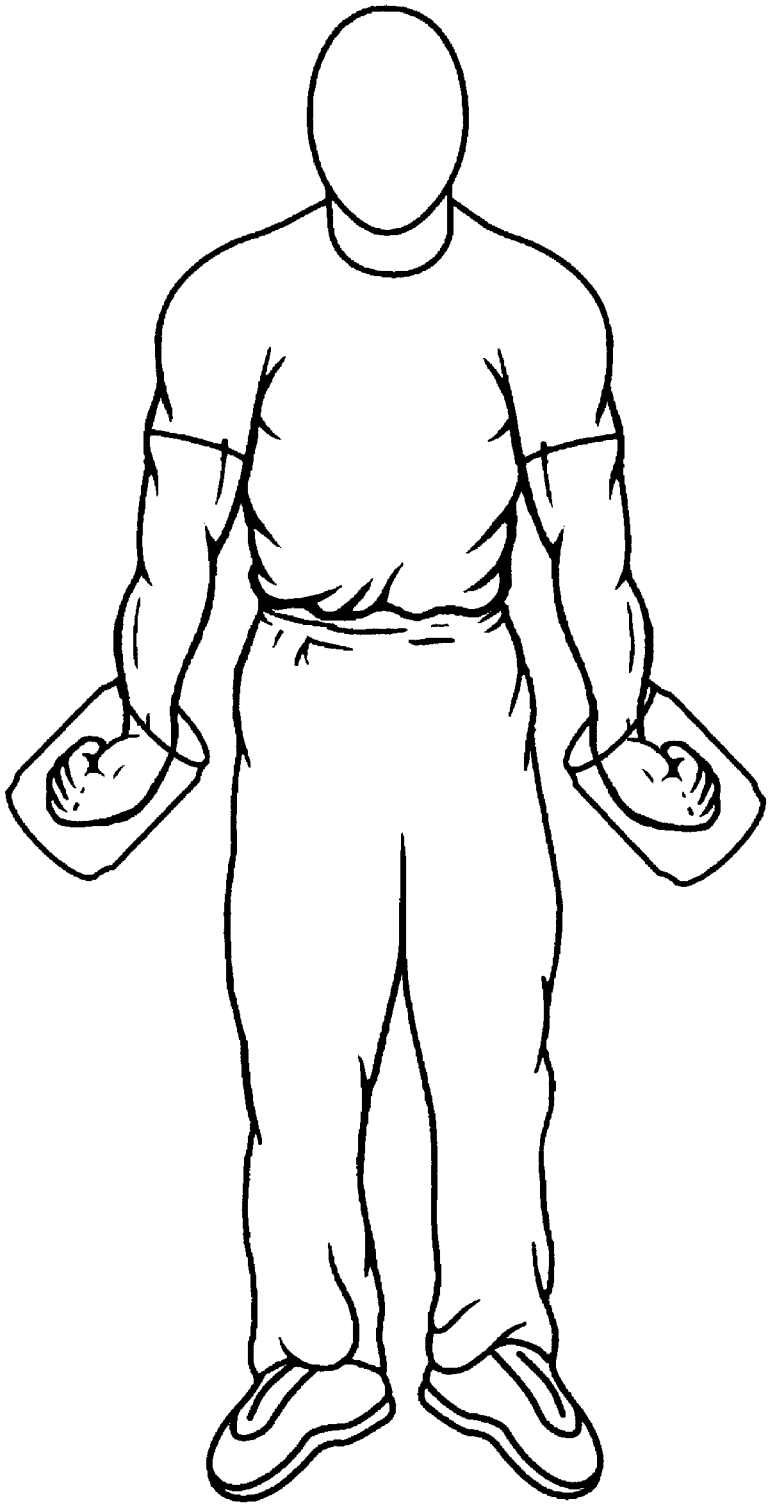
FIGS. 16A–16B are illustrations of an exerciser at various phases of performing a biceps curl exercise in accordance with the teachings of the present invention.
Figure 16B:
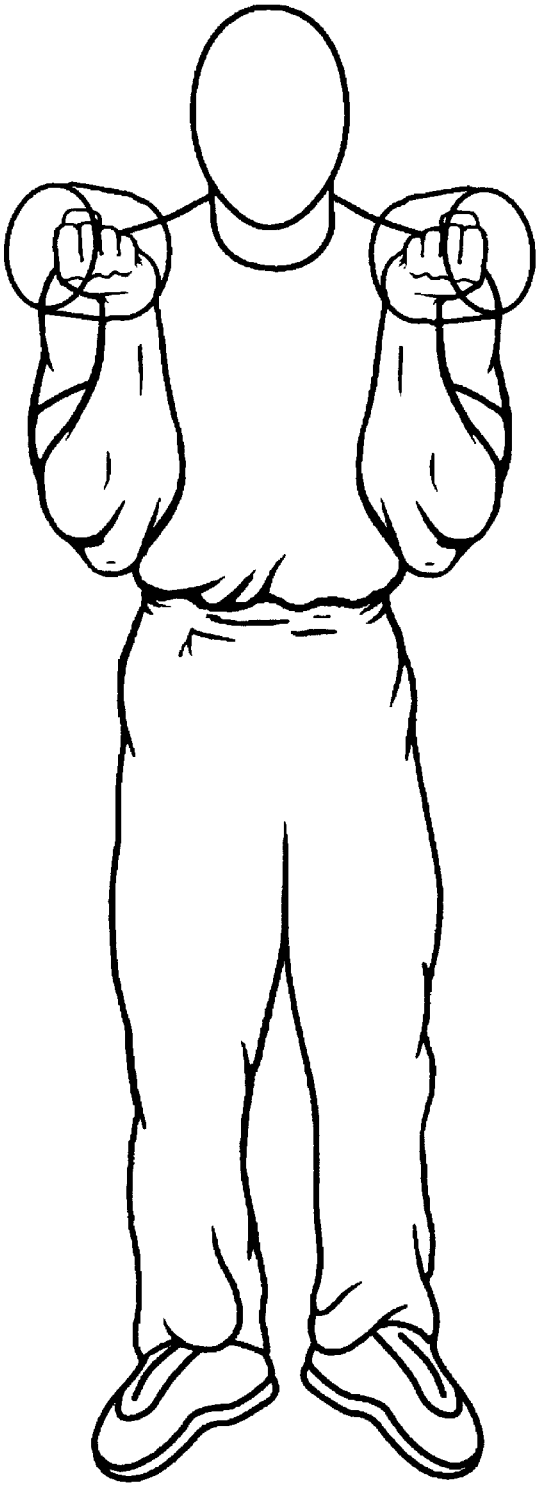

Referring now to FIGS. 16A–16B, shown is an exerciser performing a curl exercise embodying concepts of the present invention. The exerciser is shown grasping in each hand a live-hand device 100. Each live-hand device 100 includes a distal end and a proximal end, a handle (not shown) located between the distal end and the proximal end and disposed within an opening of the device 100, at least one weight (not shown) attached to the device 100 and positioned to resist supination and pronation of the exerciser's forearm, and at least one weight attached to the device 100 distal from the handle (not shown) positioned to resist wrist flexion and extension (when the forearms are supinated or pronated) and radial and ulnar deviation (when the forearms are partially supinated or partially pronated). Unlike many of the exercises described above, the biceps curl exercise is preferably performed without a flexible member 114 attached to either device 100.

The exerciser assumes a beginning position with his elbows substantially extended, his forearms pronated, and his wrists flexed and ulnarly deviated, as shown in FIG. 16A. Next, the exerciser flexes his elbows, supinates his forearms, and extends and radially deviates his wrists, as shown in FIG. 16B. Next, the exerciser reverses the motions just completed to return to the starting position. The exerciser can complete as many of the repetitions of the exercise as desired. It is preferable that the exerciser performs each portion of the exercise to his substantially maximal range of motion.

Figure 17A:
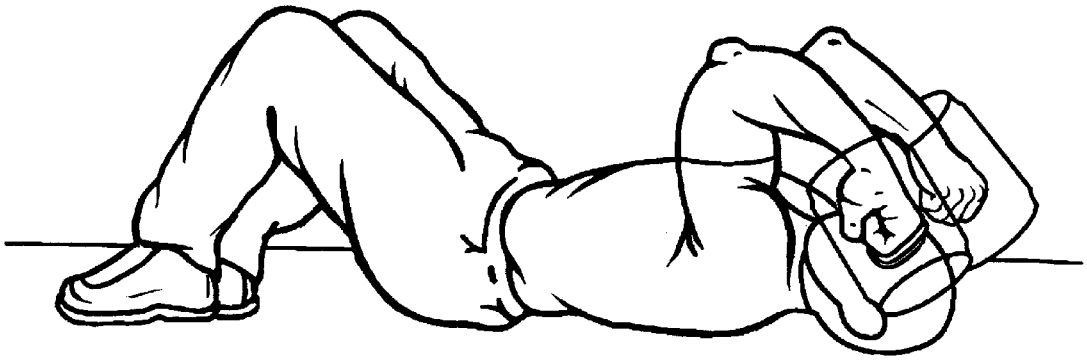
FIGS. 17A–17B are illustrations of an exerciser at various phases of performing a triceps extension exercise in accordance with the teachings of the present invention.
Figure 17B:
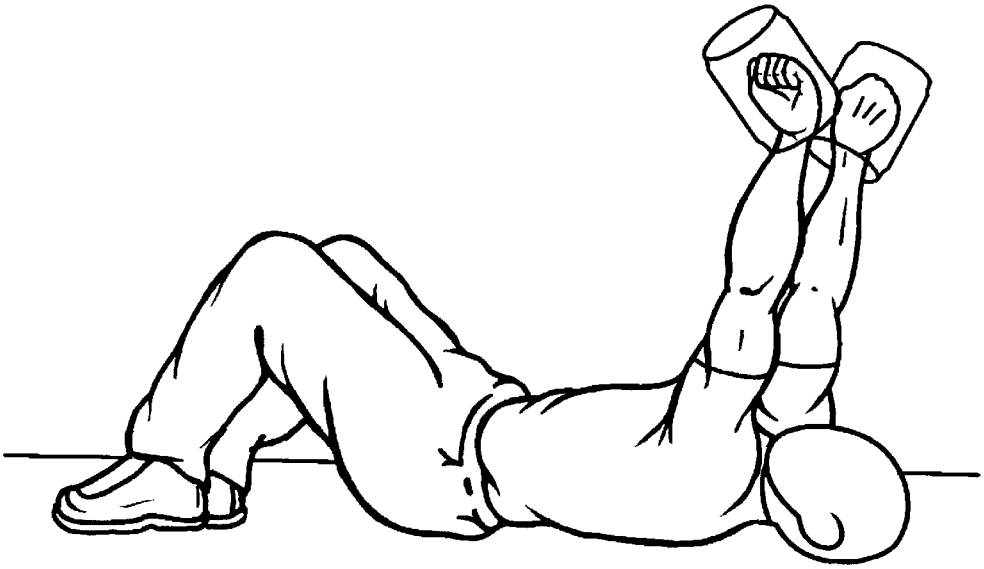

Referring now to FIGS. 17A–17B, shown is an exerciser performing a triceps extension exercise embodying concepts of the present invention. Although the exerciser is shown in a supine position, the triceps extension can also be performed by an exerciser in a seated or standing position.

The exerciser is shown grasping in each hand a live-hand device 100. Each live-hand device 100 includes a distal end and a proximal end, a handle (not shown) located between the distal end and the proximal end and disposed within an opening of the device 100, at least one weight (not shown) attached to the device 100 and positioned to resist supination and pronation of the exerciser's forearm, and at least one weight attached to the device 100 distal from the handle (not shown) positioned to resist wrist flexion and extension (when the forearms are supinated or pronated) and radial and ulnar deviation (when the forearms are partially supinated or partially pronated). Unlike many of the exercises described above, the triceps extension exercise is preferably performed without a flexible member 114 attached to either device 100.

The exerciser assumes a beginning position with his elbows flexed, his forearms supinated, and his wrists extended and radially deviated, as shown in FIG. 17A. Next, the exerciser extends his elbows, pronates his forearms, and flexes and ulnarly deviates his wrists, as shown in FIG. 17B. Next, the exerciser reverses the motions just completed to return to the starting position. The exerciser can complete as many of the repetitions of the exercise as desired. It is preferable that the exerciser performs each portion of the exercise to his substantially maximal range of motion.

Figure 18A:
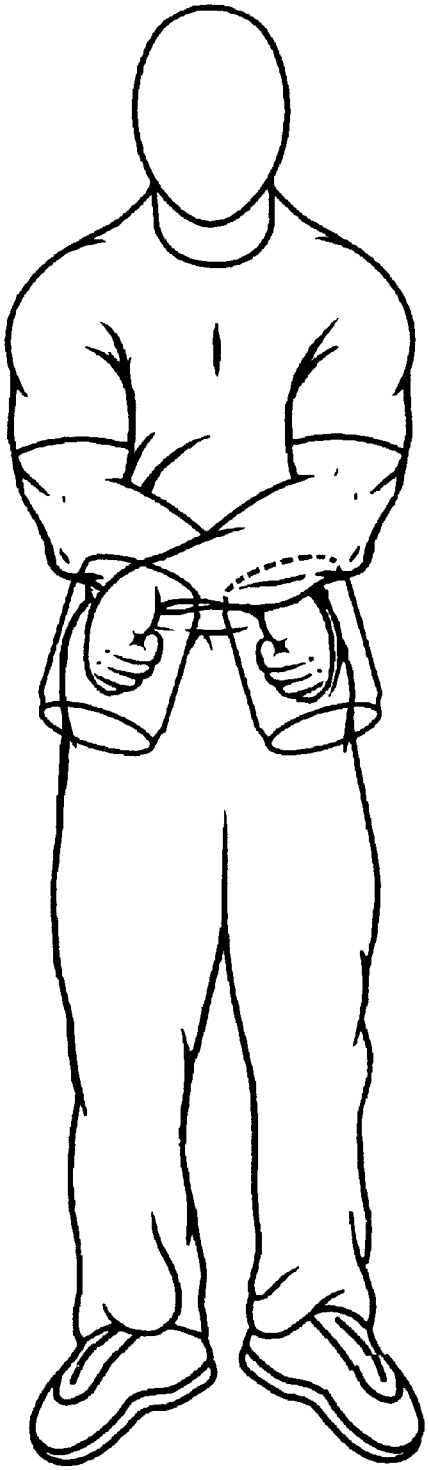
FIGS. 18A–18B are illustrations of an exerciser at various phases of performing a two-handed shoulder fly exercise in accordance with the teachings of the present invention.
Figure 18B:
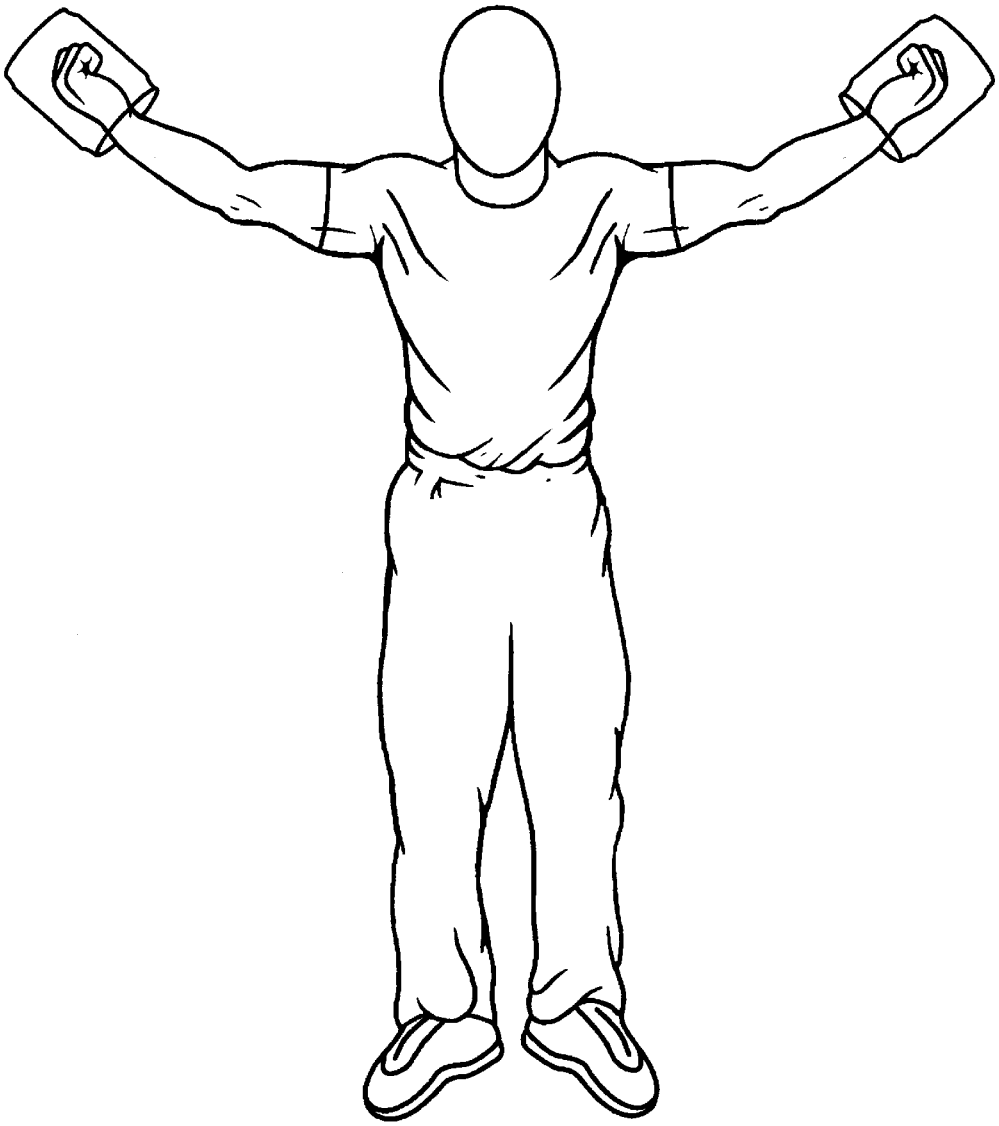

Referring now to FIGS. 18A–18B, shown is an exerciser performing a two-handed shoulder fly exercise embodying concepts of the present invention. The exerciser is shown grasping in each hand a live-hand device 100. Each live-hand device 100 includes a distal end and a proximal end, a handle (not shown) located between the distal end and the proximal end and disposed within an opening of the device 100, at least one weight (not shown) attached to the device 100 and positioned to resist supination and pronation of the exerciser's forearm, and at least one weight attached to the device 100 distal from the handle (not shown) positioned to resist wrist flexion and extension (when the forearms are supinated or pronated) and radial and ulnar deviation (when the forearms are partially supinated or partially pronated). Unlike many of the exercises described above, the two-handed shoulder fly exercise is preferably performed without a flexible member 114 attached to either device 100.

The exerciser assumes a beginning position with his shoulders adducted and internally rotated, his elbows slightly flexed, his forearms pronated, and his wrists flexed and ulnarly deviated, as shown in FIG. 18A. Next, the exerciser extends his elbows, abducts and externally rotates his shoulders, supinates his forearms, and extends and radially deviates his wrists, as shown in FIG. 18B. Next, the exerciser reverses the motions just completed to return to the starting position. The exerciser can complete as many of the repetitions of the exercise as desired. It is preferable that the exerciser performs each portion of the exercise to his substantially maximal range of motion.

It is understood that the present invention can take many forms and embodiments. Accordingly, several variations may be made in the foregoing without departing from the spirit or the scope of the invention. For example, various exercises and various features for varying moment arms in addition to those disclosed herein could be devised.

Although the invention has been described with specific devices and exercises, these descriptions are not meant to be construed in a limiting sense. Various modifications of the disclosed embodiments, as well as alternative embodiments of the invention, will become apparent to persons skilled in the art upon reference to the description of the invention. It is, therefore, contemplated that the claims will cover any such modifications or embodiments that fall within the true scope and spirit of the invention.

What is claimed is:

1. An upper extremity training and rehabilitation device comprising:

a substantially cylindrical base having:

a distal end and a proximal end;

an opening at the proximal end adapted for insertion of an exerciser's hand; and at least one notch formed at at least one of the distal end or the proximal end; and a handle disposed within the opening of the base.

2. The device of claim 1 wherein the handle is approximately perpendicular to the longitudinal axis.

3. The device of claim 1 further comprising at least one weight attached to the distal end of the base.

4. The device of claim 1 further comprising a flexible member having a first end and a second end.

5. The device of claim 4 further comprising the first end of the flexible member being attached to the base.

6. The device of claim 5 wherein the flexible member is elastic.

7. The device of claim 6 wherein the second end of the flexible member is adapted to be attached to an inertial resistance.

8. The device of claim 5 wherein the flexible member comprises a substantially flat strap.

9. The device of claim 2 further comprising at least one detachable weight attached to an exterior surface of the base.

10. The device of claim 3 further comprising at least one weight attached to the distal end of the base.

11. The device of claim 1 wherein a position of the handle is adjustable along a longitudinal axis of the base running substantially perpendicularly to the proximal end and the distal end of the base.

12. The device of claim 1 further comprising at least one hook attached to an exterior surface of the base proximate to the distal end of the base.

13. The device of claim 1 further comprising at least one hook attached to an exterior surface of the base proximate to the proximal end of the base.

14. The device of claim 1 wherein the handle is positioned approximately midway between the distal end and the proximal end of the base.

15. The device of claim 4 wherein the device comprises a plurality of points for attaching the flexible member.

16. The device of claim 1 wherein the handle is adapted to be grasped by a hand of an exerciser.

17. The device of claim 1 wherein the handle is adapted to fit an open hand of an exerciser.

18. The device of claim 1 wherein a portion of an exterior surface of the base is covered by a non-slip material.

19. The device of claim 14 wherein the handle is adapted to be grasped by a hand of an exerciser.

20. The device of claim 14 wherein the handle is adapted to fit an open hand of an exerciser.

21. The device of claim 5 wherein the flexible member is inelastic.

22. The device of claim 15 wherein the handle is shaped to ergonomically fit the hand of the exerciser.

23. The device of claim 16 wherein the handle is shaped to ergonomically fit the open hand of the exerciser.

24. The device of claim 9 wherein the detachable weight is attached to the base via at least one hook-and-loop fastener.

25. The device of claim 9 wherein the detachable weight comprises a pouch containing particulate weighted matter.

26. The device of claim 1 wherein a portion of an exterior surface of the base is covered with at least one hook portion of at least one hook-and-loop fastener.

27. The device of claim 1 wherein a portion of an exterior surface of the base is covered with at least one loop portion of at least one hook-and-loop fastener.

28. The device of claim 9 wherein a center of gravity of the detachable weight is positioned on the exterior of the base adjacent to an end of the handle.

29. The device of claim 9 wherein the at least one detachable weight is positioned so that its center of gravity is adjacent to an end of the handle.

30. The device of claim 9 wherein the at least one detachable weight is positioned so that its center of gravity is adjacent to an end of the handle and is closer to the distal end of the base than the handle.

31. The device of claim 9 wherein the at least one detachable weight is positioned so that its center of gravity is adjacent to an end of the handle and is closer to the proximal end of the base than the handle.

32. The device of claim 7 wherein the second end of the flexible member is attached to an inertial resistance.

33. The device of claim 5 wherein the flexible member is adapted to wrap around an exterior surface of the base.

34. The device of claim 25 wherein the hook portions of the hook-and-loop fasteners are attached at substantially equidistantly-spaced positions around the exterior of the base.

35. The device of claim 26 wherein the loop portions of the hook-and-loop fasteners are attached at substantially equidistantly-spaced positions around the exterior of the base.

36. The device of claim 1 wherein the base further comprises at least one indicator to demarcate rotation of the device in a plane substantially perpendicular to a longitudinal axis of the base, the longitudinal axis running substantially perpendicular to the proximal end and the distal end.

37. The device of claim 5 wherein the device is adapted to permit the flexible member to engage at least one distal notch.

38. The device of claim 5 wherein the device is adapted to permit the flexible member to engage at least one proximal notch.

* * * * *